US007664430B2

(12) United States Patent
Yamashita et al.

(10) Patent No.: US 7,664,430 B2
(45) Date of Patent: Feb. 16, 2010

(54) IMAGE FORMING APPARATUS WITH A HOLDING AMOUNT ADJUSTING UNIT

(75) Inventors: Takayuki Yamashita, Kanagawa (JP); Yutaka Kiuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 11/403,004

(22) Filed: Apr. 13, 2006

(65) Prior Publication Data

US 2007/0065177 A1 Mar. 22, 2007

(30) Foreign Application Priority Data

Sep. 21, 2005 (JP) ..... P2005-274026
Sep. 21, 2005 (JP) ..... P.2005-274509
Sep. 21, 2005 (JP) ..... P.2005-274536

(51) Int. Cl.
*G03G 21/00* (2006.01)

(52) U.S. Cl. ..... 399/127; 399/128; 399/129; 399/343; 399/347; 399/353; 399/354

(58) Field of Classification Search ..... 399/127–129, 399/34–35, 71, 343, 347, 353–354
See application file for complete search history.

(56) References Cited

U.S. PATENT DOCUMENTS 6,049,345 A * 4/2000 Nishio et al. ..... 347/151
2004/0228658 A1* 11/2004 Tomita et al. ..... 399/150

FOREIGN PATENT DOCUMENTS

JP 63-235974 9/1988
JP 63-261380 10/1998

* cited by examiner

*Primary Examiner*—David M Gray
*Assistant Examiner*—Geoffrey T Evans
(74) *Attorney, Agent, or Firm*—Morgan, Lewis & Bockius LLP

(57) ABSTRACT

An image forming apparatus includes an image carrier that rotates in a predetermined direction so as to carry a toner image, a charging member that charges the image carrier by a discharge operation, a toner holding member that is disposed to be in contact with the image carrier so as to hold toner in a portion being in contact with the image carrier and that removes a discharge product generated on the image carrier, and a holding amount adjusting unit that adjusts a toner holding amount of the toner holding member. The holding amount adjusting unit includes an estimation unit that estimates a current toner holding amount of the toner holding member, and a correction unit that corrects the toner holding amount of the toner holding member on a basis of an estimation result obtained from the estimation unit.

8 Claims, 53 Drawing Sheets

FIG. 30

| NUMBER OF SHEETS OF PAPER PRINTED (A4) | | 10K | 20K | 30K | 40K | 50K |
|---|---|---|---|---|---|---|
| TEST CHART 1 | COMPARATIVE EXAMPLE | ○ | △ | × | × | × |
| | EXPERIMENTAL EXAMPLE | ○ | ○ | ○ | ○ | ○ |
| TEST CHART 2 | COMPARATIVE EXAMPLE | ○ | ○ | ○ | △ | × |
| | EXPERIMENTAL EXAMPLE | ○ | ○ | ○ | ○ | ○ |

FIG. 32

| NUMBER OF SHEETS OF PAPER PRINTED (A4) | 10K | 20K | 30K | 40K | 50K |
|---|---|---|---|---|---|
| COMPARATIVE EXAMPLE | ○ | △ | × | × | × |
| EXPERIMENTAL EXAMPLE | ○ | ○ | ○ | ○ | ○ |

△ : PHENOMENON IN WHICH IMAGE BECOMES WHITE IS NOT OBSERVED

○ : PHENOMENON IN WHICH IMAGE BECOMES WHITE IS DIMLY OBSERVED

× : PHENOMENON IN WHICH IMAGE BECOMES WHITE IS OBSERVED

IMAGE FORMING APPARATUS WITH A HOLDING AMOUNT ADJUSTING UNIT

BACKGROUND

1. Technical Field

The present invention relates to an image forming apparatus, such as a printer or a copying machine.

2. Related Art

In a conventional image forming apparatus using an electrophotographic method or an electrostatic recording method, it is general that an image carrier is electrically charged by using a discharge charging member, such as a corotron or a conductive roller to which a bias is applied.

In the discharge charging method, it is not avoidable that discharge products generated by the discharge are attached on an image carrier, such as a photoconductor. If a large amount of discharge products are attached on the image carrier, the electrical characteristic of a surface layer (for example, a photoconductor layer) of the image carrier corresponding to portions, in which the discharge products are attached, is changed under high humidity environment because the discharge products have hygroscopic properties. As a result, there is a possibility that a phenomenon, in which an image becomes white, will occur. In particular, in a condition in which an image forming apparatus is placed under the high humidity environment for a long time, the hygroscopic properties of the discharge products increase even more, and accordingly, the phenomenon in which an image becomes white occurs more frequently.

Here, in order to remove the discharge products, for example, a brush-shaped cleaning member having a high front end force may be used. In this case, however, a photoconductor layer on the image carrier is abraded by the brush and abraded remainder is reattached onto the image carrier, and as a result, an external additive of toner is attached with the reattached remainder as a core. Accordingly, a raindrops shaped filming phenomenon (hereinafter, referred to as a raindrops shaped filming according to the necessity) is apt to occur and the image carrier is apt to be easily scratched because the front end force of the brush is strong. In addition, in order to remove the discharge products by using a blade-shaped cleaning member, it is possible to remove the discharge products by optimizing a parameter of the blade, however, the contact pressure becomes large, which causes a problem in that the blade is bent or makes a noise due to the rubbing and further the image carrier is abraded or the blade itself is abraded (teeth of a blade edge is broken or locally abraded). As a result, the lifetime of the image forming apparatus is shortened.

SUMMARY

The present invention has been made in view of the above circumstances and provides an image forming apparatus.

According to an aspect of the invention, an image forming apparatus includes an image carrier that rotates in a predetermined direction so as to carry a toner image, a charging member that charges the image carrier by a discharge operation, a toner holding member that is disposed to be in contact with the image carrier so as to hold toner in a portion being in contact with the image carrier and that removes a discharge product generated on the image carrier, and a holding amount adjusting unit that adjusts a toner holding amount of the toner holding member. The holding amount adjusting unit includes an estimation unit that estimates a current toner holding amount of the toner holding member and a correction unit that corrects the toner holding amount of the toner holding member on a basis of an estimation result obtained from the estimation unit.

According to another aspect of the invention, an image forming apparatus includes an image carrier that rotates in a predetermined direction so as to carry a toner image, a charging member that charges the image carrier by a discharge operation, a toner holding member that is disposed to be in contact with the image carrier along a direction crossing a movement direction of the image carrier so as to hold toner in a portion being in contact with the image carrier and that removes a discharge product generated on the image carrier, and a holding amount adjusting unit that adjusts a toner holding amount of the toner holding member. The holding amount adjusting unit includes a concentration measuring unit that measures a concentration of an output image in a region along the longitudinal direction of the toner holding member, and a correction unit that corrects the toner holding amount of the toner holding member on a basis of a measuring result obtained from the concentration measuring unit.

BRIEF DESCRIPTION OF THE DRAWINGS

FIG. 30 is an explanatory view illustrating the evaluation on a phenomenon in which an image becomes white in the third example and a third comparative example;

FIG. 32 is an explanatory view illustrating the evaluation on a phenomenon in which an image becomes white in the fourth example and a fourth comparative example;

DETAILED DESCRIPTION OF THE INVENTION

Figure 1:
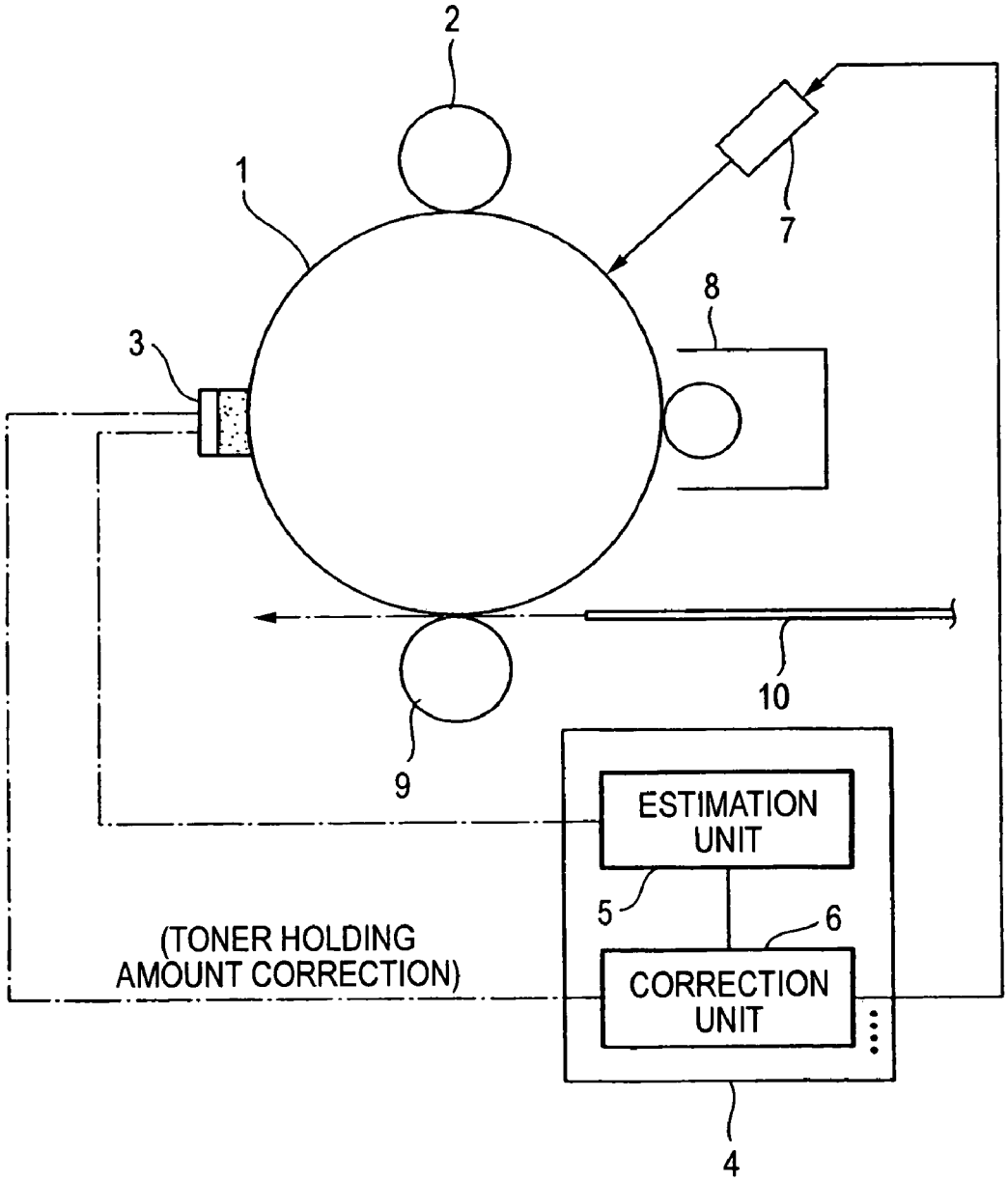
FIG. 1 is a view schematically illustrating an image forming apparatus according to the invention.

In addition, the image forming apparatus shown in FIG. 1 is only an example, and in the drawing, reference numeral 7 represents a latent image writing unit writing an electrostatic latent image on the image carrier 1, reference numeral 8 represents a developing unit that makes the electrostatic latent image on the image carrier 1 visualized by using toner, and reference numeral 9 represents a transfer charging member that transfers a toner image on the image carrier 1 onto a recording medium.

In the invention, as the image carrier 1, a photoconductor, a dielectric, or the like can be properly selected as long as a toner image can be carried. In addition, the image carrier 1 may have an arbitrary shape, such as a drum shape or a belt shape. Further, it is possible to properly select a case having only an image forming carrier on which a toner image can be formed and carried or a case in which a toner image on the image forming carrier is primary-transferred on an intermediate transfer member before being transferred onto a recording medium 10.

Further, the charging member 2 includes a member having a function of charging the image carrier 1 by a discharge operation. For example, the charging member 2 includes a corona charger, such as a corotron or a scorotron, and a bias roller to which a bias is applied. Furthermore, the charging member 2 includes a device used, for example, when an electrostatic latent image is formed on an image carrier, and also includes a device, such as a transfer charging member 9 that transfers a toner image on the image carrier onto the recording medium 10 or a transfer charging member that transfers a toner image from one image carrier element (for example, an image forming carrier) to another image carrier element (for example, an intermediate transfer member) in a case in which the image carrier 1 is divided into plural elements.

Furthermore, it is desirable that the toner holding member 3 hold toner in a portion where the toner holding member 3 is in contact with the image carrier, and a nonwoven fabric, a brush, and the like are used as the toner holding member 3. In addition, the toner holding member 3 may be a part of a cleaning unit or may be a separate element different from the cleaning unit.

Here, the contact pressure of the toner holding member 3 may be properly set by taking the removability of discharge products into consideration. However, as will be described in detail in the following embodiments, the contact pressure of the toner holding member 3 may be set by considering the reduction of water contact angle and the raindrops shaped filming grade.

Furthermore, the holding amount of toner held in the toner holding member 3 may be properly set by taking the removability of discharge products into consideration. For example, a predetermined toner image may be formed on the image carrier 1 and the formed image carrier may be supplied to a front end portion of the toner holding member 3.

In addition, it has been found that, in the case in which the toner holding member 3 is used, the removability of discharge products is achieved when the amount of toner held in the toner holding member 3 is equal to or larger than a predetermined amount, however, when the toner holding amount for the toner holding member 3 becomes non-uniform which generates a portion having a small amount of toner, there occurs a phenomenon in which an image becomes white in a portion corresponding to the portion having a small amount of toner. This phenomenon is noticeable in a case in which an image forming apparatus is placed under a high-humidity condition for a long time. In this case, the abrasion amount of the image carrier 1 is small in the portion in which the image becomes white, as compared with another portion where the phenomenon in which an image becomes white does not occur. As a result, for example, in a case in which the image carrier 1 rotates at a uniform speed, there occurs a problem in that the film thickness of the image carrier 1 becomes non-uniform.

Therefore, in the invention, the holding amount adjusting unit 4 that adjusts the toner holding amount of the toner holding member 3 is provided.

It is desirable that the holding amount adjusting unit 4 is operated when the toner holding amount needs to be adjusted, and an automatic adjusting mode or an artificial adjusting mode is all possible.

In addition, the estimation unit 5 includes any unit capable of estimating the current toner holding amount of the toner holding member 3. That is, it is possible to properly select an estimation unit capable of, for example, estimating the current toner holding amount on the basis of an initial toner holding amount and input image information or estimating the current toner holding amount on the basis of a toner pass-through amount of the toner holding member 3.

In addition, as the correction unit 6, a unit capable of correcting the toner holding amount distribution of the toner holding member 3 may be used, and a unit capable of supplementing the toner holding amount at least so as not to make an image become white may be used.

Further, in the invention, as a representative example of the operation timing of the holding amount adjusting unit 4, there is a case in which the toner holding amount is adjusted by using, as a trigger, a timing signal when the toner holding amount needs to be adjusted. Here, 'when the toner holding amount needs to be adjusted' includes 'when power is on', 'under high temperature and high humidity environment', 'when an image forming apparatus is not used for a long time', 'for regular maintenance', 'when a sleep mode is released', and the like.

In addition, a signal generated, for example, when power is on or when a sleep mode is released (return from a standby mode) is used as the timing signal.

Furthermore, in the invention, the estimation unit 5 estimates and updates the current toner holding amount of the toner holding member 3 on the basis of input image information. That is, the estimation unit 5 estimates the variation of the toner holding amount in the toner holding member 3.

Furthermore, in the invention, the estimation unit 5 estimates the current toner holding amount of the toner holding member 3 on the basis of the amount of toner having passed through the toner holding member 3.

Here, in the case in which the estimation unit 5 estimates the current toner holding amount of the toner holding member 3 on the basis of the amount of toner having passed through the toner holding member 3, the estimation unit 5 has a pass-through amount measuring member at a downstream side of the toner holding member 3 in the vicinity of the image carrier 1. At this time, even though an independent functional member may be used as the pass-through amount measuring member, the charging member 2 that charges the image carrier 1 may also be used as the pass-through amount measuring member in order to reduce the number of components.

In addition, in the invention, the estimation unit 5 estimates the current toner holding amount in a unit of plural blocks in a region along the longitudinal direction of the toner holding member 3. According to the invention, since the current toner holding amount is estimated for each block, the distribution trend of the current toner holding amount can be specified for each block In addition, the correction unit 6 may be properly selected. The correction unit 6 rotates the image carrier 1 by the predetermined number of rotations, makes a corrected image for correcting the toner holding amount of the toner holding member 3 on the image carrier 1 once or plural times, and rubs the corrected image on the toner holding member 3 through the image carrier 1 (corrected-image rubbing method).

In addition, in the invention, the correction unit 6 makes corrected images corresponding to plural blocks, respectively, the plural blocks being obtained by dividing a region along the longitudinal direction of the toner holding member 3. In this case, it is possible to make the corrected image for each block so as to correct the toner holding amount distribution.

Further, in the invention, the correction unit 6 corrects the toner holding amount such that the toner holding amount per unit length of the toner holding member 3 is equal to or larger than a predefined allowable amount.

Furthermore, in the invention, the correction unit 6 corrects the toner holding amount such that the toner holding amount per unit length of the toner holding member 3 is equal to or larger than a predefined allowable amount and the toner holding amount per unit length of the toner holding member 3 is approximately uniform along the longitudinal direction of the toner holding member 3.

Furthermore, in the invention, the correction unit 6 classifies estimation result information obtained from the estimation unit 5 into one or plural threshold values and makes a corrected image, having concentration distribution apt to be opposite to the current toner holding amount, for each of the classified threshold values.

Here, the 'corrected image having concentration distribution apt to be opposite to the current toner holding amount for each of the classified threshold values' means that a low-concentration corrected image is formed with respect to a portion having a large toner holding amount and a high-concentration corrected image is formed with respect to a portion having a small toner holding amount. In this case, the low-concentration corrected image includes a zero-concentration corrected image.

In addition, in the invention, if the current toner holding amount of the toner holding member 3 is determined to be smaller than an allowable value on the basis of the estimation result obtained from the estimation unit 5, the correction unit 6 discharges toner held in the toner holding member 3 and reattaches toner so as to correspond to the allowable value or more (toner discharging/reattaching method).

Figure 33:
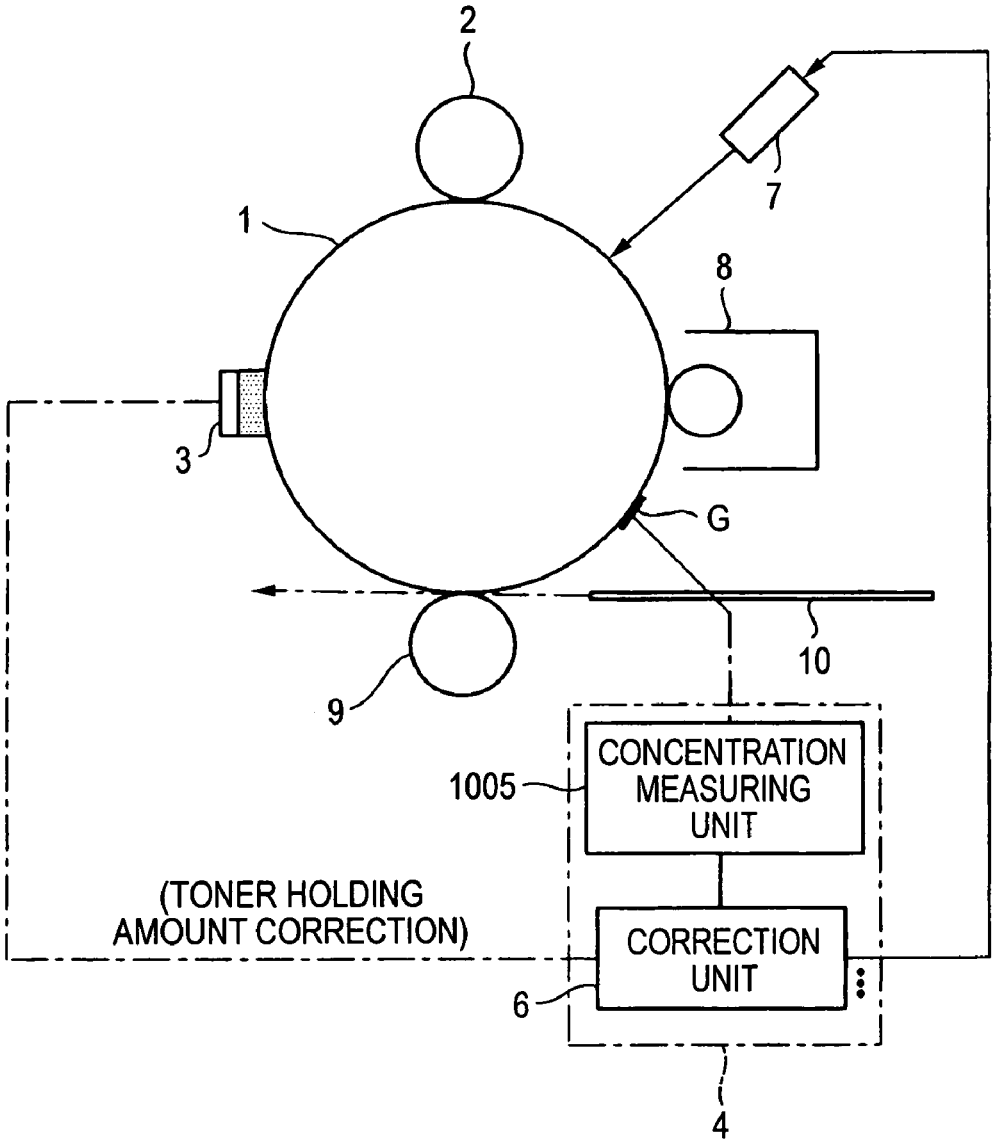
FIG. 33 is a view schematically illustrating an image forming apparatus according to the invention.
Figure 34:
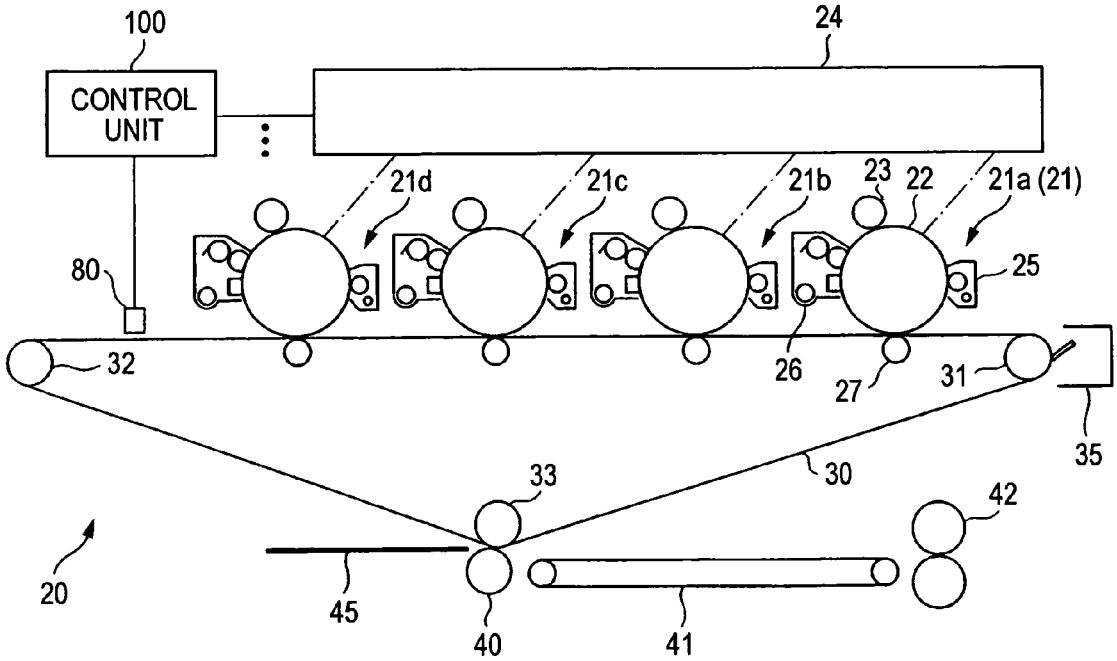
FIG. 34 is a view illustrating the entire configuration of an image forming apparatus according to a fifth embodiment of the invention.

The image forming apparatus shown in FIG. 33 is only an example, and in the drawing, reference numeral 7 represents a latent image writing unit writing an electrostatic latent image on the image carrier 1, reference numeral 8 represents a developing unit that makes the electrostatic latent image on the image carrier 1 visualized by using toner, and reference numeral 9 represents a transfer charging member transferring a toner image on the image carrier 1 onto a recording medium.

In the invention, as the image carrier 1, a photoconductor, a dielectric, or the like can be properly selected as long as a toner image can be carried. In addition, the image carrier 1 may have an arbitrary shape, such as a drum shape or a belt shape. Further, it is possible to properly select a case having only an image forming carrier on which a toner image can be formed and carried or a case in which a toner image on the image forming carrier is primary-transferred on an intermediate transfer member before being transferred onto a recording medium 10.

Further, the charging member 2 includes a member having a function of charging the image carrier 1 by a discharge operation. For example, the charging member 2 includes a corona charger, such as a corotron or a scorotron, and a bias roller to which a bias is applied. Furthermore, the charging member 2 includes a device used, for example, when an electrostatic latent image is formed on an image carrier, and also includes a device, such as a transfer charging member 9 transferring a toner image on the image carrier onto the recording medium 10 or a transfer charging member that transfers a toner image from one image carrier element (for example, an image forming carrier) to another image carrier element (for example, an intermediate transfer member) in a case in which the image carrier 1 is divided into plural elements.

Furthermore, it is desirable that the toner holding member 3 holds toner in a portion where the toner holding member 3 is in contact with the image carrier, and a nonwoven fabric, a brush, and the like are used as the toner holding member 3. In addition, the toner holding member 3 may be a part of a cleaning unit or may be a separate element different from the cleaning unit.

Here, the contact pressure of the toner holding member 3 may be properly set by taking the removability of discharge products into consideration. However, as will be described in detail in the following embodiments, the contact pressure of the toner holding member 3 may be set by considering the reduction of water contact angle and the raindrops shaped filming grade.

Furthermore, the holding amount of toner held in the toner holding member 3 may be properly set by taking the removability of discharge products into consideration. For example, a predetermined toner image may be formed on the image carrier 1 and the formed image carrier may be supplied to a front end portion of the toner holding member 3.

Furthermore, it has been found that, in the case in which the toner holding member 3 is used, the removability of discharge products is achieved when the amount of toner held in the toner holding member 3 is equal to or larger than a predetermined amount, however, when the toner holding amount for the toner holding member 3 becomes non-uniform which generates a portion having a small amount of toner, there occurs a phenomenon in which an image becomes white in a portion corresponding to the portion having a small amount of toner. This phenomenon is noticeable in a case in which an image forming apparatus is placed under a high-humidity condition for a long time. In this case, the abrasion amount of the image carrier 1 is small in the portion in which the image becomes white, as compared with another portion where the phenomenon in which an image becomes white does not occur. As a result, for example, when the image carrier 1 rotates at a uniform speed, in a case in which the image carrier 1 rotates at a uniform speed, there occurs a problem in that the film thickness of the image carrier 1 becomes non-uniform.

Therefore, in the invention, the holding amount adjusting unit 4 capable of adjusting the toner holding amount of the toner holding member 3 is provided.

It is desirable that the holding amount adjusting unit 4 is operated when the toner holding amount needs to be adjusted, and an automatic adjusting mode or an artificial adjusting mode is all possible.

In addition, as the concentration measuring unit 1005, it is possible to properly select, for example, a line sensor disposed in the longitudinal direction of the toner holding member 3, a sensor system in which plural separate sensors are disposed in the longitudinal direction of the toner holding member 3, or a movable sensor moving in the longitudinal direction of the toner holding member 3.

In addition, as the correction unit 6, a unit capable of correcting the toner holding amount distribution of the toner holding member 3 may be used, and to use a unit capable of supplementing the toner holding amount at least so as not to make an image become white.

Further, in the invention, as a representative example of the operation timing of the holding amount adjusting unit 4, there is a case in which the toner holding amount is adjusted by using, as a trigger, a timing signal when the toner holding amount needs to be adjusted. Here, 'when the toner holding amount needs to be adjusted' includes 'when power is on', 'under high temperature and high humidity environment', 'when an image forming apparatus is not used for a long time', 'for regular maintenance', 'when a sleep mode is released', and the like.

In addition, a signal generated, for example, when power is on or when a sleep mode is released (return from a standby mode) is used as the timing signal.

Furthermore, the concentration measuring unit 1005 may be properly selected. The concentration measuring unit 1005 measures the concentration of an output image formed on the image carrier 1, or measures the concentration of an output image transferred from the image carrier 1 onto a recording medium 10.

Furthermore, in the invention, the concentration measuring unit 1005 measures the concentration of an output image in a unit of plural blocks in the region along the longitudinal direction of the toner holding member 3.

According to the invention, since the concentration of the output image is measured for each block, it is possible to specify the distribution trend of the output image for each block.

In addition, the correction unit 6 may be properly selected. The correction unit 6 rotates the image carrier 1 by the predetermined number of rotations, makes a corrected image for correcting the toner holding amount of the toner is holding member 3 on the image carrier 1 once or plural times, and rubs the corrected image on the toner holding member 3 through the image carrier 1 (corrected-image rubbing method).

In addition, in the invention, the correction unit 6 makes corrected images corresponding to plural blocks, respectively, the plural blocks being obtained by dividing a region along the longitudinal direction of the toner holding member 3. In this case, it is possible to make the corrected image for each block so as to correct the toner holding amount distribution.

Further, in the invention, the correction unit 6 corrects the toner holding amount such that the toner holding amount per unit length of the toner holding member 3 is equal to or larger than a predefined allowable amount. In this case, since the toner holding amount is equal to or larger than the allowable amount over the entire range, it is possible to effectively prevent a phenomenon in which an image becomes white due to a portion having a small amount of toner.

Furthermore, in the invention, the correction unit 6 corrects the toner holding amount such that the toner holding amount per unit length of the toner holding member 3 is equal to or larger than a predefined allowable amount and the toner holding amount per unit length of the toner holding member 3 is approximately uniform along the longitudinal direction of the toner holding member 3. In this case, since the toner holding amount is equal to or larger than the allowable amount over the entire range and at the same time approximately uniform, it is possible to remove the discharge products on the image carrier 1 reliably and uniformly.

Furthermore, in the invention, the correction unit 6 classifies a measuring result obtained from the concentration measuring unit 1005 into one or plural threshold values and makes a corrected image having concentration distribution apt to be opposite to concentration distribution for each of the classified threshold values. According to the invention, since the concentration of the output image is classified into one or plural threshold values and the corrected image is made corresponding to each of the classified threshold values, it is possible to perform an optimal toner holding amount correction for each of the classified threshold values.

Here, the 'corrected image having concentration distribution apt to be opposite to concentration distribution for each of the classified threshold values' means that a low-concentration corrected image is formed with respect to a portion having a large toner holding amount and a high-concentration corrected image is formed with respect to a portion having a small toner holding amount. In this case, the low-concentration corrected image includes a zero-concentration corrected image (no image).

However, a low-concentration corrected image may be made, which is not a zero-concentration corrected image, with respect to a high-concentration image portion measured by the concentration measuring unit 1005. As such, by proving a low-concentration corrected image, which is not a zero-concentration corrected image, with respect to the high-concentration image portion, it is possible to prevent an image carrier 1 from abrading when the image carrier 1 rotates.

As described above, according to the invention, even if discharge products are attached on the image carrier in the image forming apparatus in which the image carrier is electrically charged by a discharge operation of the charging member, the removability of the discharge products can be reliably maintained by using the toner holding member.

In particular, in the invention, since the holding amount adjusting unit capable of adjusting the toner holding amount of the toner holding member is provided, and the holding amount adjusting unit includes the concentration measuring unit that measures the concentration of an output image in a region along the longitudinal direction of the toner holding member and the correction unit that corrects the toner holding amount of the toner holding member on the basis of a measuring result obtained from the concentration measuring unit, it is possible to maintain the toner holding amount of the toner holding member in a desired state. As a result, it is possible to effectively prevent a phenomenon in which an image becomes white as the toner holding amount is locally reduced and a phenomenon in which the image carrier abrades non-uniformly and to reliably maintain the removability of the discharge products.

Hereinafter, embodiments of the invention will be described in detail with reference to the accompanying drawings.

First Embodiment

Figure 2:
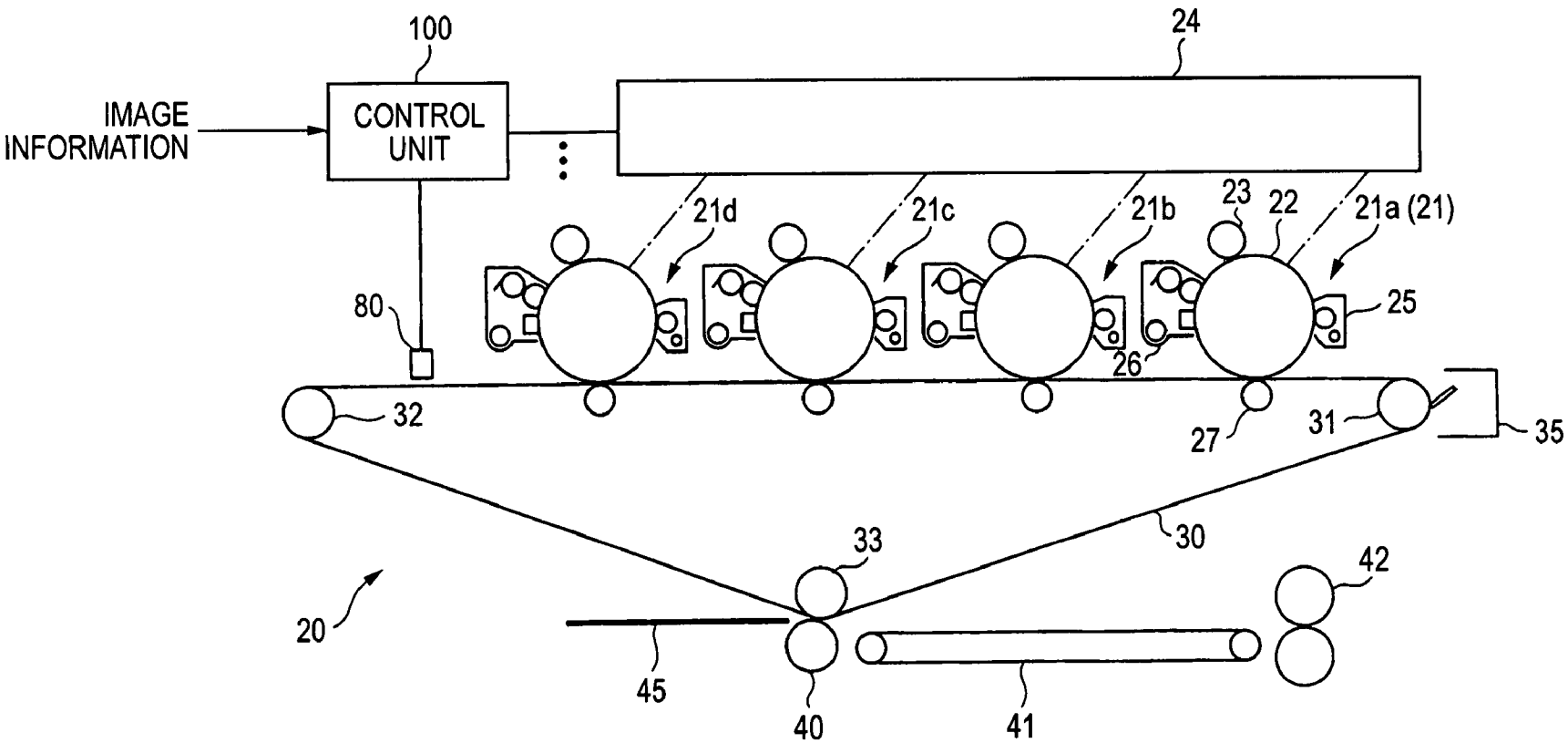
FIG. 2 is a view illustrating the entire configuration of an image forming apparatus according to a first embodiment of the invention.

FIG. 2 is an explanatory view illustrating the entire configuration of an image forming apparatus according to a first embodiment of the invention.

In FIG. 2, an image forming apparatus 20 is a tandem-type image forming apparatus using an intermediate transfer method. In the image forming apparatus 20, for example, image generating units 21 (specifically, 21*a* to 21*d*) corresponding to yellow (Y), magenta (M), cyan (c), and black (M) are horizontally disposed, and an intermediate transfer member 30 having, for example, a belt shape is disposed to be opposite to the image generating units 21.

Figure 3A:
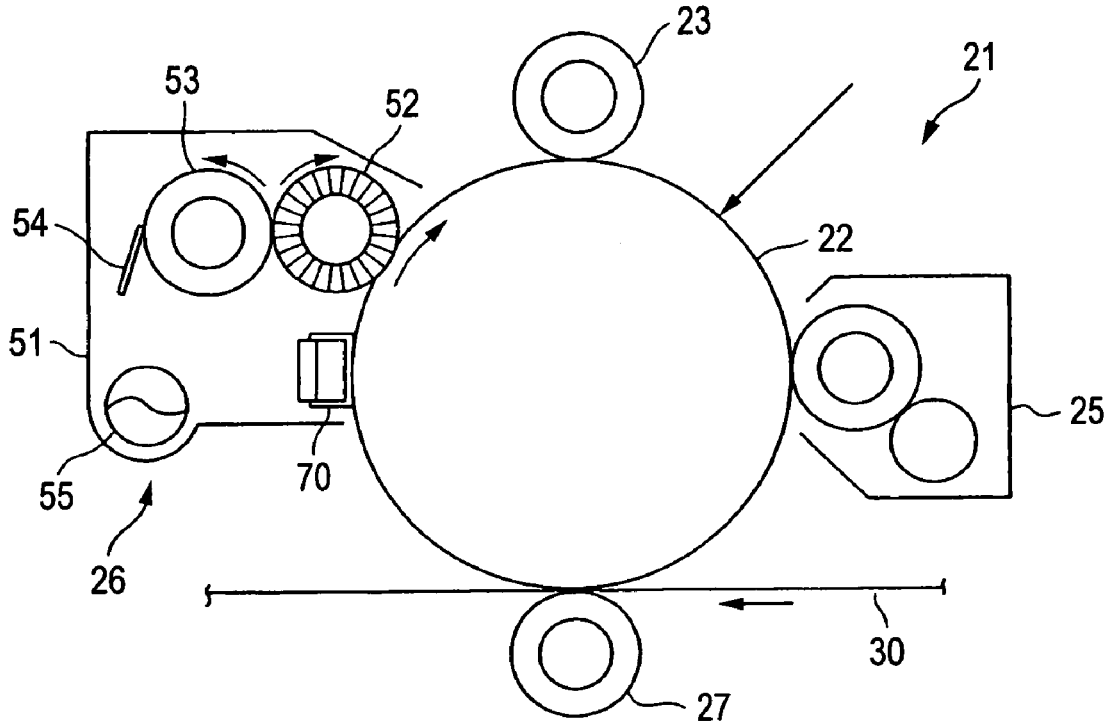
FIG. 3A is a view illustrating the detail of an example of an image generating unit used in the embodiment.
Figure 3B:
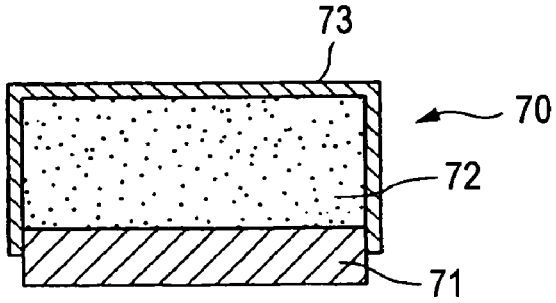
FIG. 3B is a view illustrating the detail of a toner holding member used in the embodiment.

In the present embodiment, each of the image generating units 21 (21*a* to 21*d*) has a photosensitive drum 22 rotating in a predetermined direction, as shown in FIGS. 2 and 3A. In the vicinity of the photosensitive drum 22, a charger 23 which charges the photosensitive drum 22 and is composed of, for example, a charging roll to which a bias is applied, an image writing unit 24 which writes an electrostatic latent image on the charged photosensitive drum 22 and is composed of, for example, an exposing unit, a developing unit 25 which makes an electrostatic latent image written on the photosensitive drum 22 visualized by using toner corresponding to each color component, and a cleaner 26 which cleans toner remaining on the photosensitive drum 22 are sequentially disposed.

In addition, in the present embodiment, even though the image writing unit 24 is common to the image generating units 21, the image writing unit 24 may be separately provided for each of the image generating units 21.

Furthermore, the intermediate transfer member 30 is stretched by plural tension rollers 31 to 33 and is rotated by, for example, the tension roller 31 serving as a driving roller. In addition, on the bottom side of the intermediate transfer member 30 facing each of the photosensitive drums 22, primary transfer chargers (in this embodiment, primary transfer rollers) 27 are respectively disposed such that a predetermined primary transfer bias is applied thereto. In addition, a secondary transfer charger (in this embodiment, a secondary transfer roller) 40 is disposed on a portion of the intermediate transfer member 30 facing the tension roller 33 such that a predetermined secondary transfer bias is applied between the secondary transfer charger 40 and the tension roller 33 serving as a backup roller.

Further, on a downstream side of a secondary transfer portion of the intermediate transfer member 30, for example, on a portion of the intermediate transfer member 30 facing the tension roller 31, an intermediate transfer cleaner 35 is disposed so as to clean toner remaining on the intermediate transfer member 30.

In addition, reference numeral 41 denotes a conveying belt for conveying a recording medium 45 having passed through the secondary transfer charger 40 and reference numeral 42 denotes a fixer for fixing a non-fixed toner image transferred onto the recording medium 45.

Figure 4:
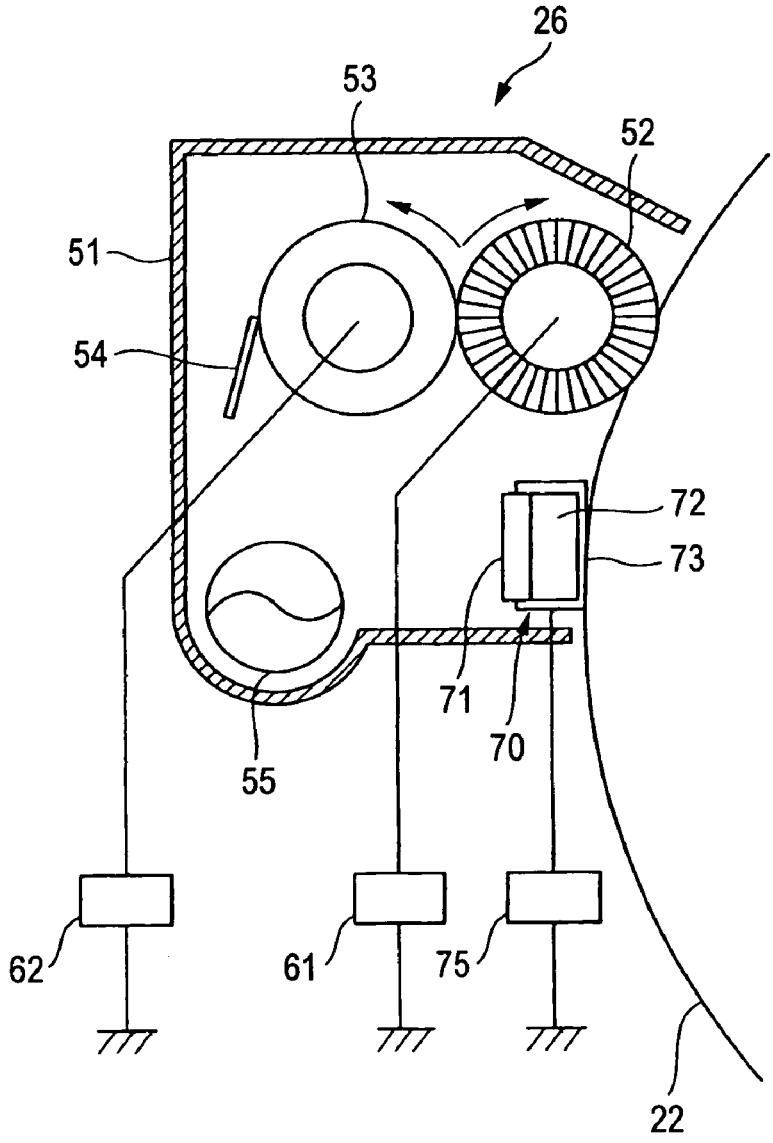
FIG. 4 is a view illustrating the detail of a cleaning unit used in the embodiment.

Further, in the present embodiment, as shown in FIGS. 3A and 4, the cleaner 26 includes, for example, a cleaner housing 51 opened toward the photosensitive drum 22, a rotating brush 52 provided on the opening of the cleaner housing 51 so as to clean the photosensitive drum 22, a collection roller 53 provided on a rear side of the rotating brush 52, and a scraper 54 provided on the collection roller 53 so as to perform a scraping operation.

In the present embodiment, the rotating brush 52 is formed by embedding a conductive brushing material around a core material and is connected to a cleaning bias power source 61 that applies a predetermined cleaning bias (including a case when DC component is 0V). On the other hand, a collection bias power source 62 is connected to the collection roller 53 so that a collection bias, which is a potential difference between the collection bias power source 62 and the cleaning bias power source 61, can be applied to the collection roller 53. In addition, on the bottom of the cleaner housing 51, there is provided a conveying auger 55 for conveying wasted toner to a collection box (not shown).

Furthermore, in the present embodiment, even though the collection roller 53 and the scraper 54 are used for the rotating brush 52, a simple collection system may be adopted, for example, by providing only a flicking bar in a system having, for example, a small amount of remaining toner or retransferred toner.

Furthermore, in the present embodiment, the cleaner 26 has a toner holding member 70 disposed at the upstream side of the rotating brush 52.

The toner holding member 70 is disposed to be in contact with the photosensitive drum 22. For example, the toner holding member 70 is formed by attaching and fixing an elastic member 72, such as a urethane sponge, on a support plate 71 such as a metal plate, and then by attaching and fixing a conductive nonwoven fabric 73 on the elastic member 72. To the non-woven fabric 73, a charge-adjusting bias power source 75, which applies, for example, a charge-adjusting bias having the same polarity (for example, a negative polarity) as a is charging polarity of toner, is applied.

Here, as the non-woven fabric 73, one having the conductivity may be properly selected. For example, there is used a non-woven fabric formed by mixing conductive wool (for example, conductive nylon: registered trademark, the same hereinafter) having a diameter of about 15 μm, insulating wool (for example, insulating nylon) having a diameter of about 5 μm, and a fine polyester fiber. The reason why the non-woven fabric 73 is formed by mixing the conductive wool and the insulative wool is because a fine fiber having a diameter of about 5 μm, even if it is an insulating wool, can store toner in a high density considering that the finest conductive wool at a present time generally has a diameter of about 10 to 15 μm, and as a result, it is possible to improve the ability of scraping discharge products. In addition, it is possible to form the non-woven fabric 73 by using only conductive wool if the conductive wool is fine, or it is possible to form the non-woven fabric 73 by using only conductive wool having, for example, a diameter of about 15 μm in a system in which high scraping ability is not required.

Figure 3C:
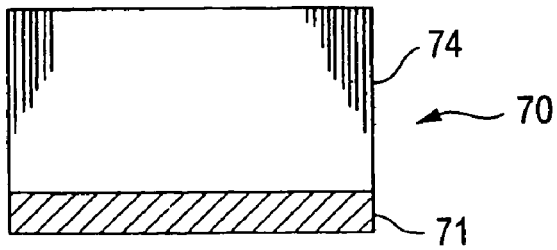
FIG. 3C is a view illustrating a modified example of the toner holding member.

In addition, the toner holding member 70 is not limited to the case in which the non-woven fabric 73 is used. For example, as shown in FIG. 3C, it is possible to form the toner holding member 70 by embedding a conductive fixed brush 74 into the support plate 71. Even though the fixed brush 74 may be properly selected, for example, a brush formed by mixing a conductive wool (conductive nylon) having a diameter of about 15 μm and a fine insulating wool (for example, insulating nylon) having a diameter of about 5 μm is used. The reason why the fixed brush 74 is formed by mixing the conductive wool and the fine insulating wool is the same as that in the non-woven fabric 73.

In addition, even though it is necessary that toner above a predetermined amount be held in the toner holding member 70, the toner may not be held beforehand in the early stage of use because it is general that the toner is sufficiently maintained while being used. However, according to a system, when even higher scraping ability is required, it is possible to make the non-woven fabric 73 or the fixed brush 74 dirty with the toner from the early stage so as to provide sufficient scraping ability from the early stage.

In addition, in order to make an ability of the toner holding member 70 to remove the discharge products equal in the longitudinal direction thereof, it is possible to make the toner holding member 170 oscillating in the longitudinal direction.

Figure 5:
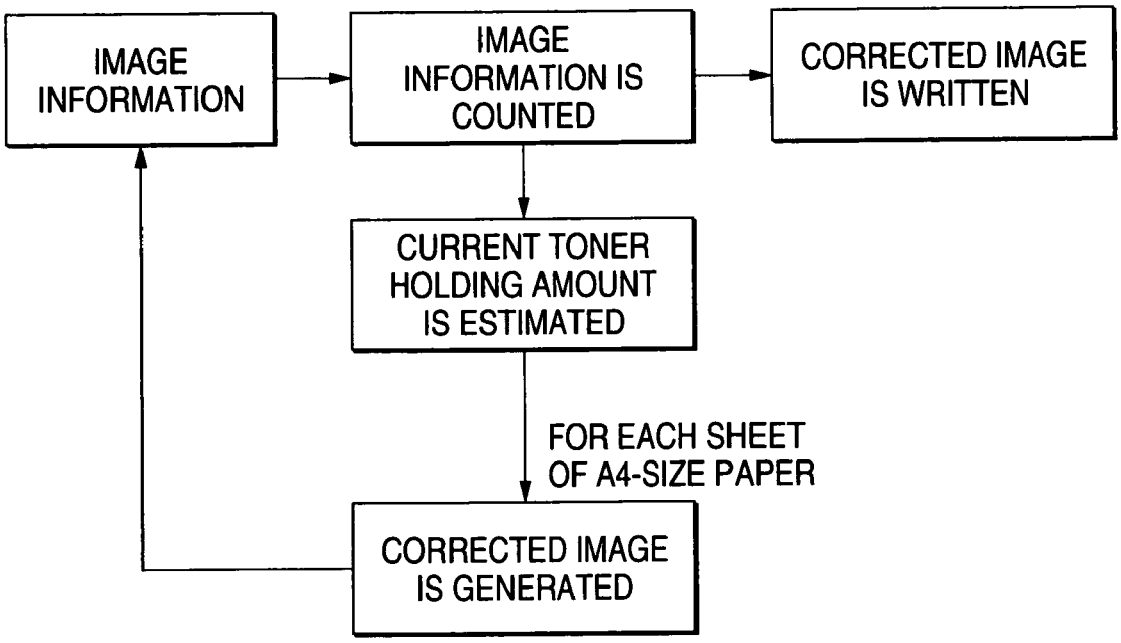
FIG. 5 is an explanatory view illustrating the flow of a process of adjusting the toner holding amount performed by the image forming apparatus according to the embodiment.

Further, in the present embodiment, a control unit 100 is a microcomputer system having a CPU, a ROM, a RAM, and an I/O port, has a holding amount adjusting program (refer to FIGS. 6 to 9), which adjusts the toner holding amount with respect to the toner holding member 70, installed in the ROM. For example, the control unit 100 executes the holding amount adjusting program by using a timing signal for adjusting the toner holding amount as a trigger and corrects the toner holding amount on the basis of the input image information as shown in FIG. 5.

Here, the timing signal available includes an operation signal generated when power is on, an operation signal generated under high temperature and high humidity environment, an operation signal generated when an image forming apparatus 20 is not used for a long time, an operation signal generated at regular maintenance, or an operation signal generated when a sleep mode is released (return from a standby mode).

Furthermore, in FIG. 2, reference numeral 80 denotes a concentration control line sensor disposed on the downstream side of the most downstream-side image generating unit 21*d* facing the intermediate transfer member 30. The line sensor 80 extends in a width direction perpendicular to the movement direction of the intermediate transfer member 30 and has a construction in which sensor elements are arrayed at a predetermined pitch.

Next, an operation of the image forming apparatus according to the present embodiment will be described on the basis of a basic image generating process and a holding amount adjusting process. In addition, a case in which a fixed brush is used as the toner holding member 70 will be described below.

-Basic Image Generating Process-

In each of the image generating units 21, as shown in FIGS. 2 and 3A, the photosensitive drum 22 is charged to a desired surface potential by the charger 23 and then an electrostatic latent image is formed on the charged photosensitive drum 22 by the image writing unit 24. The electrostatic latent image is visualized by color component toner of each developing unit 25 to be formed as a toner image. Then, the respective color component toner images are sequentially transferred onto the intermediate transfer member 30 by the primary transfer charger 27 and then collectively transferred onto the recording medium 45 by the secondary transfer charger 40. Thereafter, the recording medium 45 on which the respective color component toner images have been transferred passes through the fixer 42, and thus non-fixed toner images on the recording medium 45 is fixed.

Further, toner remaining on the photosensitive drum 22 after the first transfer process and opposite-polarity toner (retransferred toner) retransferred from the intermediate transfer member 30 onto the photosensitive drum 22 pass through the toner holding member 70 of the cleaner 26 and then are cleaned by the rotating brush 52.

At this time, since a charge adjusting bias (here, a negative polarity bias, for example, −850V) supplied from the charge-adjusting bias power source 75 is applied to the nonwoven fabric 73 of the toner holding member 70, the remaining toner and the retransferred toner having passing through the toner holding member 70 is charge-adjusted to have negative polarities. The toner charge-adjusted to have the negative polarities is cleaned by the rotating brush 52.

That is, the potential of the photosensitive drum 22 having passed through the fixed brush 74 having conductivity becomes a predetermined potential (for example, about −400V), and thus the negative polarity toner can be cleaned in an electrostatic manner by setting the potential of the rotating brush 52 to, for example, 0V. The cleaned toner is moved to the collection roller 53 in the electrostatic manner and scraped by the scraper 54 so as to be collected.

Further, the toner or the like, which remains on the intermediate transfer member 30, is cleaned by the intermediate transfer cleaner 35.

-Holding Amount Adjusting Process-

In the present embodiment, the control unit 100 is supplied with predetermined input image information and performs a holding amount adjusting process per toner holding amount of the toner holding member 70 by using the supplied timing signal as a trigger.

Figure 6:
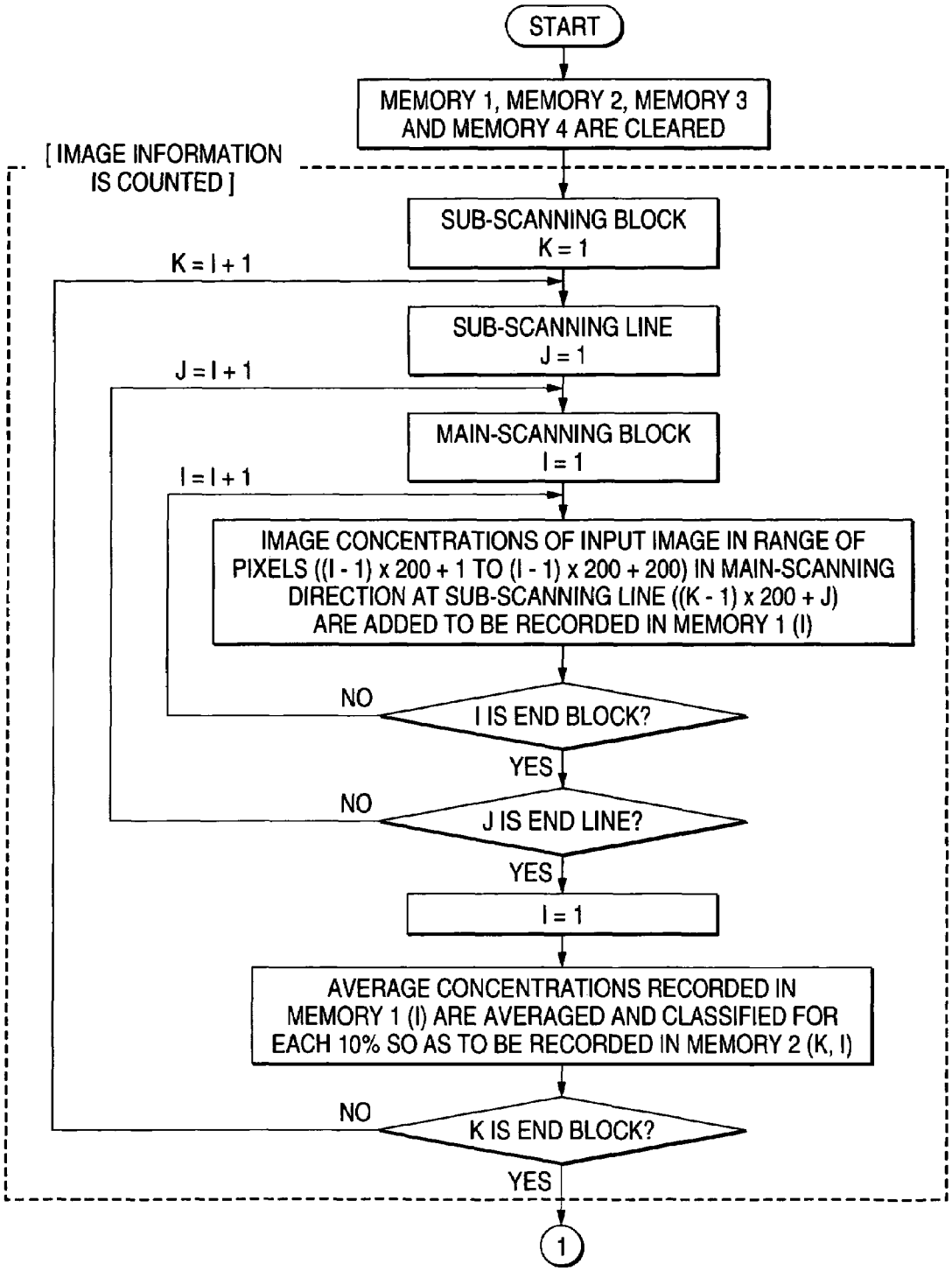
FIG. 6 is a flowchart (1) illustrating the detail of the process of adjusting the toner holding amount shown in FIG. 5.

In other words, as shown in FIG. 6, the control unit 100 clears memory 1, memory 2, memory 3, and memory 4. Then, per input image information, the control unit 100 records and averages the average concentrations corresponding to 200 lines (200th line is an end line) in the sub-scanning direction, each of the average concentrations being an average concentration of 200 pixels in the main scanning direction, adding-records the average concentrations in a memory(I), averages the added concentrations recorded in the memory(I) so as to be classified, for example, for each 10%, and records the classified concentrations in the memory 2(K, I).

Figure 7:
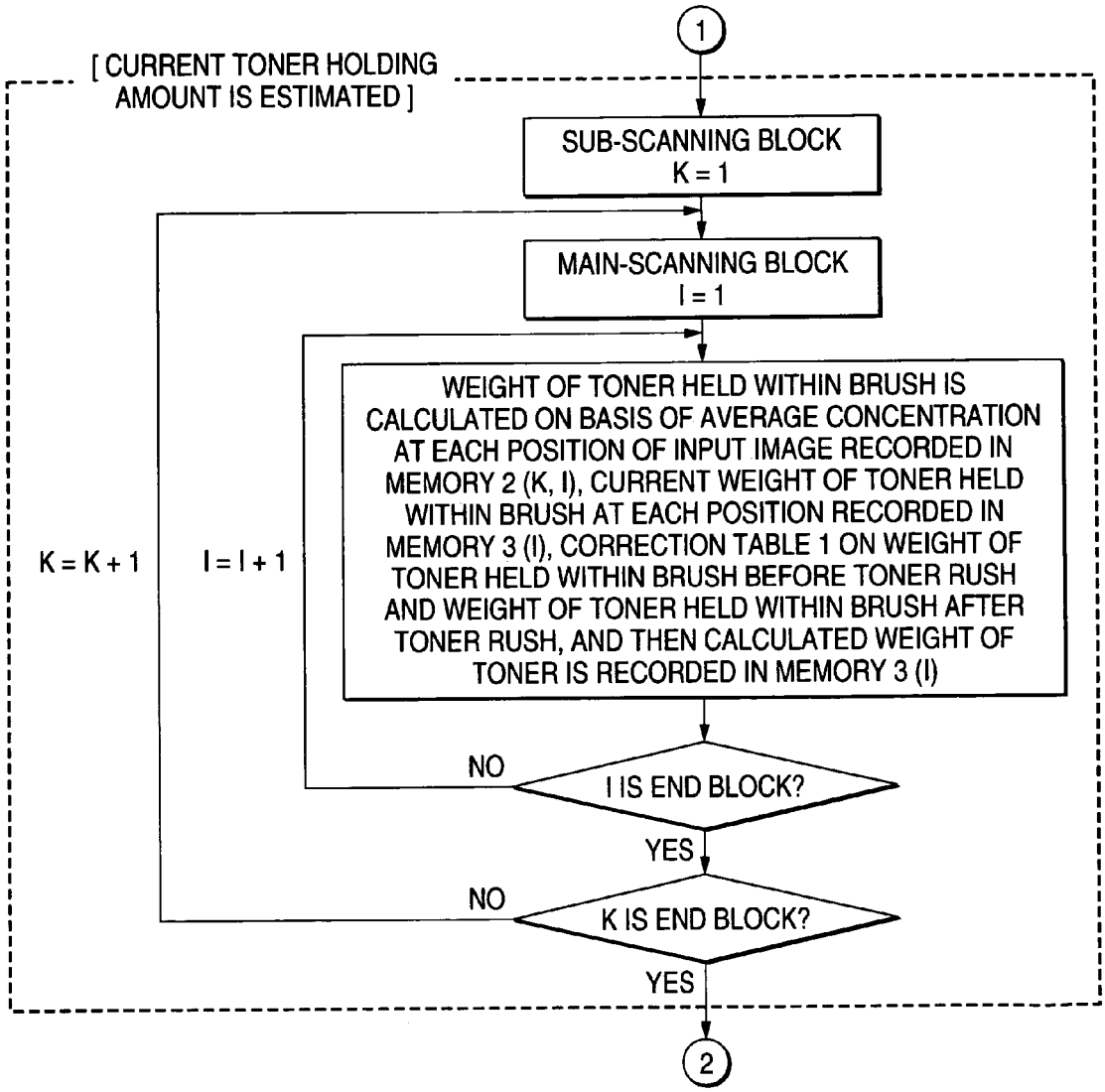
FIG. 7 is a flowchart (2) illustrating the detail of the process of adjusting the toner holding amount shown in FIG. 5.

Subsequently, as shown in FIG. 7, the control unit 100 calculates the weight of toner held within the brush after toner rush on the basis of the average concentration at each position of an input image recorded in the memory 2 (K, I), a current weight of toner held within the brush at each position recorded in the memory 3(I), a correction table 1 on the weight of toner held within the brush before toner rush and the weight of toner held within the brush after toner rush, and then records the calculated weight of toner held within the brush after toner rush in the memory 3(I).

Figure 10A:
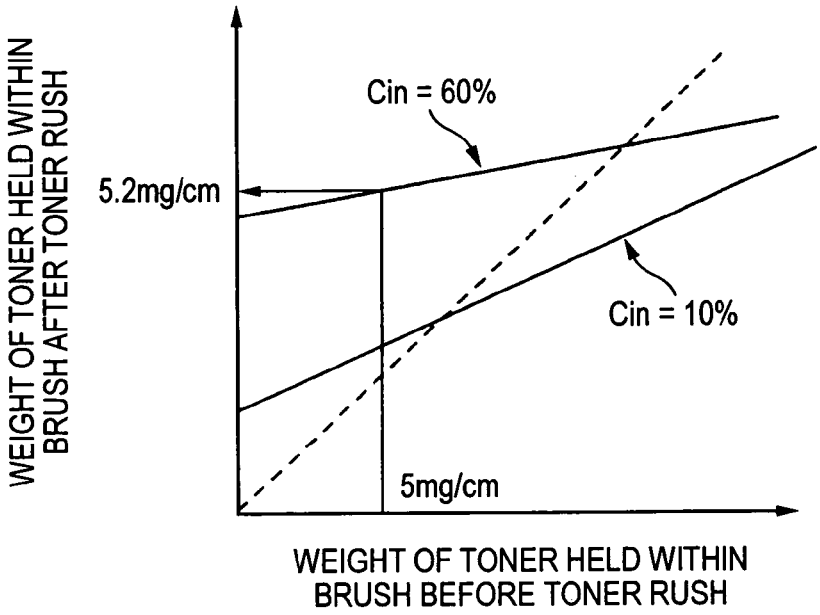
FIG. 10A is an explanatory view illustrating a principle of estimating the current toner holding amount and FIG. 10B is an explanatory view illustrating a principle of generating a corrected image.

For example, according to the correction table 1 shown in FIG. 10A, when the average concentration within 200×200 pixels is 60% and the weight of toner held within the brush before toner rush is 5 mg/cm, the weight of toner held within the brush after toner rush is calculated as 5.2 mg/cm.

Figure 8:
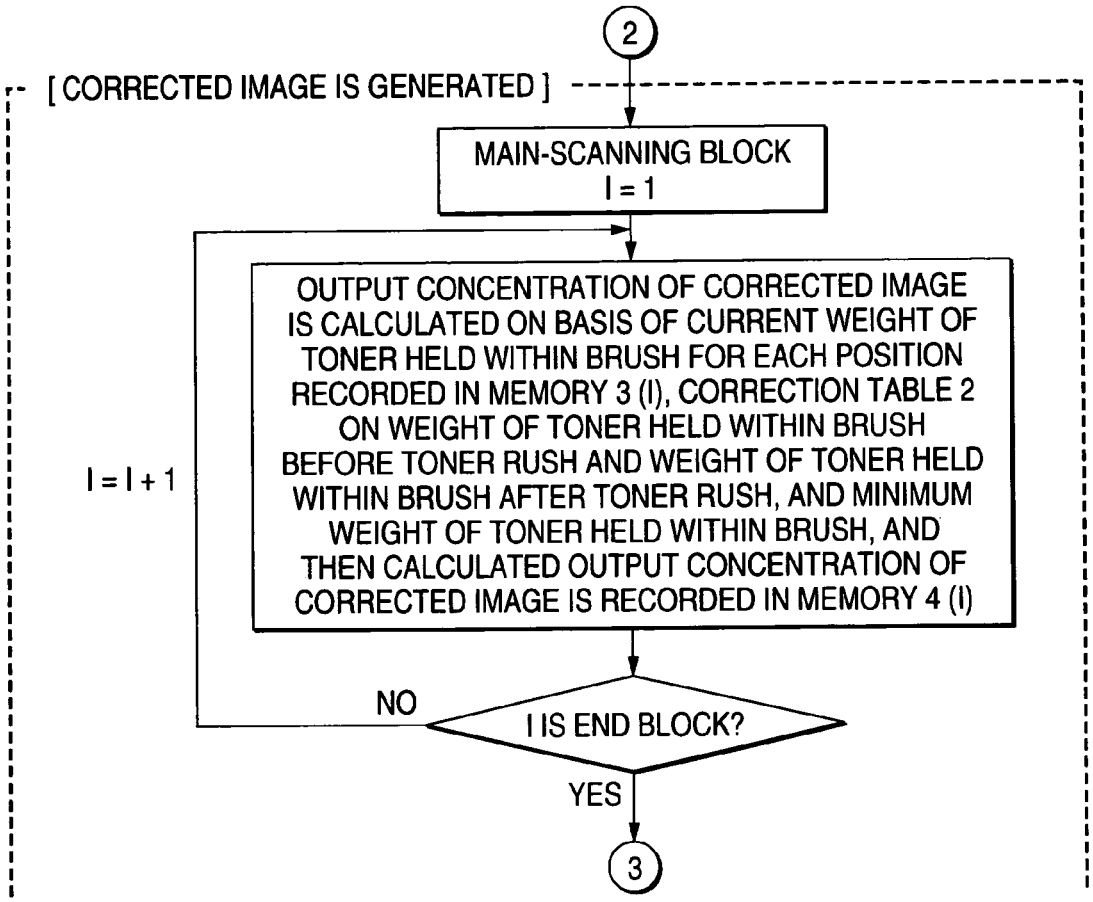
FIG. 8 is a flowchart (3) illustrating the detail of the process of adjusting the toner holding amount shown in FIG. 5.
Figure 9:
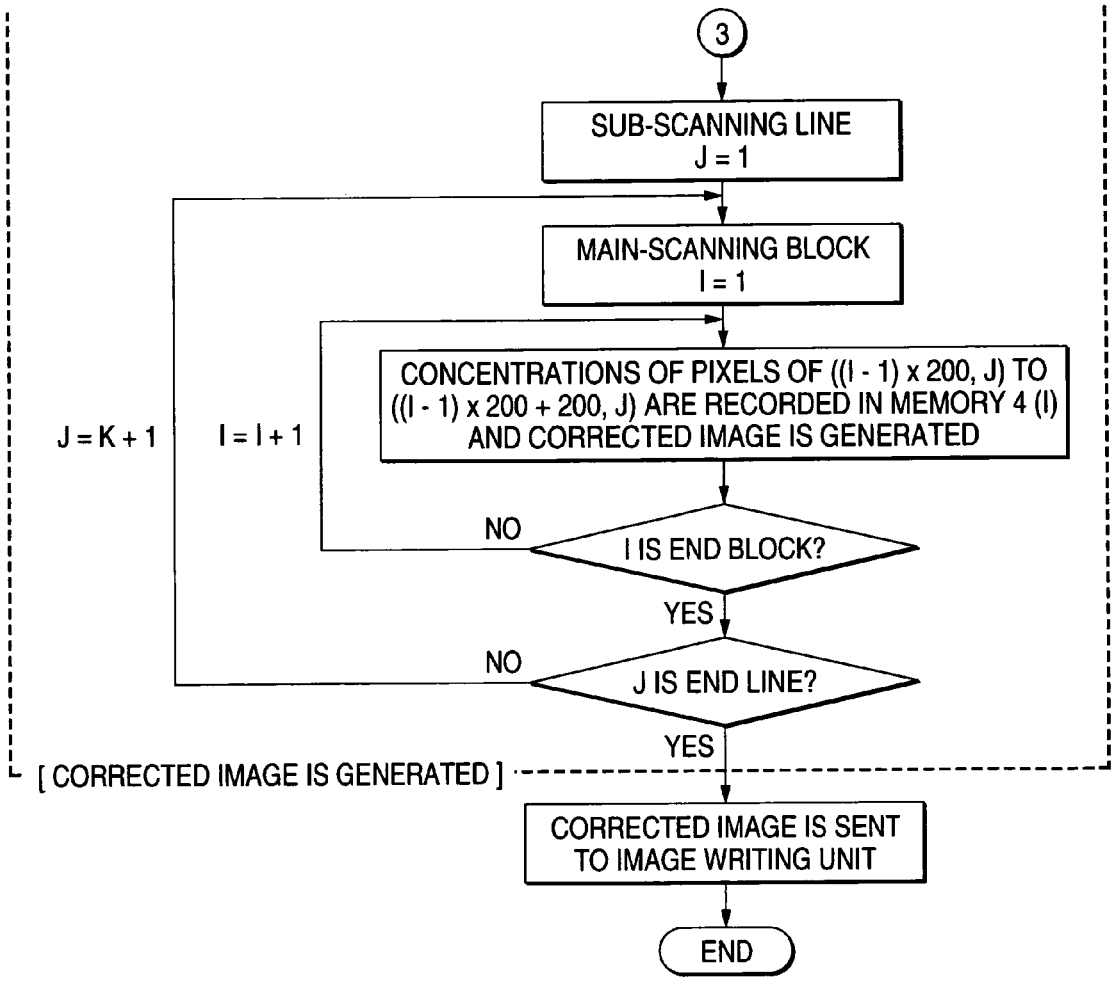
FIG. 9 is a flowchart (4) illustrating the detail of the process of adjusting the toner holding amount shown in FIG. 5.

Thereafter, as shown in FIG. 8, the control unit 100 generates a corrected image per A4-size sheet of paper. Specifically, the control unit 100 calculates the output concentration (average concentration within 200×200 pixels) of the corrected image on the basis of a current weight of toner held within the brush for each position recorded in the memory 3(I), a correction table 2 on the weight of toner held within the brush before toner rush and the weight of toner held within the brush after toner rush, and a minimum weight of toner held within the brush, and then records the calculated output concentration of the corrected image in the memory 4(I).

Figure 10B:
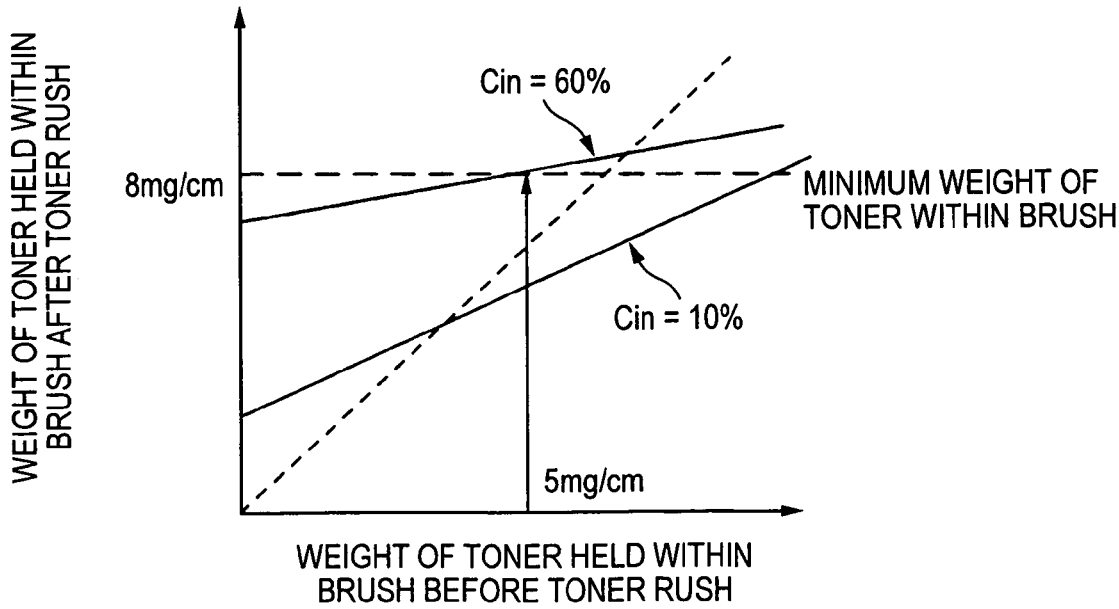

For example, as shown in FIG. 10B, when the weight of toner held within the brush before toner rush is 5 mg/cm, the average concentration within 200×200 pixels is calculated as 60% for the minimum weight of toner held within the brush (for example, 8 mg/cm).

Then, the control unit 100 sends the corrected image to the image writing unit 24 and makes the corrected image by using an inter-image area.

Figure 11A:
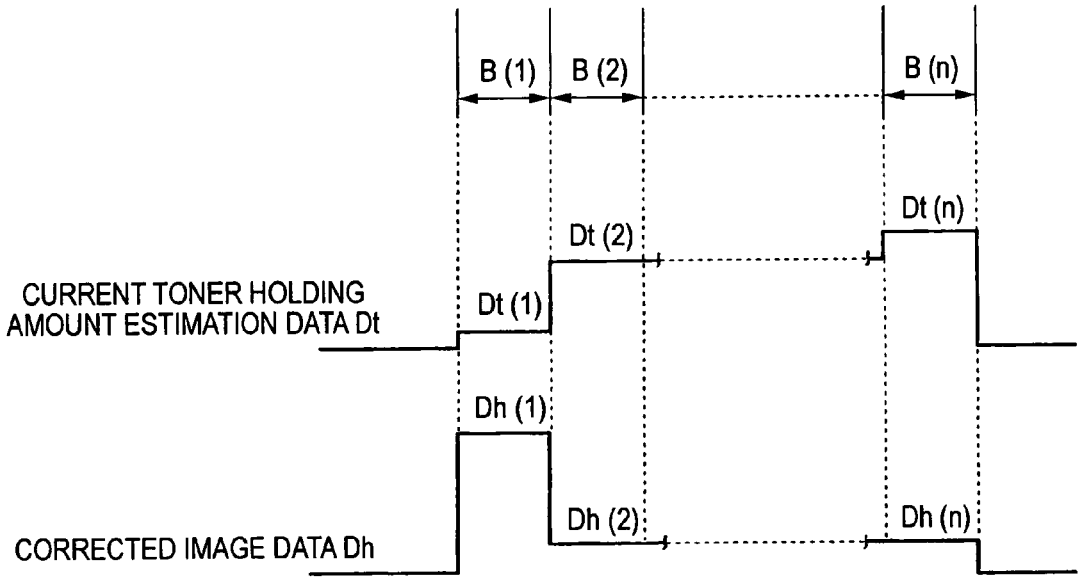
FIG. 11A is an explanatory view illustrating the relationship between current toner holding amount estimation data and corrected image data obtained by a measuring unit composed of a line sensor for measuring the pass-through amount and FIG. 11B is an explanatory view schematically illustrating states on the toner holding amount distribution before and after performing a correction.

For example, as shown in FIG. 11A, when current toner holding amount estimation data Dt (specifically, Dt(1), Dt(2), Dt(n)) is requested for each block B (B(1), B(2), . . . , B(n)) within 200×200 pixels, corresponding corrected image data Dh (Dh(1), Dh(2), . . . , Dh(n)) is generated.

Figure 11B:
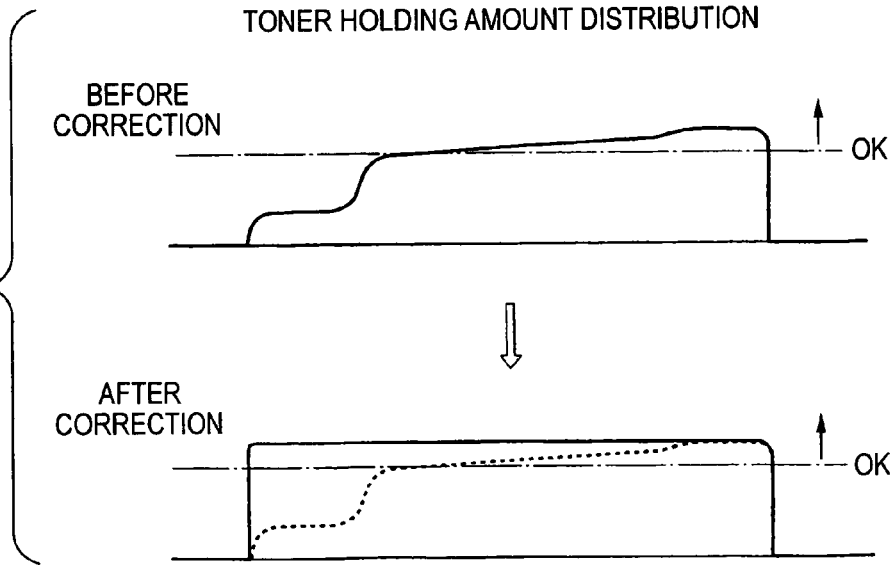

During the operation process, since the corrected image is generated as an image having a concentration distribution which tends to be opposite to the current toner holding amount estimation, the corrected image rubs against the toner holding member 70. As a result, as shown in FIG. 11B, even though a part of the toner holding amount of the toner holding member 70 has been lower than an allowable level (corresponding to a region having low output image concentration) before correction, the toner holding amount of the toner holding member 70 becomes approximately equal so as to be higher than the allowable level over the entire area.

For this reason, it is possible to suppress the toner holding amount of the toner holding member 70 from being locally reduced, and accordingly, the abrasion amount of the photosensitive drum 22 does not become non-uniform. As a result, it is possible to effectively prevent a phenomenon, in which an image becomes white due to the region having a locally small abrasion amount, from occurring.

Second Embodiment

Figure 12:
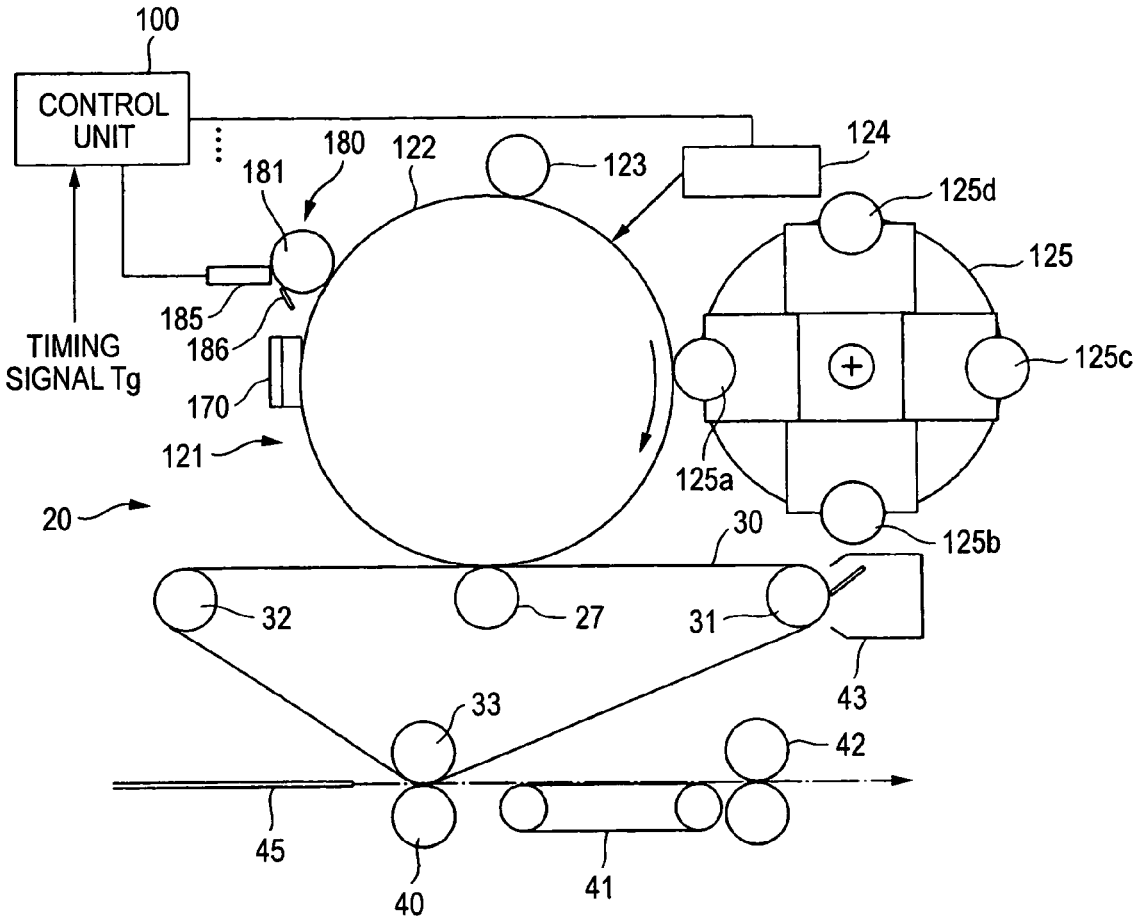
FIG. 12 is a view illustrating the entire configuration of an image forming apparatus according to a second embodiment of the invention.

FIG. 12 is a view illustrating the entire configuration of an image forming apparatus according to a second embodiment of the invention.

Referring to FIG. 12, an image forming apparatus 20 is basically configured to adopt an intermediate transfer method in approximately the same manner as in the first embodiment. However, the second embodiment is different from the first embodiment in that the image forming apparatus 20 is composed of a cleaner-less four-cycle machine using one image generating unit 121.

In FIG. 12, the image generating unit 121 has a photosensitive drum 122 rotating in a predetermined direction. In the vicinity of the photosensitive drum 122, a charger 123 which charges the photosensitive drum 122, an image writing unit 124 which writes an electrostatic latent image on the charged photosensitive drum 122, a rotary developing unit 125 (including developer tanks 125*a* to 125*d* in which each color component toner is stored) which makes an electrostatic latent image written on the photosensitive drum 122 visualized by using toner corresponding to each color component, and a toner holding member 170 and a pass-through amount measuring unit 180 disposed to be in contact with the photosensitive drum 122.

In addition, the same components as in the first embodiment are denoted by the same reference numerals as in the first embodiment, and detailed explanation thereof will be omitted.

Figure 13:
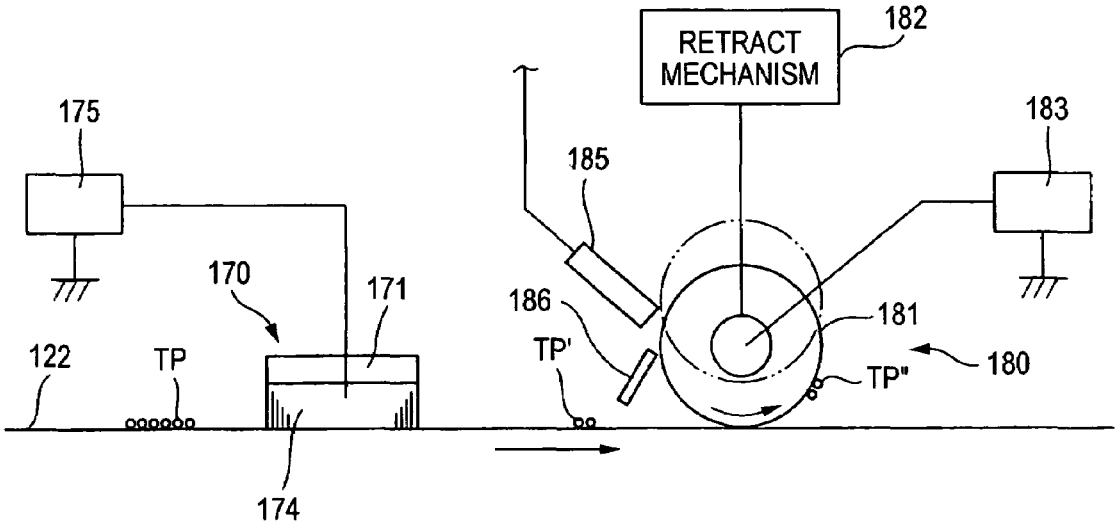
FIG. 13 is a view illustrating the detail of a toner holding member and a pass-through amount measuring unit according to the embodiment.

In the present embodiment, as shown in FIG. 13, the toner holding member 170 is formed by attaching and fixing a fixed brush 174 on a support plate 171. For example, the toner holding member 170 is connected to a charge-adjusting bias power source 175 by which a predetermined charge-adjusting bias (bias having the same polarity as normal toner polarity) can be applied. In addition, the toner holding member 170 is not limited thereto, but the toner holding member 170 may be formed by using the nonwoven fabric in the first embodiment, for example.

Further, for example, as shown in FIGS. 12 and 13, the pass-through amount measuring unit 180 has a measuring roller (pass-through amount measuring roller) 181 which is made of resin or rubber and is attached on the photosensitive drum 122 or detached therefrom. When the photosensitive drum 122 and the measuring roller 181 are disposed to be in contact with each other, the measuring roller 181 is rotated so as to follow the photosensitive drum 122. In addition, the measuring roller 181 moves back and forth such that the measuring roller 181 can be attached on the photosensitive drum 122 or detached therefrom by using a retract mechanism 182, and a transfer bias power source 183 capable of applying a transfer bias is connected to the measuring roller 181.

In addition, a concentration sensor 185 composed of a line sensor is disposed to face the measuring roller 181 along the axis direction of the measuring roller 181, and a scraper 186 for cleaning remaining toner is disposed below the concentration sensor 185 so as to be in contact with the measuring roller 181.

Figure 14:
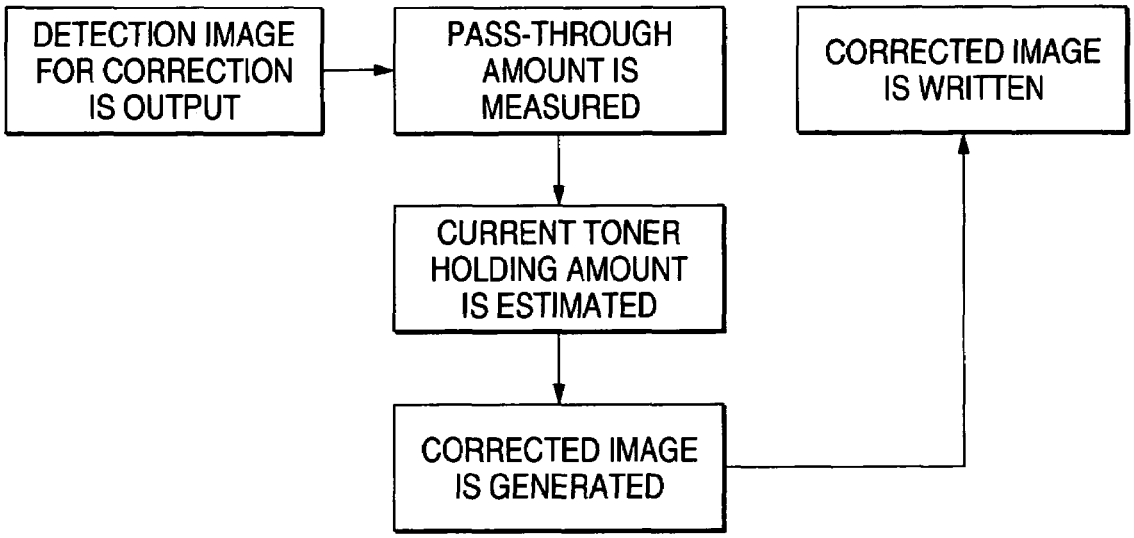
FIG. 14 is an explanatory view illustrating the flow of a process of adjusting the toner holding amount performed in the image forming apparatus according to the second embodiment.

Further, the control unit 100 uses a predetermined timing signal Tg as a trigger, and performs a holding amount adjusting process per toner holding amount for the toner holding member 170 on the basis of toner pass-through amount information obtained from the concentration sensor 185, as shown in FIG. 14.

Next, an operation of an image forming apparatus according to the present embodiment will be described.

Figure 15:
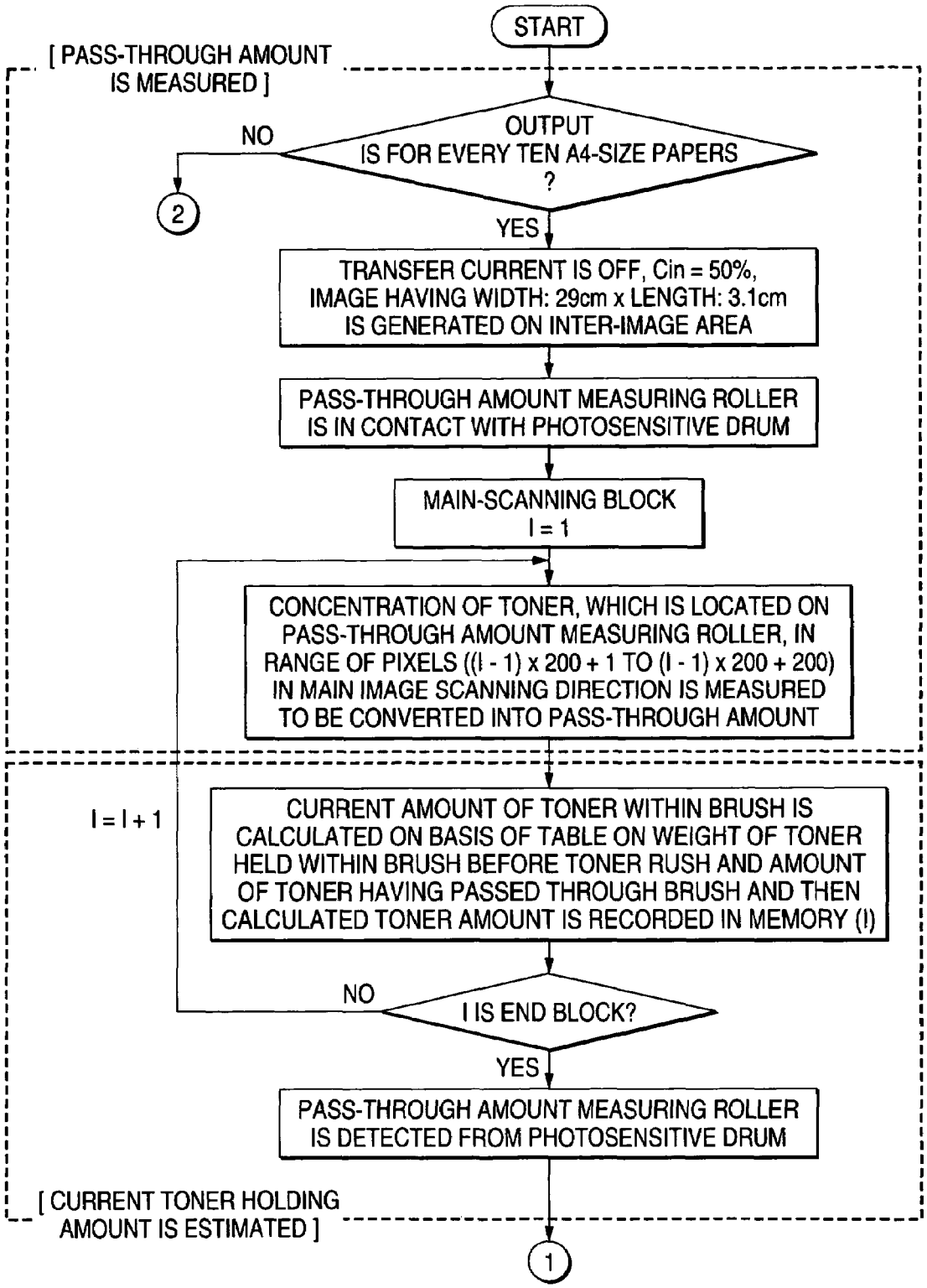
FIG. 15 is a flowchart (1) illustrating the detail of the process of adjusting the toner holding amount shown in FIG. 14.
Figure 16:
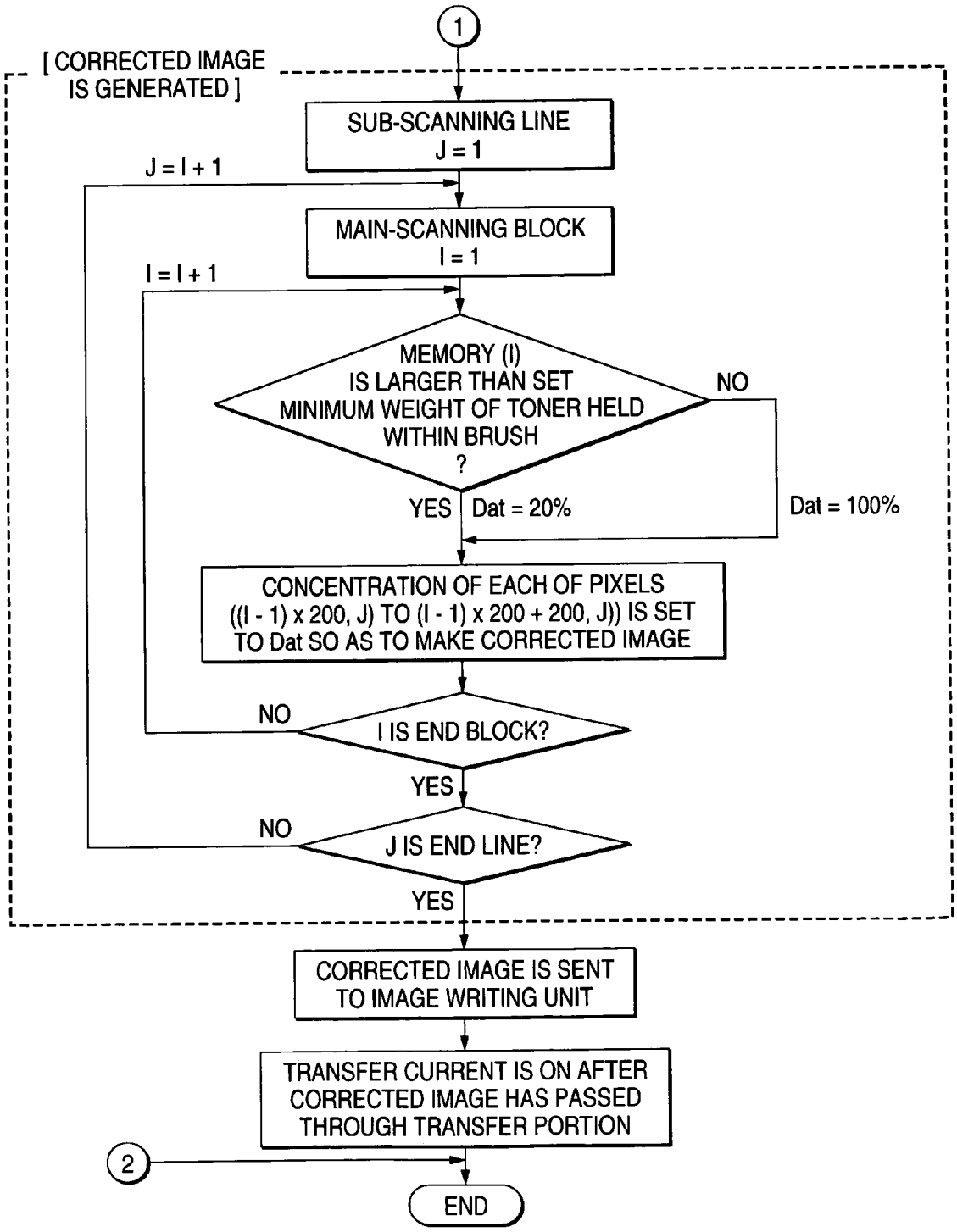
FIG. 16 is a flowchart (2) illustrating the detail of the process of adjusting the toner holding amount shown in FIG. 14.

As shown in FIGS. 13 to 15, the control unit 100 is supplied with a timing signal Tg every ten sheets of, for example, A4-size images, and then outputs a test pattern image TP (for example, half-tone image under conditions of Cin=50%, 29 cm (width)×3.1 cm (length)) to an inter-image area.

At this time, a transfer current of the primary transfer charger 27 is set to be turned off, and a transfer bias supplied from the transfer bias power source 183 is turned on by making the pass-through amount measuring roller 181 coming in contact with the photosensitive drum 122.

Thereafter, a test pattern image TP' having passed through the toner holding member 170 is electrostatically transferred on the pass-through amount measuring roller 181, as shown by an image TP". Under this state, the control unit 100 measures the pass-through amount on the basis of the concentration information obtained from the pass-through amount measuring roller 181, as shown in FIGS. 13 to 15.

That is, the control unit 100 measures the concentration of toner, which is located on the pass-through amount measuring roller 181, in the range of 200 pixels in the main image-scanning direction by using the concentration sensor 185, and converts the measured amount into a pass-through amount.

Figure 17A:
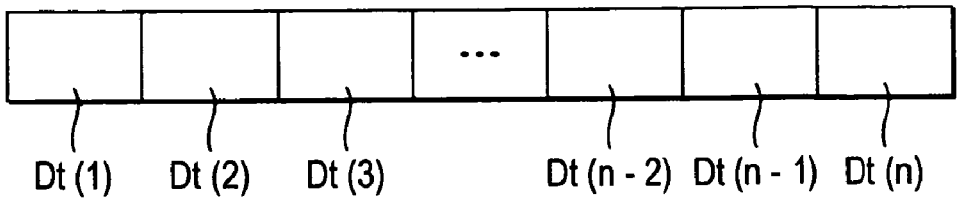
FIG. 17A is an explanatory view illustrating an example of current toner holding amount data and FIG. 17B is an explanatory view illustrating an example of corrected image data.

Pass-through amount data Dt (unit: mg) is, for example, Dt(1)=0.8, Dt(2)=0.72, Dt(3)=0.56, Dt(n−2)=0.43, Dt(n−1)=0.69, Dt(n)=0.70, as shown in FIG. 17A.

In addition, the control unit 100 calculates a current amount of toner within a brush with respect to each block on the basis of a table on the weight of toner held within the brush before toner rush and the amount of toner having passed through a brush and then records the calculated toner amount in the memory (I).

In addition, when the measuring process performed by the pass-through amount measuring unit 180 is completed, the measuring roller 181 is detached from the photosensitive drum 122.

Subsequently, as shown in FIGS. 13 to 16, the control unit 100 determines whether or not the memory (I) is larger than the set minimum weight (for example, 10 mg: corresponding to the leaking amount of 0.68 mg) of toner within a brush for each main scanning block I (1 to end), in the order of sub-scanning line J (1 to end). If the memory (I) is determined to be larger than the set minimum weight of toner held within the brush, the control unit 100 generates a low-concentration (for example, Dat=20%) corrected image Dh(L), and if the memory (I) is determined to be smaller than the set minimum weight of toner held within the brush, the control unit 100 generates a high-concentration (for example, Dat=100%) corrected image Dh (H). That is, the control unit 100 generates the corrected image by setting the concentration of pixels ((I−1)×200, J) to ((I−1)×200+200, J) in each block as Dat.

Figure 17B:
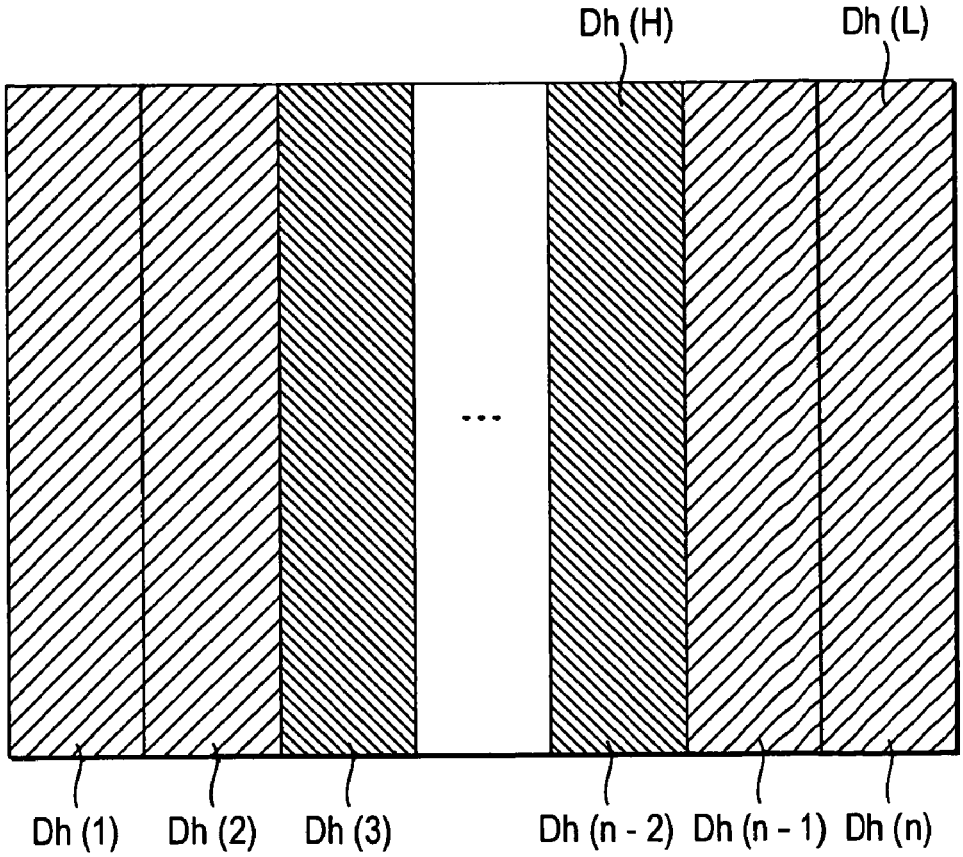

For example, as shown in FIG. 17B, corrected images in each block are Dh(1)=Dh(L), Dh(2)=Dh(L), Dh(3)=Dh(H), . . . , Dh(n−2)=Dh(H), Dh(n−1)=Dh(L), Dh(n)=Dh(L).

Then, the control unit 100 sends the corrected image to the image writing unit 124 so as to make a corrected image having a predetermined size.

The corrected image is visualized on the photosensitive drum 122, passes through a transfer portion, and is supplied to the toner holding member 170.

Further, since a transfer current of the primary transfer charger 27 flows after the corrected image has passed through the transfer portion, remaining toner of the corrected image having passed through the toner holding member 170 is transferred onto the intermediate transfer member 30 by the primary transfer charger 27 and then collected by the intermediate transfer cleaner 35.

Third Embodiment

Figure 18:
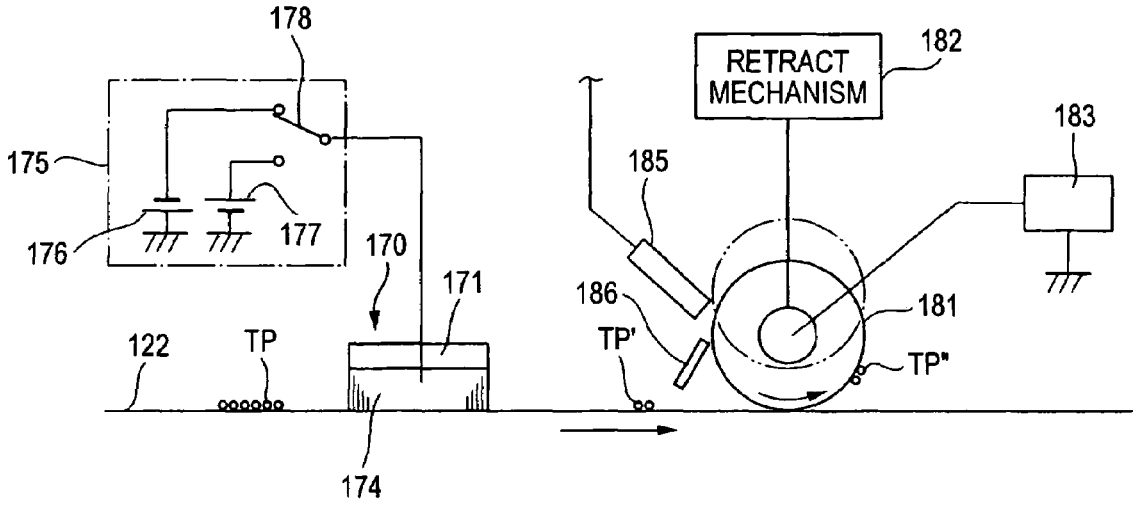
FIG. 18 is a view (corresponding to FIG. 13) illustrating main parts of an image forming apparatus according to a third embodiment of the invention.

FIG. 18 is a view illustrating main parts of an image forming apparatus according to a third embodiment of the invention.

Referring to FIG. 18, the basic configuration of an image forming apparatus 20 is approximately the same as that in the second embodiment, except that a holding amount adjusting process in the third embodiment is different from that in the second embodiment.

That is, in the present embodiment, a charge-adjusting bias power source 175 of the toner holding member 170 includes a negative polarity power source 176 having the same polarity as toner, a positive polarity power source 177 having a polarity opposite to that of the toner, and a transition switch 178 switching between the power sources 176 and 177 at a proper timing.

Figure 19:
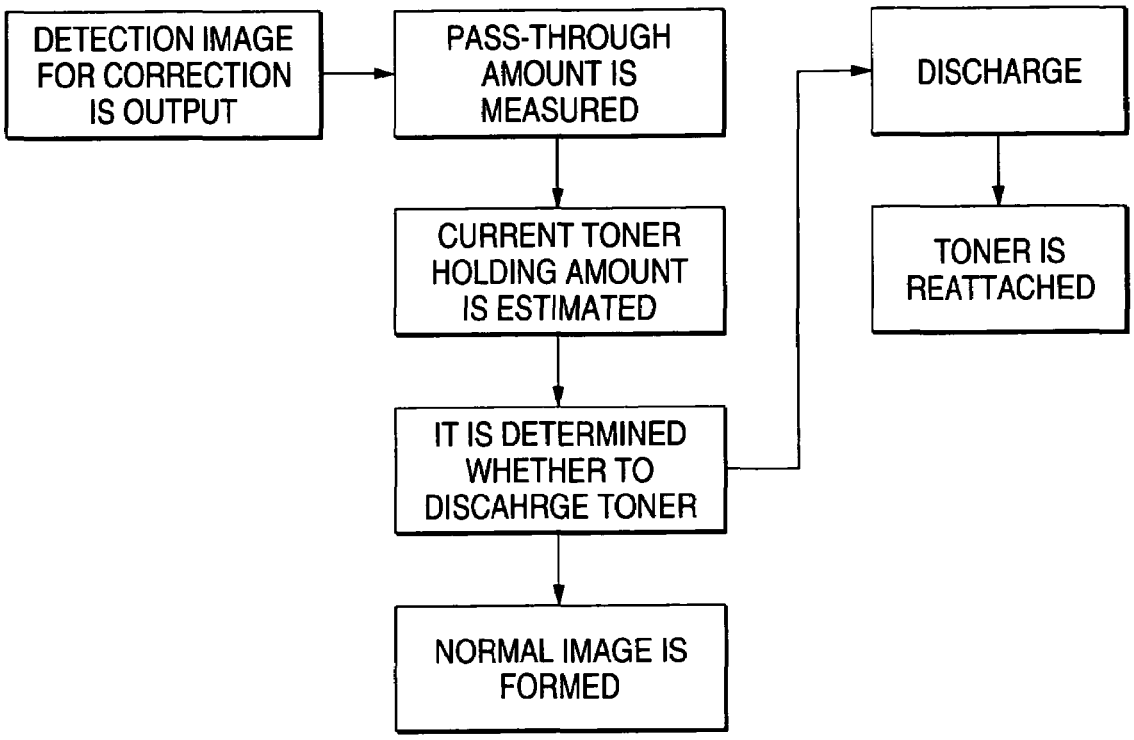
FIG. 19 is an explanatory view illustrating the flow of a process of adjusting the toner holding amount performed in the image forming apparatus according to the third embodiment.
Figure 20:
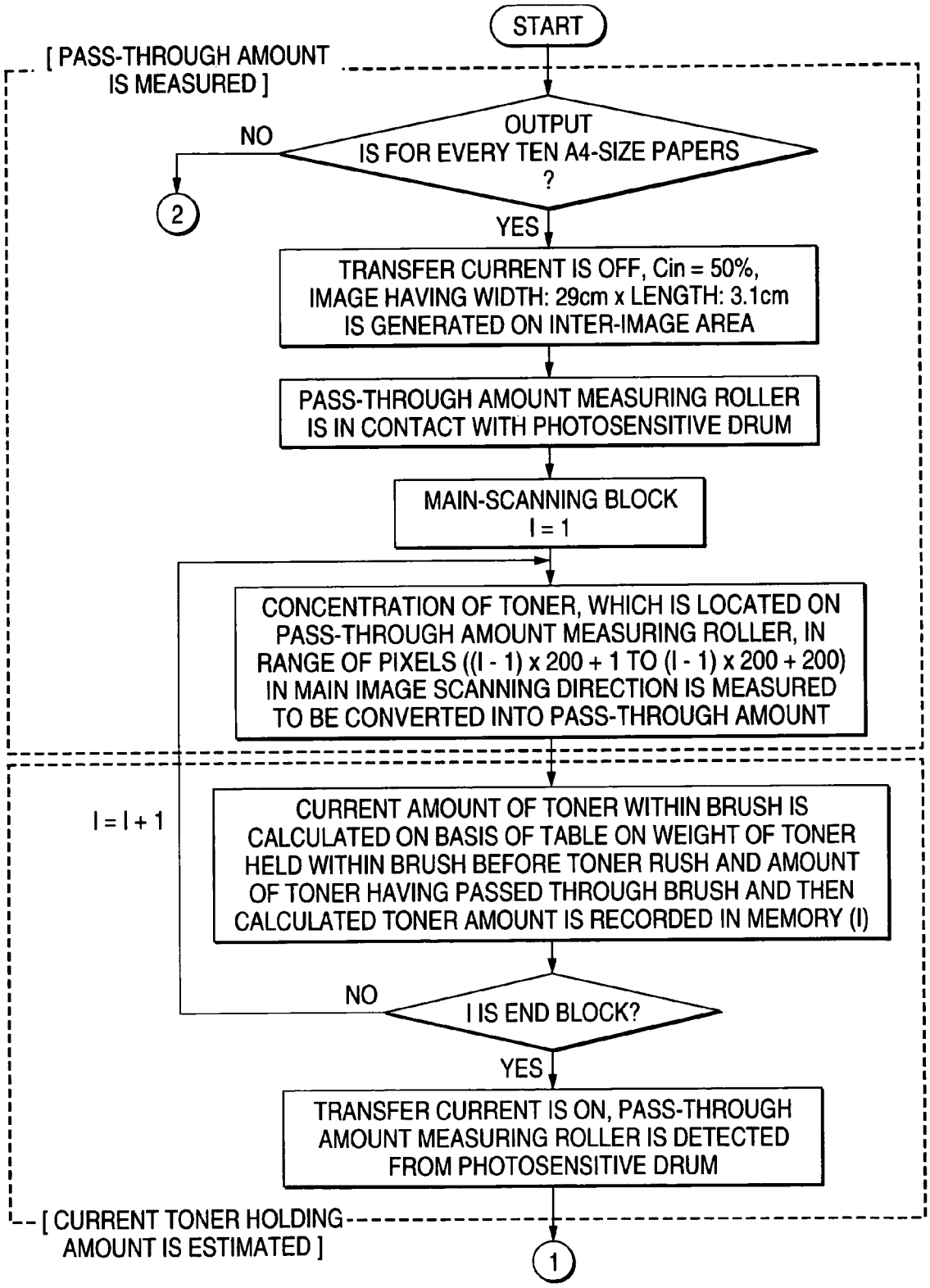
FIG. 20 is a flowchart (1) illustrating the detail of the process of adjusting the toner holding amount shown in FIG. 19.
Figure 21:
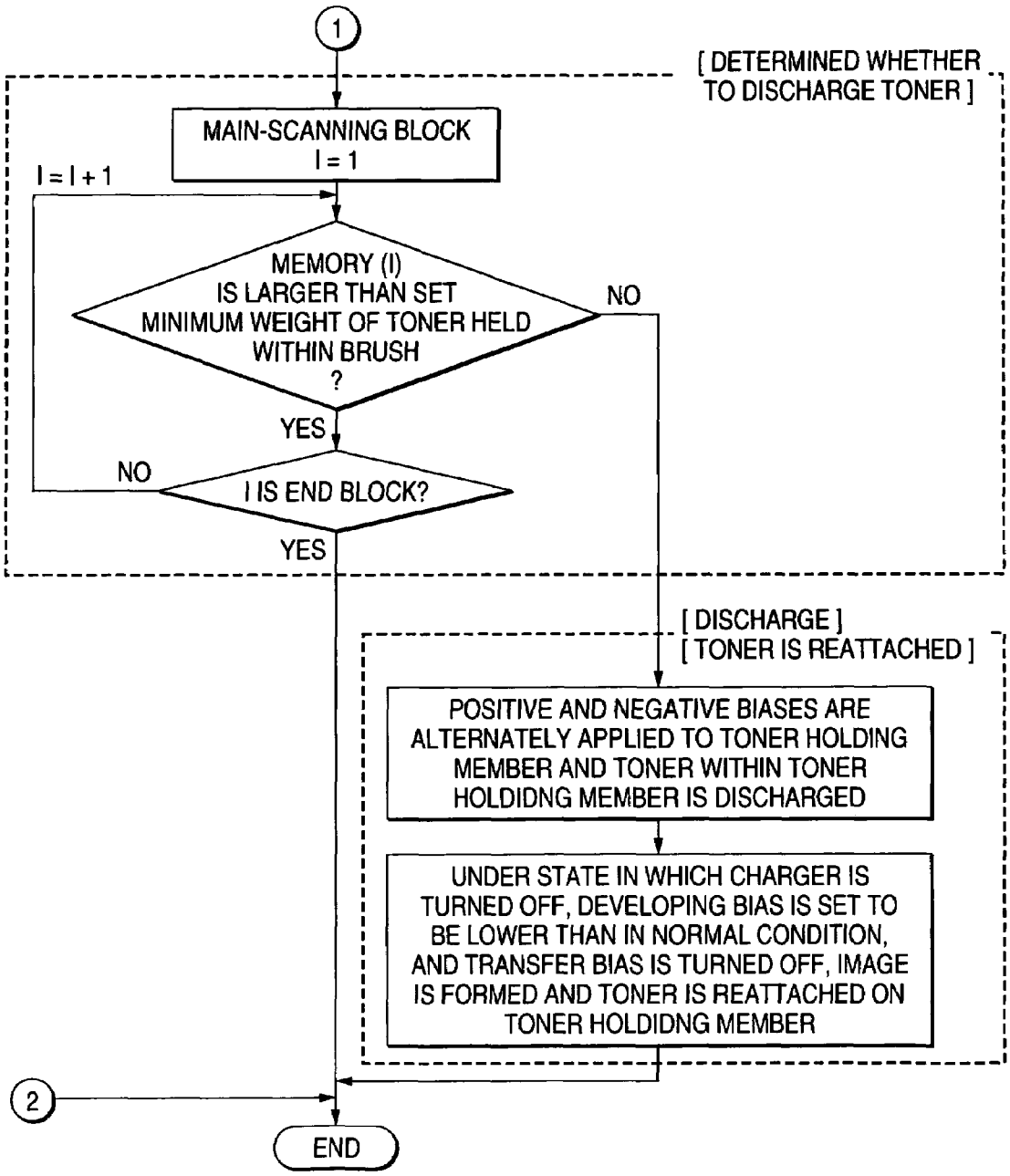
FIG. 21 is a flowchart (2) illustrating the detail of the process of adjusting the toner holding amount shown in FIG. 19.

Furthermore, as shown in FIGS. 19 to 21, in the holding amount adjusting process (process of adjusting holding amount of toner moving to a toner holding member) of the present embodiment, a detection image for correction is first output, and then the pass-through amount is measured and the current toner holding amount is estimated on the basis of the outputted detection image. The above-described processes are the same as those in the second embodiment.

Then, when the process of estimating the current toner holding amount is completed, a control unit (not shown) makes a transfer current of the primary transfer charger 27 flow and detaches the pass-through amount measuring roller 181 from the photosensitive drum 122.

Thereafter, as shown in FIGS. 19 to 21, the control unit 100 determines whether or not there is a region where the amount of toner within a brush recorded in the memory (I) is smaller than the minimum weight of toner held within the brush set beforehand. If it is determined that the region exists, positive and negative biases are alternately applied to the toner holding member 170, and toner within the toner holding member 170 is discharged to be transferred to the intermediate transfer member 30 through the primary transfer charger 27 and then is cleaned by the cleaner 35 (refer to FIG. 12).

Then, under a state in which the charger 123 is turned off, a developing bias is set to be lower than in a normal condition, and a transfer bias is turned off, a reattaching image (image satisfying that the current toner holding amount is larger than the minimum weight of toner held within the brush) is formed and toner is reattached on the toner holding member 170.

In addition, when it is determined that any amount of toner within a brush recorded in the memory (I) is larger than the minimum weight of toner held within the brush set beforehand, the control unit 100 immediately completes the holding amount adjusting process because it is not necessary to supplement toner for the toner holding member 170.

Fourth Embodiment

Figure 22:
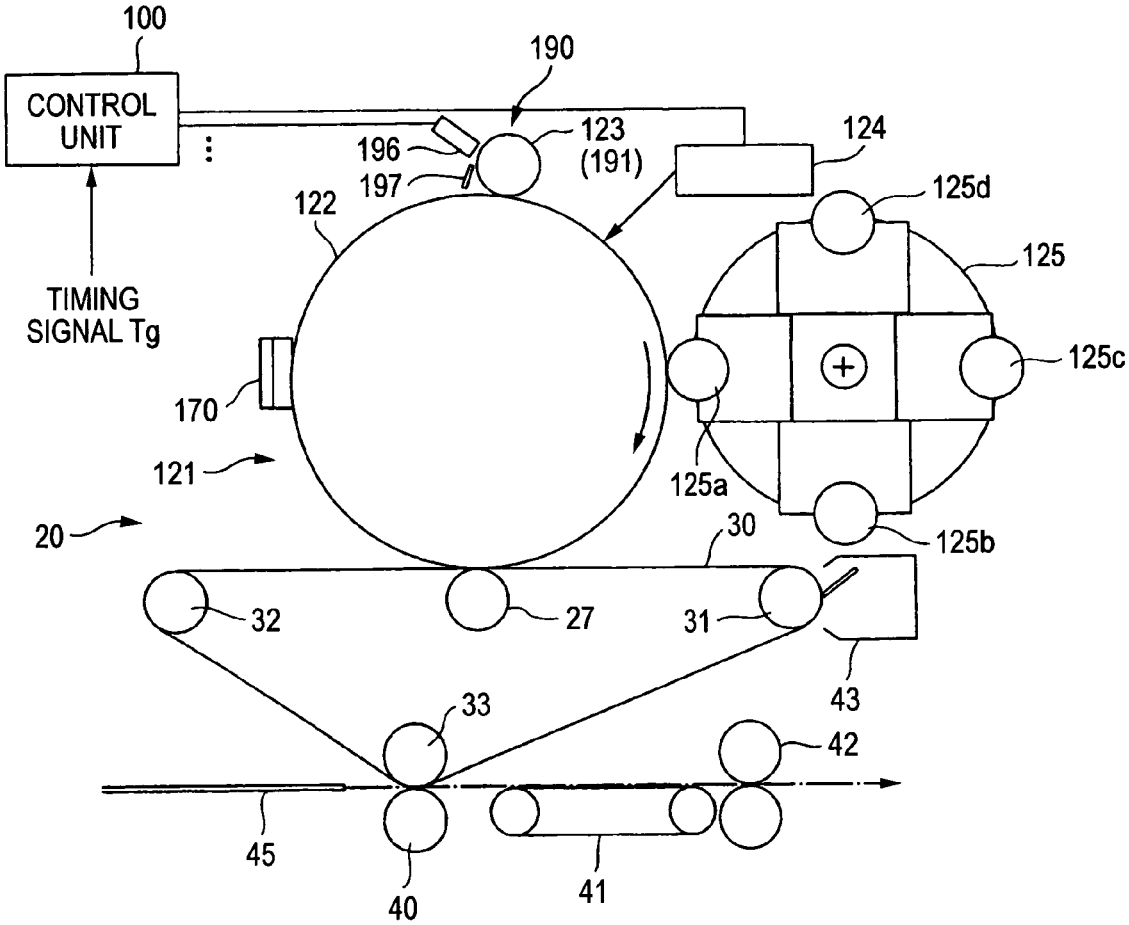
FIG. 22 is a view illustrating an image forming apparatus according to a fourth embodiment of the invention.

FIG. 22 illustrates the entire configuration of an image forming apparatus according to a fourth embodiment of the invention.

Referring to FIG. 22, the basic configuration of an image forming apparatus is approximately the same as that in the second embodiment, except that the pass-through amount measuring unit 180 is not provided separately but the charger 123 is also used as a pass-through amount measuring unit 190. In addition, the same components as in the second embodiment are denoted by the same reference numerals in the second embodiment, and detailed explanation thereof will be omitted.

Figure 23:
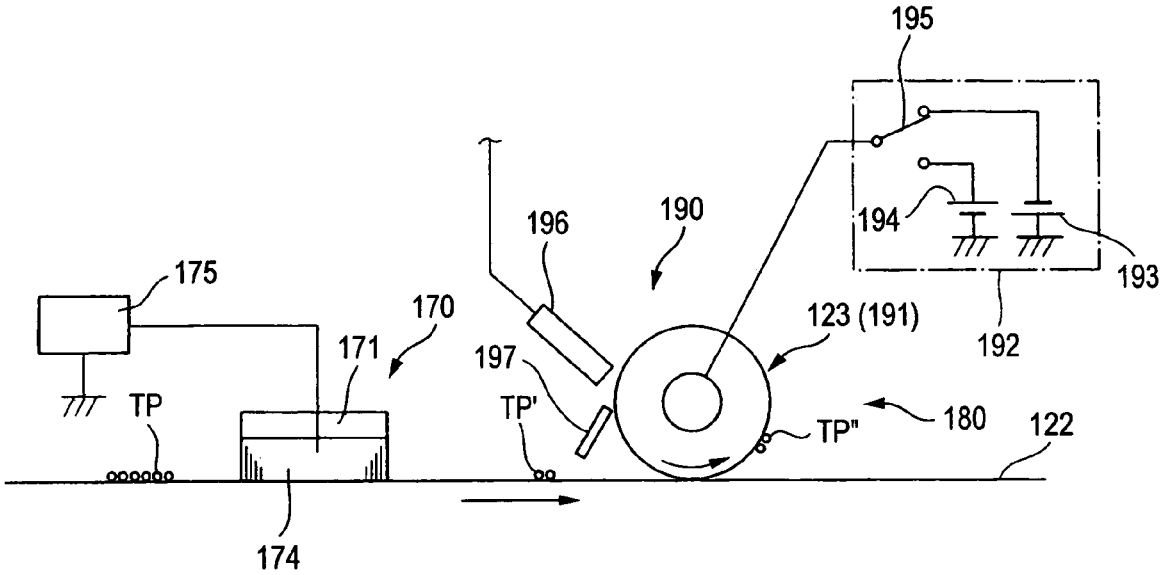
FIG. 23 is a view (corresponding to FIG. 13) illustrating main parts of the image forming apparatus according to the fourth embodiment of the invention.

In the present embodiment, as shown in FIG. 23, for the pass-through amount measuring unit 190, a charging roller which is a component of the charger 123 is used as a measuring roller 191. A bias power source 192, which can apply a charging bias and a transfer bias, is connected to the measuring roller (charging roller) 191. In this embodiment, the bias power source 192 can switch between a negative polarity power source 193 and a positive polarity power source 194 by using a transition switch 195.

In addition, a concentration sensor 196, which extends in the axis direction of the measuring roller 191 and is composed of, for example, a line sensor, is disposed around the measuring roller 191, and a scraper 197 is disposed below the concentration sensor 196 so as to be in contact with the measuring roller 191.

As such, according to the present embodiment, the pass-through amount measuring unit 190 using the charger 123 operates as described below.

That is, if a test pattern image TP, which is the same as in the second embodiment, has passed through the toner holding member 170, a test pattern image TP' having passed therethrough reaches the charger 123.

At this time, the pass-through amount can be measured by transferring a test pattern image TP" onto the measuring roller 191 and measuring the concentration of the test pattern image TP" with the concentration sensor 196.

Furthermore, the test pattern image TP" attached on the measuring roller 191 is cleaned by the scraper 197. In addition, from the viewpoint for even more reliably maintaining the regularity of a surface of the measuring roller 191, toner on the measuring roller 191 may be discharged by alternately applying the positive and negative biases by means of the bias power source 192.

Accordingly, even though the pass-through amount measuring unit 180 is not provided separately, it is possible to perform a process of adjusting the toner holding amount for the toner holding member 170 with a simple configuration in which the charger 123 is also used as the pass-through amount measuring unit 190.

Fifth Embodiment

Furthermore, in the present embodiment, a line sensor 80 for detecting the concentration is disposed at the downstream side of the most downstream-side image generating unit 21*d* facing the intermediate transfer member 30. The line sensor 80 extends in a width direction perpendicular to the movement direction of the intermediate transfer member 30 and has a construction in which sensor elements are arrayed at a predetermined pitch.

Figure 35:
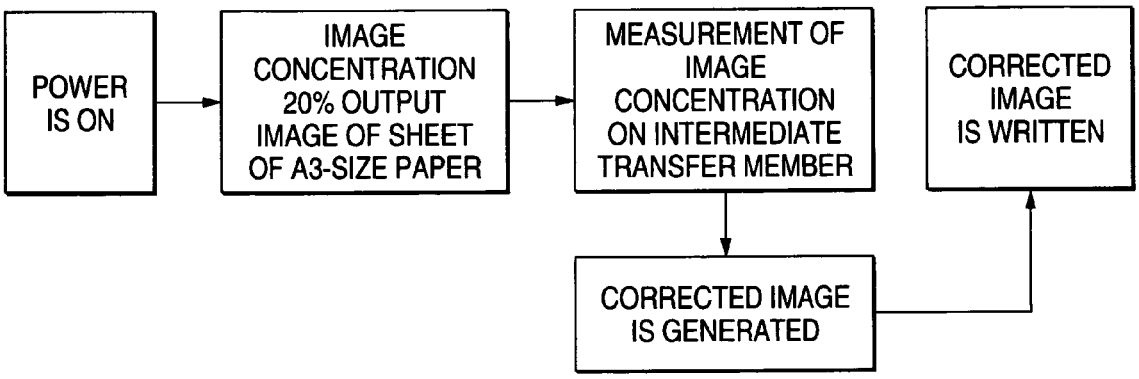
FIG. 35 is an explanatory view illustrating the flow of a process of adjusting the toner holding amount performed by the image forming apparatus according to the embodiment.

In addition, a control unit 100 is a microcomputer system having a CPU, a ROM, a RAM, and an I/O port, has a holding amount adjusting program (refer to FIGS. 6 and 7), which adjusts the toner holding amount with respect to the toner holding member 70, installed in the ROM. For example, the control unit 100 executes the holding amount adjusting program by using a timing signal for adjusting the toner holding amount as a trigger and corrects the toner holding amount on the basis of information on the concentration of an output image obtained from the line sensor 80, as shown in FIG. 35.

Here, the timing signal available includes an operation signal generated when power is on, an operation signal generated under high temperature and high humidity environment, an operation signal generated when an image forming apparatus 20 is not used for a long time, an operation signal generated at regular maintenance, or an operation signal generated when a sleep mode is released (return from a standby mode).

Next, an operation of the image forming apparatus according to the present embodiment will be described on the basis of a basic image generating process and a holding amount adjusting process.

-Basic Image Generating Process-

In each of the image generating units 21, as shown in FIGS. 34, 3A to 3C, an electrostatic latent image is formed on the charged photosensitive drum 22 by the image writing unit 24 after the photosensitive drum 22 is charged to a predetermined surface potential. The electrostatic latent image is visualized by color component toner of each developing unit 25 to be formed as a toner image. Then, the respective color component toner images are sequentially transferred onto the intermediate transfer member 30 by the primary transfer charger 27 and then collectively transferred onto the recording medium 45 by the secondary transfer charger 40. Thereafter, the recording medium 45 on which the respective color component toner images have been transferred passes through the fixer 42, and thus non-fixed toner images on the recording medium 45 is fixed.

Further, toner remaining on the photosensitive drum 22 after the first transfer process and opposite-polarity toner (retransferred toner) retransferred from the intermediate transfer member 30 onto the photosensitive drum 22 pass through the toner holding member 70 of the cleaner 26 and then are cleaned by the rotating brush 52.

At this time, since a charge adjusting bias (here, a negative polarity bias, for example, −850V) supplied from the charge-adjusting bias power source 75 is applied to the nonwoven fabric 73 of the toner holding member 70, the remaining toner and the retransferred toner having passing through the toner holding member 70 is charge-adjusted to have negative polarities. The toner charge-adjusted to have the negative polarities are cleaned by the rotating brush 52.

That is, the potential of the photosensitive drum 22 having passed through the nonwoven fabric 73 having conductivity becomes a predetermined potential (for example, about −400V), and thus the negative polarity toner can be cleaned in an electrostatic manner by setting the potential of the rotating brush 52 to, for example, 0V. The cleaned toner is moved to the collection roller 53 in the electrostatic manner and scraped by the scraper 54 so as to be collected.

Further, the toner or the like, which remains on the intermediate transfer member 30, is cleaned by the intermediate transfer cleaner 35.

-Holding Amount Adjusting Process-

For example, as shown in FIGS. 34, 3A to 3C, and 35, when power is on, the control unit 100 is supplied with a timing signal through a power switch and performs a holding amount adjusting process for the toner holding amount of the toner holding member 70 by using the supplied timing signal as a trigger.

Figure 36:
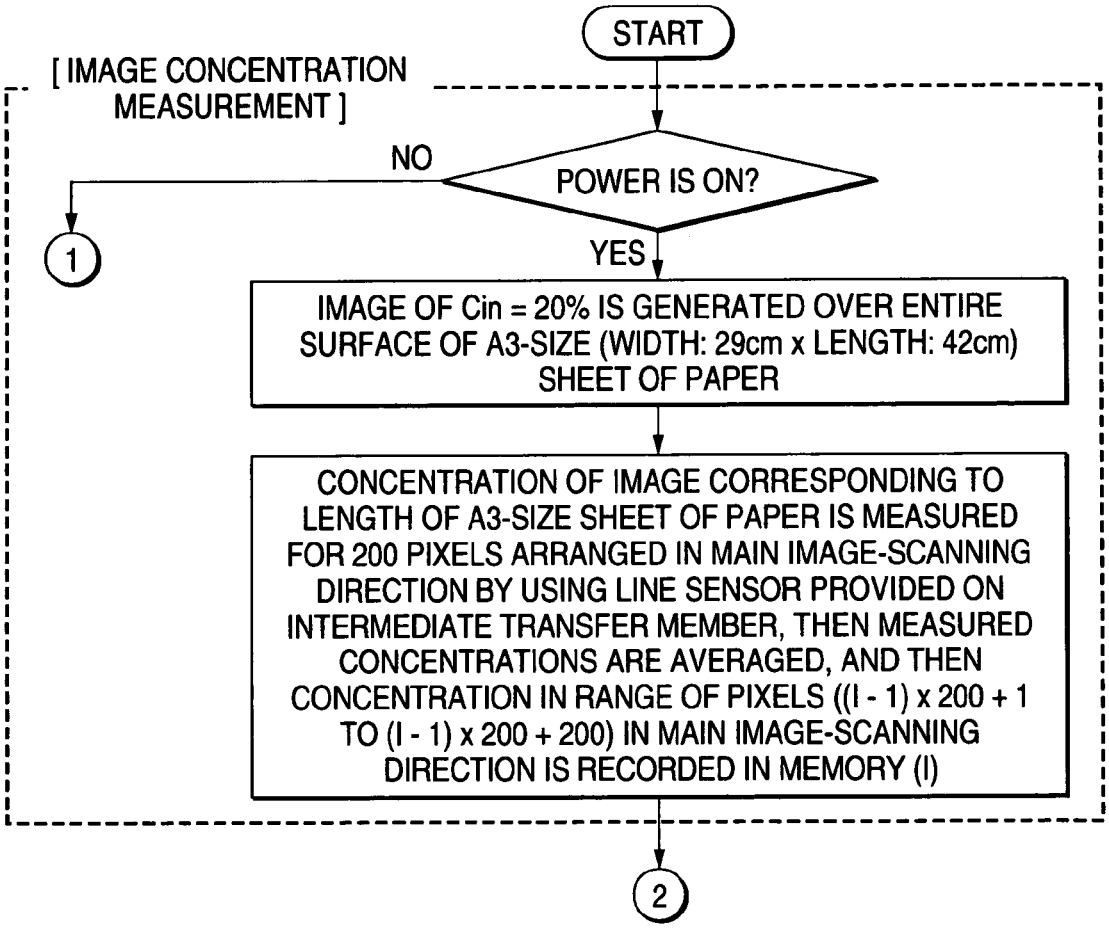
FIG. 36 is a flowchart (1) illustrating the detail of the process of adjusting the toner holding amount shown in FIG. 35.

In other words, as shown in FIG. 36, the control unit 100 determines whether or not the power is on, and at a time when the power is on, the control unit 100 generates a half-tone image having predetermined concentration (for example, Cin=20%) over the entire surface of an A3-size sheet of paper.

Subsequently, the control unit 100 measures the concentration of an image, which will be described below. Specifically, the control unit 100 measures the concentration of an image corresponding to the length of an A3-size sheet of paper for each block, in which a predetermined number of pixels (for example, 200 pixels) in the main image-scanning direction are included, by using a line sensor provided on the intermediate transfer member 30, averages the measured concentrations, and records the concentration in the range of pixels (I−1)×200+1 to (I−1)×200+200 in the main image-scanning direction in the memory (I).

Figure 38A:
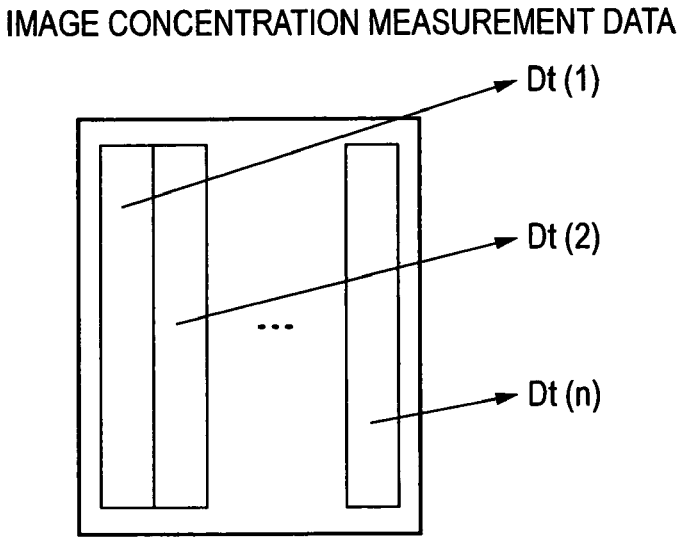
FIG. 38A is an explanatory view illustrating an example of image concentration measurement data.
Figure 38B:
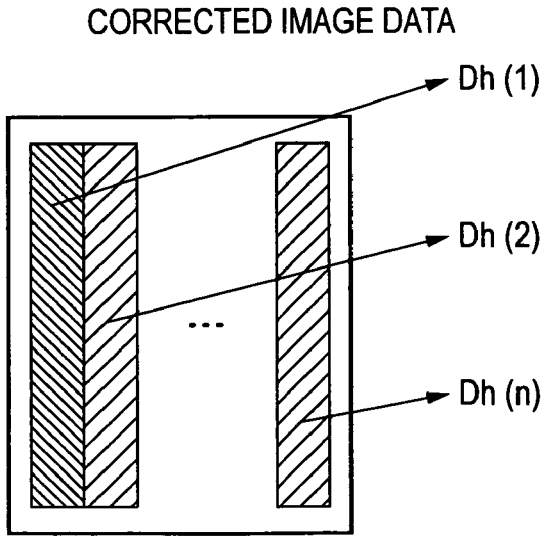
FIG. 38B is an explanatory view illustrating an example of a corrected image.
Figure 39A:
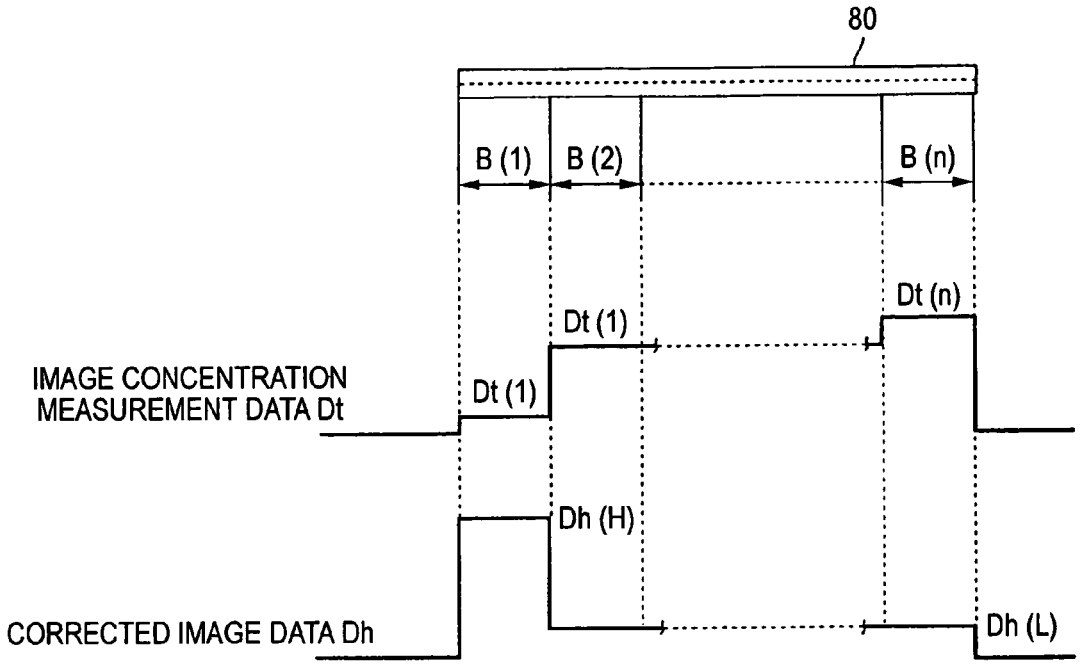
FIG. 39A is an explanatory view illustrating the relationship between image concentration measurement data and the corrected image data obtained by a measuring unit composed of a line sensor.

At this time, as shown in FIGS. 38A, 38B, and 39A, image concentration measurement data is recorded for each block. For example, Dt(1)=1.5%, Dt(2)=15%, . . . , Dt(n)=20%.

Figure 37:
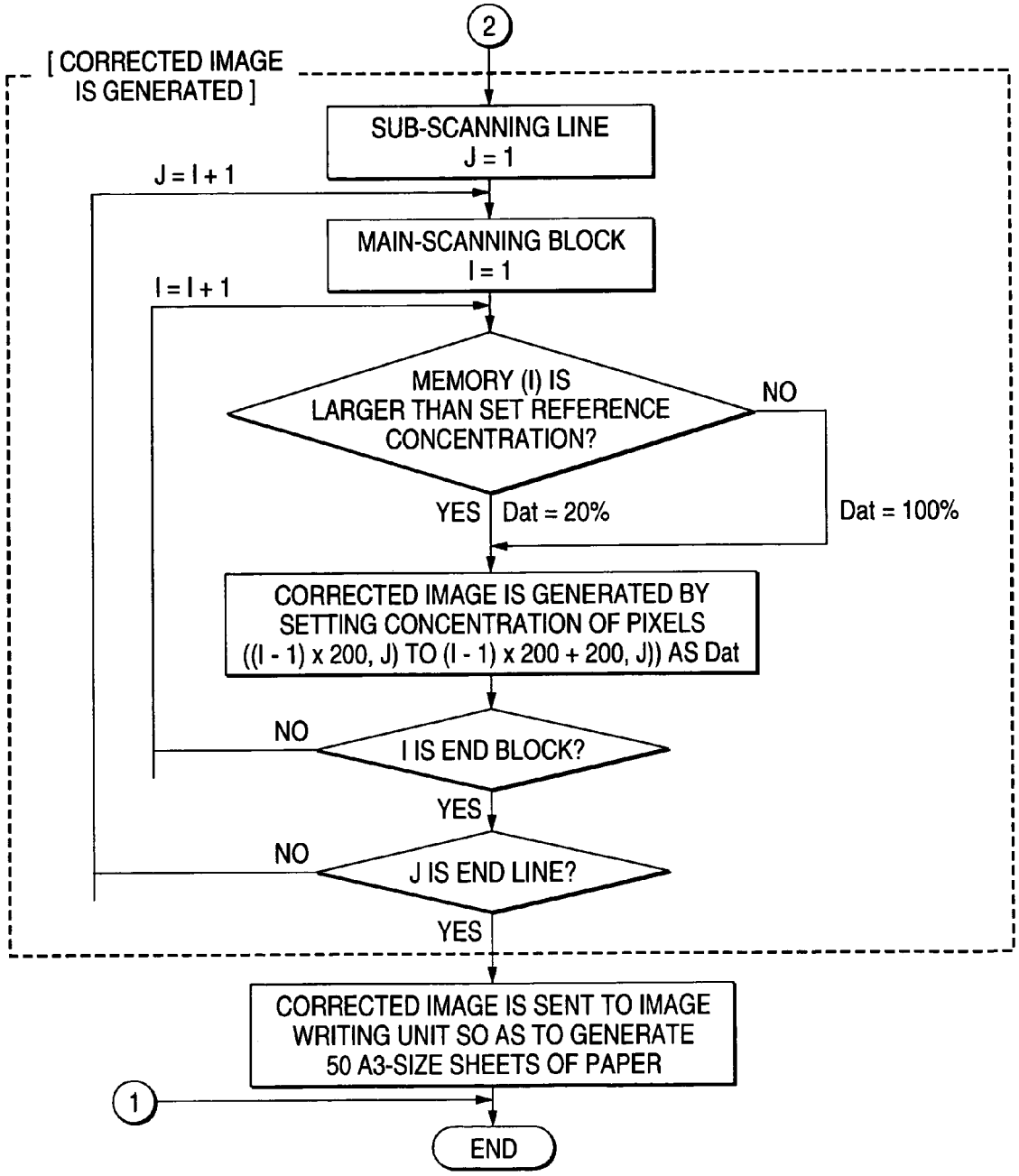
FIG. 37 is a flowchart (2) illustrating the detail of the process of adjusting the toner holding amount shown in FIG. 35.

Thereafter, as shown in FIG. 37, the control unit 100 determines whether or not the memory (I) is larger than the set reference concentration (for example, 10%) for each main scanning block I (1 to end), in the order of sub-scanning line J (1 to end). If the memory (I) is determined to be larger than the set reference concentration, the control unit 100 generates a low-concentration (for example, Dat=20%) corrected image Dh(L), and if the memory (I) is determined to be smaller than the set reference concentration, the control unit 100 generates a high-concentration (for example, Dat=100%) corrected image Dh(H). That is, the control unit 100 generates the corrected image by setting the concentration of pixels ((I−1)×200, J) to ((I−1)×200+200, J) in each block as Dat.

Then, the control unit 100 sends the corrected image to the image writing unit 25 so as to write the corrected image onto the photosensitive drum 22, thereby making corrected images corresponding 50 A3-size sheets of paper.

For example, as shown in FIGS. 38B and 39A, a corrected image for each block is Dh(1)=Dh(H), Dh(2)=Dh(L), . . . , Dh(n)=Dh(L).

Figure 39B:
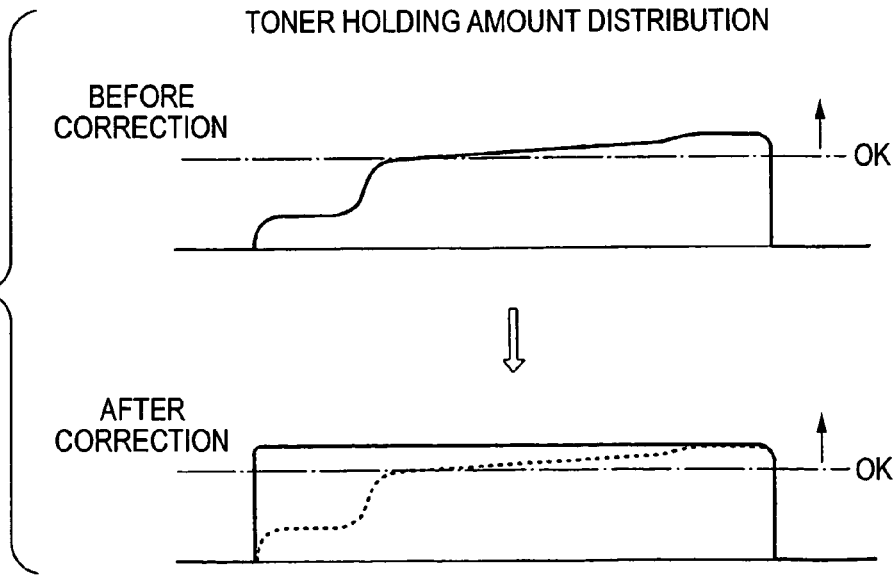
FIG. 39B is an explanatory view schematically illustrating states on the toner holding amount distribution before and after performing a correction.

During the process described above, since the corrected image is generated so as to have concentration distribution apt to be opposite to concentration distribution for each block, the corrected image abrades against the toner holding member 70 for the predetermined number of times. As a result, as shown in FIG. 39B, even though the toner holding amount of the toner holding member 70 is partially lower than an allowable level (corresponding to a portion where output image concentration is low), the toner holding amount of the toner holding member 70 becomes uniform so as to be higher than the allowable level over approximately the entire range after the correction has been performed.

For this reason, it is possible to suppress the toner holding amount of the toner holding member 70 from being locally reduced, and accordingly, the abrasion amount of the photosensitive drum 22 does not become non-uniform. As a result, it is possible to effectively prevent a phenomenon, in which an image becomes white due to the region having a locally small abrasion amount, from occurring.

Sixth Embodiment

Figure 40:
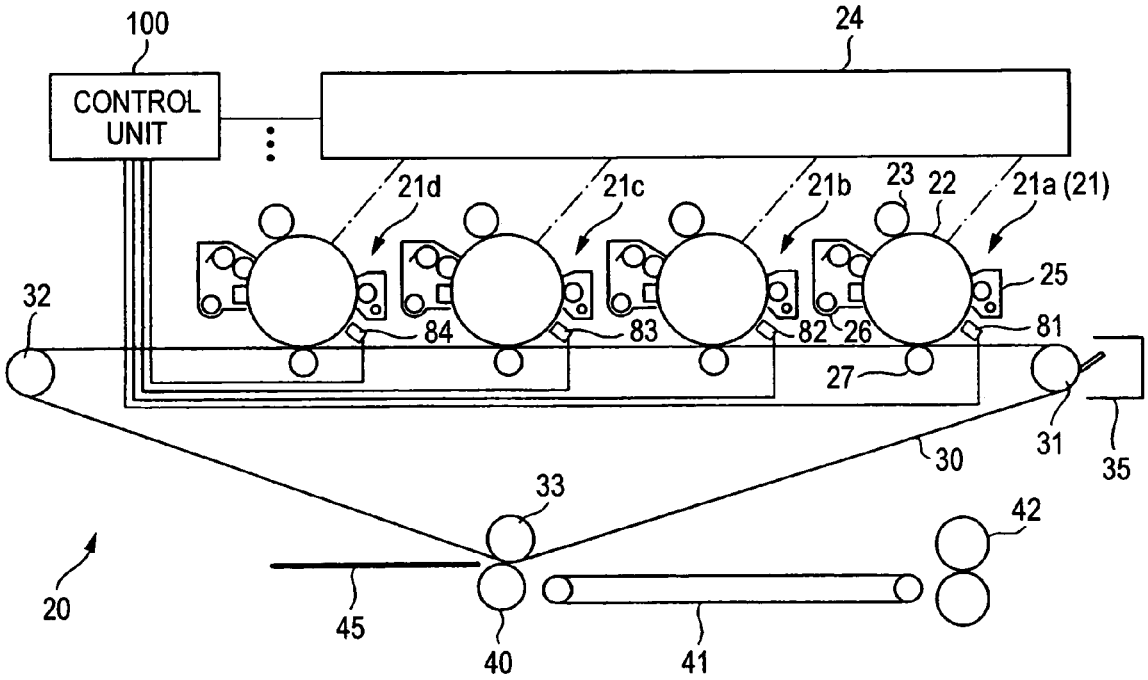
FIG. 40 is a view illustrating the entire configuration of an image forming apparatus according to a sixth embodiment of the invention.

FIG. 40 is a view illustrating the entire configuration of an image forming apparatus according to a sixth embodiment of the invention.

Referring to FIG. 40, a basic configuration of an image forming apparatus is approximately the same as that in the fifth embodiment, except that a method of measuring the concentration of an output image is different from that in the fifth embodiment. In addition, the same components as in the fifth embodiment are denoted by the same reference numerals as in the fifth embodiment, and detailed explanation thereof will be omitted.

In this embodiment, the concentration of an output image is measured by disposing concentration sensors 81 to 84, each of which is composed of a line sensor, at the upstream side of a first transfer portion in a portion facing a photosensitive drum 22 of each image generating unit 21 (21*a* to 21*d*), measuring the concentration of the output image generated on the photosensitive drum 22 by means of each of the concentration sensors 81 to 84, and supplying each measurement result to the control unit 100 so that the control unit 100 can adjust the toner holding amount of the toner holding member 70.

Seventh Embodiment

Figure 41:
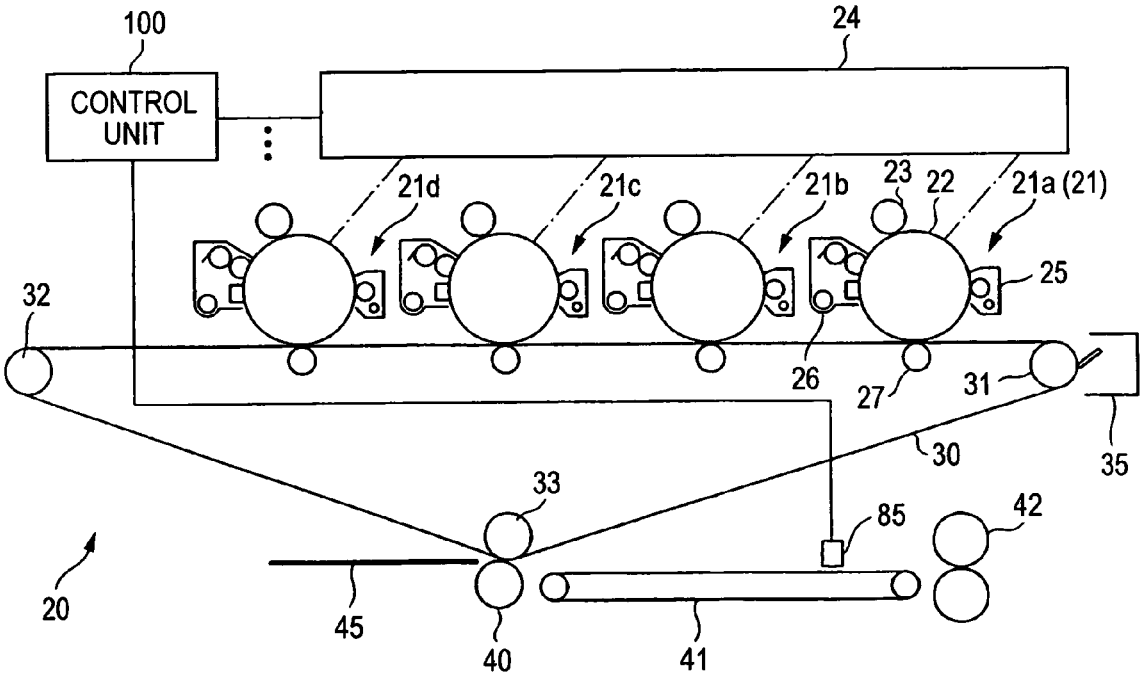
FIG. 41 is a view illustrating the entire configuration of an image forming apparatus according to a seventh embodiment of the invention.

FIG. 41 is a view illustrating the entire configuration of an image forming apparatus according to a seventh embodiment of the invention.

Referring to FIG. 41, a basic configuration of an image forming apparatus is approximately the same as those in the fifth and sixth embodiments, except that a method of measuring the concentration of an output image is different from those in the fifth and sixth embodiments. In addition, the same components as in the fifth and sixth embodiments are denoted by the same reference numerals as in the fifth embodiment, and detailed explanation thereof will be omitted.

In this embodiment, the concentration of an output image is measured, for example, by disposing a concentration sensor 85, which is composed of a line sensor, so as to face a conveying belt 41 provided at the downstream side of a secondary transfer charger 40, measuring the concentration of an output image transferred onto a recording medium 45 by means of the concentration sensor 85, and supplying a measurement result to the control unit 100 so that the control unit 100 can adjust the toner holding amount of the toner holding member 70 of each image generating unit 21.

Eighth Embodiment

Figure 46:
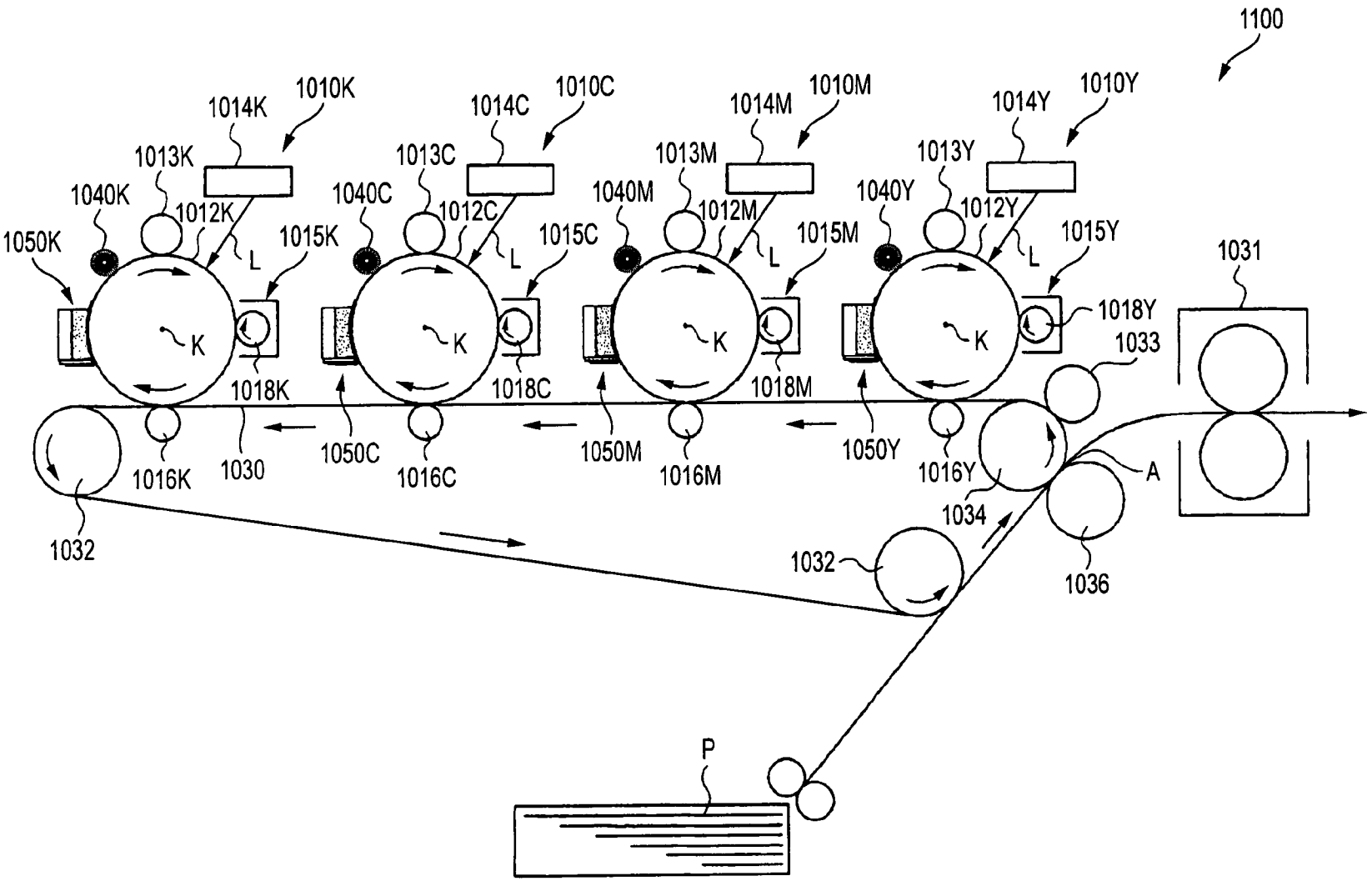
FIG. 46 is a view schematically illustrating the configuration of an image forming apparatus according to an embodiment of the invention.

FIG. 46 illustrates an image forming apparatus 1100 according to a eighth embodiment of the invention.

The image forming apparatus 1100 performs an image processing on the basis of color image information supplied from an image data input device, such as a personal computer (not shown), and forms a color image on a recording paper P by using an electrophotographic method.

The image forming apparatus 1100 includes image forming units 1010Y, 1010M, 1010C, and 1010K forming a toner image corresponding to each of the colors of yellow (Y), magenta (M), cyan (C), and black (K). In addition, hereinafter, when it is necessary to discriminate between the colors of Y, M, C, and K, one of the colors of Y, M, C, and K is suffixed to reference numeral, and when it is not necessary to discriminate between the colors of Y, M, C, and K, the Y, M, C, and K are omitted.

The image forming units 1010Y, 1010M, 1010C, and 1010K are serially disposed in the order of the image forming units 1010Y, 1010M, 1010C, and 1010K with respect to the movement direction of an endless intermediate transfer belt 1030 which is stretched by a backup roller 1034 and plural tension rollers 1032. In addition, the intermediate transfer belt 1030 passes between photosensitive drums 1012Y, 1012M, 1012C, and 1012K, serving as image carriers, of the image forming units 1010Y, 1010M, 1010C, and 1010K and primary transfer rollers 1016Y, 1016M, 1016C, and 1016K disposed to be opposite to the image forming units 1010Y, 1010M, 1010C, and 1010K, respectively.

Next, a configuration of each of the image forming units 1010Y, 1010M, 1010C, and 1010K and an image forming operation will be described by using the image forming unit 1010Y forming a yellow toner image as a representative.

Figure 47:
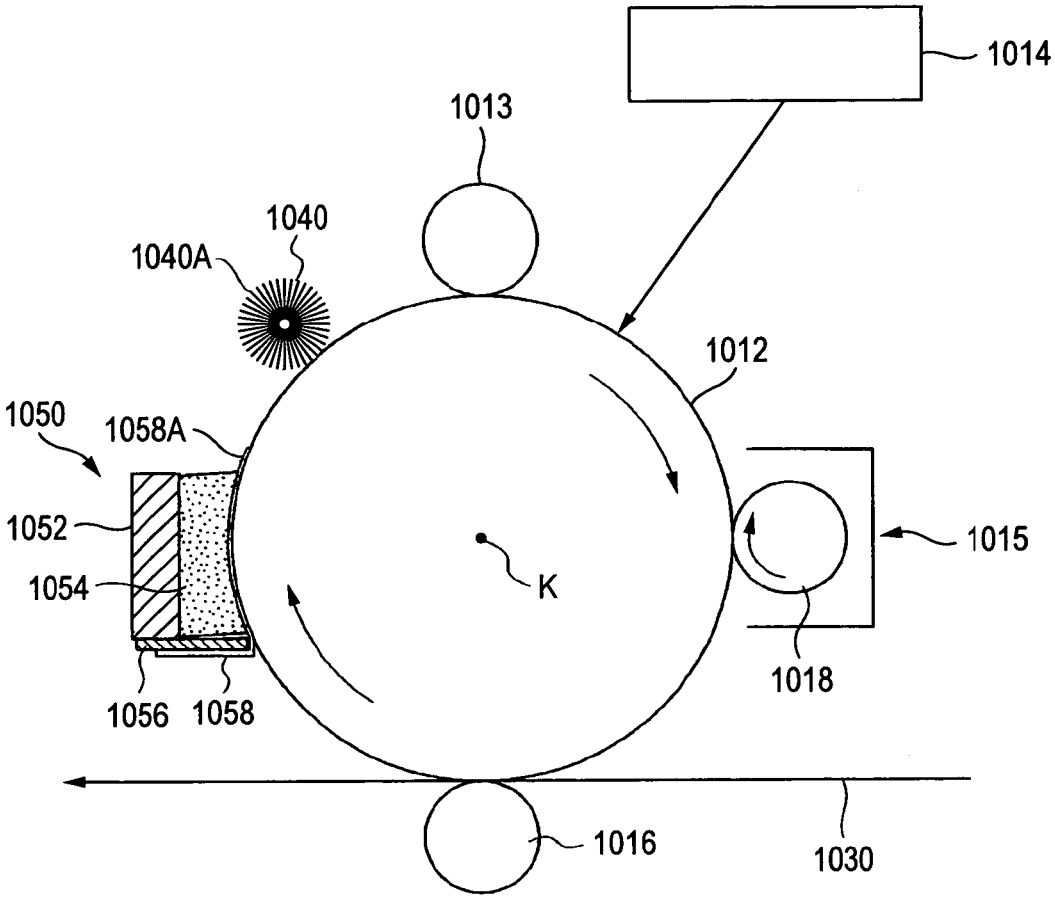
FIG. 47 is a view illustrating the configuration of an image forming unit of the image forming apparatus shown in FIG. 46.

As shown in FIG. 47, a surface of the photosensitive drum 1012Y is uniformly charged by a contact charger 1013Y. Then, an image exposure process corresponding to a yellow image is performed by an exposing unit 1014Y, and thus an electrostatic latent image corresponding to the yellow image is formed on the surface of the photosensitive drum 1012Y.

The electrostatic latent image corresponding to the yellow image is developed by toner carried by a developing roller 1018Y, to which a developing bias is applied, of a developing unit 1015Y, thereby becoming a yellow toner image. The yellow toner image is primary-transferred onto the intermediate transfer belt 1030 by the pressure force of the primary transfer roller 1016Y and the electrostatic suction power due to a transfer bias applied to the primary transfer roller 1016Y.

During the primary transfer process, the entire yellow toner image is not transferred onto the intermediate transfer belt 1030, but some of the yellow toner image remains on the photosensitive drum 1012Y. In addition, on the surface of the photosensitive drum 1012Y, discharge products (activated materials, such as ozone or nitride oxide, and products generated by reaction thereof) are generated due to a charging process. The photosensitive drum 1012Y after the first transfer has been performed passes through a contact position at which the photosensitive drum 1012Y is in contact with a fixed pad 1050Y, and thus the discharge products formed on the photosensitive drum 1012Y are removed. The fixed pad 1050Y will be described in detail later.

Furthermore, the photosensitive drum 1012Y passes through a contact position, at which the photosensitive drum 1012Y is in contact with a rotary brush 1040Y for controlling the toner charging process, at the downstream side of the fixed pad 1050Y. Transfer-remaining yellow toner remaining on the photosensitive drum 1012Y is primarily held by the rotary brush 1040Y (which will be described in detail later) and at the same time is charged to have a normal polarity, thereby being attached onto the photosensitive drum 1012. Then, the toner attached on the photosensitive drum 1012 is developed at a developing unit 1015 and collected (cleaned) by the developing roller 1018Y at the same time.

Accordingly, the image forming apparatus 1100 adopts a so-called blade-less system in which the developing process and the collection (cleaning) process for the transfer-remaining toner are performed at the same time without a cleaning blade which removes the transfer-remaining toner on the photosensitive drum 1012 by optimizing the setting conditions for the developing bias of the developing roller 1018 of the developing unit 1015.

Thereafter, the surface of the photosensitive drum 1012Y is recharged by the contact charger 1013Y due to a subsequent image forming cycle.

As shown in FIG. 46, in the image forming apparatus 1100, the image forming process described above is performed by each of the image forming units 1010Y, 1010M, 1010C, and 1010K at a timing considering the difference in the relative positions of the image forming units 1010Y, 1010M, 1010C, and 1010K, and thus toner images corresponding to the respective colors of Y, M, C, and K are superposed in a sequential manner so as to form a full-color toner image.

Subsequently, by the electrostatic suction power of a secondary transfer roller 1036 to which a transfer bias is applied, the full-color toner image is collectively transferred from the intermediate transfer belt 1030 onto the recording paper P conveyed to the secondary transfer position A at a predetermined timing.

The recording paper P on which the full-color toner image has been transferred is detached from the intermediate transfer belt 1030 to be carried to a fixing unit 1031, and then the full-color toner image is fixed on the recording paper P by heat and pressure.

The transfer-remaining toner on the intermediate transfer belt 1030 which has not been transferred onto the recording paper P is collected by a cleaner 1033 for the intermediate transfer belt.

Next, a fixed pad 1050 will be described.

Figure 48:
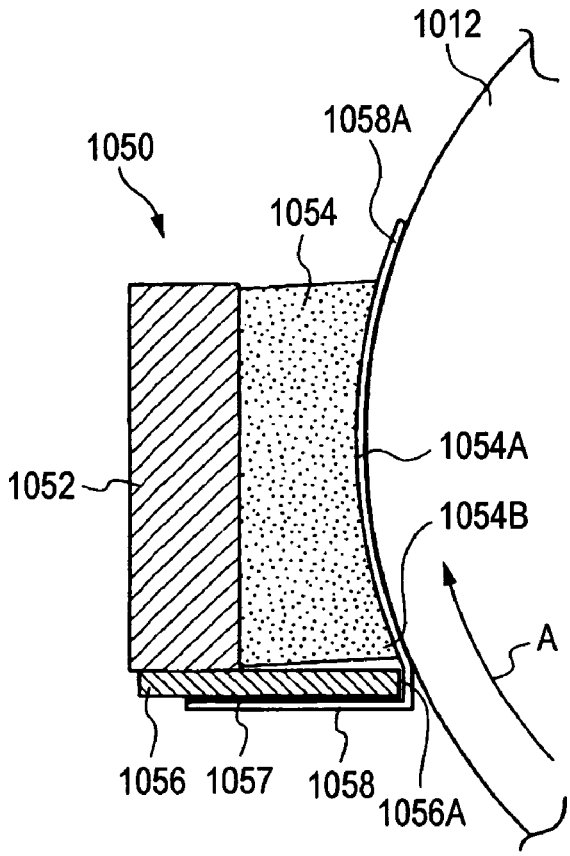
FIG. 48 is a cross-sectional view illustrating a fixed pad used in the image forming apparatus shown in FIG. 46.
Figure 49:
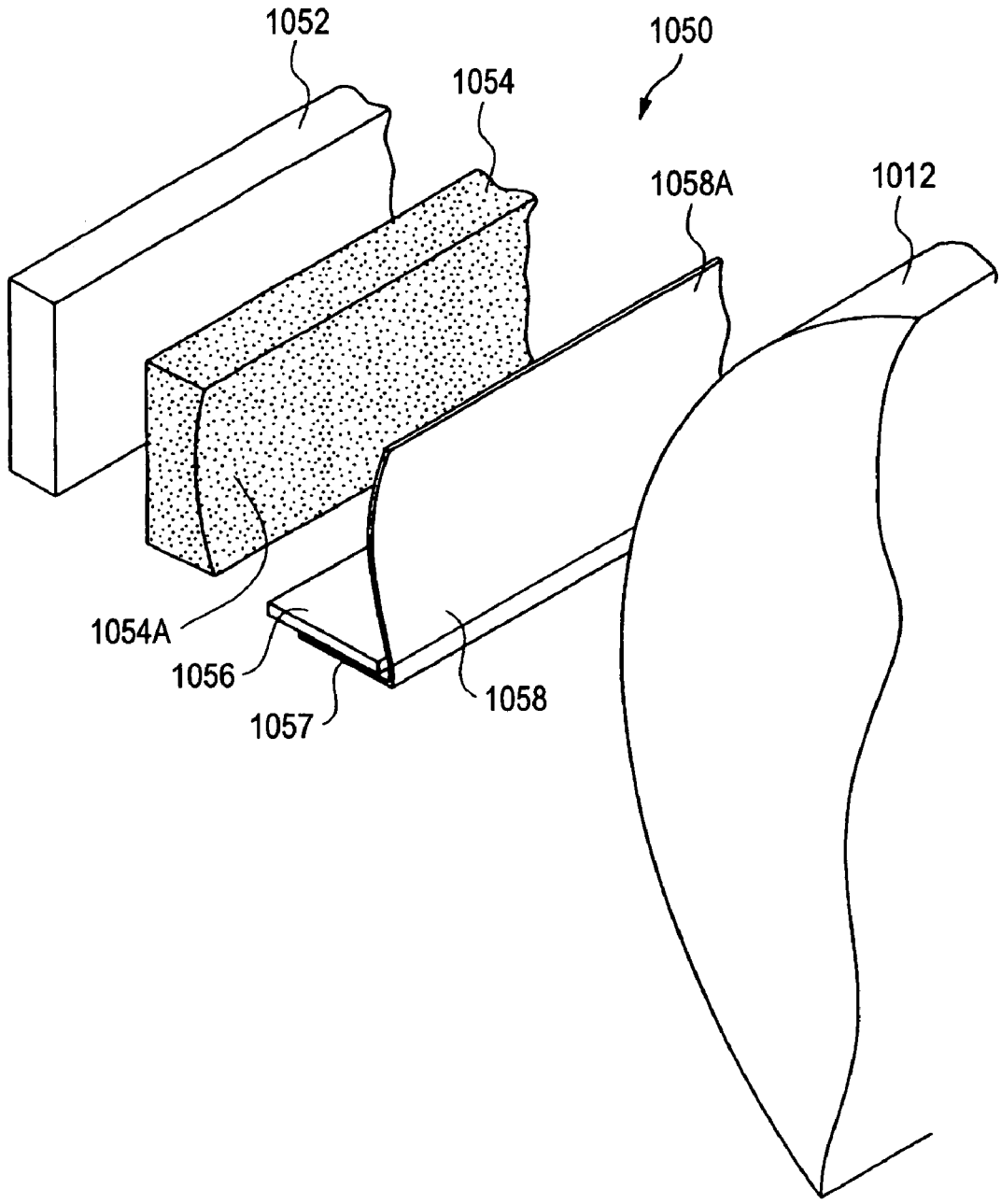
FIG. 49 is an exploded cross-sectional view illustrating the fixed pad used in the image forming apparatus shown in FIG. 46.

As shown in FIGS. 48 and 49, the fixed pad 1050 is disposed over the entire width of the photosensitive drum 1012 along the axis direction of the photosensitive drum 1012. In the fixed pad 1050, a resilient sponge 1054 is adhered to a surface of a rigid support body 1052 having a rectangular plate shape. The sponge 1054 has a concave curved surface 1054A formed along the circumferential surface of the photosensitive drum 1012. On a side wall of the support body 1052, a plate-shaped fixed member 1056 is mounted at the upstream side of the rotational direction (direction indicated by an arrow A; hereinafter, referred to as a process direction) of the photosensitive drum 1012. The fixed member 1056 is disposed along the side surface of the sponge 1054. A front end surface 1056A of the fixed member 1056 is located up to a pointed end portion 1054B of the sponge 1054 located at the upstream side of the process direction and faces the circumferential surface of the photosensitive drum 1012 with a predetermined gap interposed therebetween in the axis direction of the photosensitive drum 1012. On a side wall of the fixed member 1056, a nonwoven fabric 1058 serving as a sheet-shaped member is adhered to a side wall of the fixed member 1056 by using an adhesive 1057. The nonwoven fabric 1058 is bent from the side wall of the fixed member 1056 toward the front end surface 1056A of the fixed member 1056 so as to cover the curved surface 1054A of the sponge 1054. In addition, since a front end portion 1058A located at the downstream side of the nonwoven fabric 1058 is a free end, the front end portion 1058A of the nonwoven fabric 1058 is not fixed on the sponge 1054 or the support body 1052.

As shown in FIG. 48, the nonwoven fabric 1058 is interposed between the curved surface 1054A of the sponge 1054 and the photosensitive drum 1012, and the sponge 1054 is pressed by a predetermined pressure in the direction of the photosensitive drum 1012 by means of a support body (not shown). Thereby, the sponge 1054 deforms in a resilient manner, and as a result, the curved surface 1054A of the sponge 1054 is in contact with the nonwoven fabric 1058 and the surface of the nonwoven fabric 1058 is in contact with the circumferential surface of the photosensitive drum 1012.

In the present embodiment, foaming urethane is used as a material of the sponge. In addition, the thickness of the sponge 1054 is about 3 mm (at a portion in which the bent amount is lowest), and the nip width between the nonwoven fabric 1058 and the photosensitive drum 1012 is about 5 mm.

Furthermore, the nonwoven fabric literally means a 'fabric which is not woven', and is a sheet formed by mixing fibers in various methods. According to a method of manufacturing the nonwoven fabric, a dry nonwoven fabric, a sponge band, a wet nonwoven fabric, and the like are formed.

A dry nonwoven fabric is used for the nonwoven fabric 1058 in the present embodiment. Specifically, fibers, each having a length of several centimeters, are made into a thin sheet by using a carder or an air random weaver, and according to the necessity, several sheets overlap each other. The fibers are interwound by high-pressure and fine water flow (sponlace).

In addition, as shown in FIG. 47, the rotating brush 1040 is formed by embedding plural brush fibers 1040A around a conductive rotary axis in a radial shape. For example, a bias of −850 V is applied to the rotating brush 1040, and thus a potential difference is generated between the potential of the rotating brush 1040 and the charge potential of the photosensitive drum 1012. In addition, the diameter (ϕ) of the rotating brush 1040 is set to 10 mm. UU nylon is used as a material of the brush fiber 1040A. The diameter of the brush fiber 1040A is about 0.5 d (denier), the length of the brush fiber 1040A is about 2.5 mm, and the embedded amount is about 1.0 mm.

Next, an operation of the present embodiment will be described.

As shown in FIG. 47, the photosensitive drum 1012 after a toner image has been transferred onto the intermediate transfer belt 1030 rotates in the direction indicated by the arrow A and passes through a contact portion where the photosensitive drum 1012 is in contact with the fixed pad 1050.

On the contact portion where the photosensitive drum 1012 is in contact with the fixed pad 1050, the nonwoven fabric 1058 is pressed with a predetermined pressure against the circumferential surface of the photosensitive drum 1012 by the sponge 1054. Since the nonwoven fabric 1058 has a high fiber density, the discharge products attached on the surface of the photosensitive drum 1012 are removed by the nonwoven fabric 1058.

Further, the photosensitive drum 1012 rotates in the direction indicated by the arrow A so as to come in contact with the rotating brush 1040. Transfer-remaining toner, which has not been transferred onto the intermediate transfer belt 1030, is attached and held on the rotating brush 1040 for a while, and then electrically charged to a normal polarity (negative polarity) so as to be attached onto the photosensitive drum 1012. In addition, the transfer-remaining toner becomes uniform, and thus a problem caused by toner which has remained on the photosensitive drum 1012 can be solved.

Thereafter, the transfer-remaining toner adjusted to the normal polarity (negative polarity in the present embodiment) is sent to the contact charger 1013. Since a charging bias of about −520 V is applied to the contact charger 1013 and thus a repulsive force is generated between the transfer-remaining toner and the contact charger 1013, the transfer-remaining toner having the normal polarity passes through the contact charger 1013.

The transfer-remaining toner, having the normal polarity (negative polarity), having passed the contact charger 1013 is sent to a portion (developing portion) facing the developing roller 1018 of the developing unit 1015. Then, by optimizing the setting condition on the developing bias of the developing roller 1018 of the developing unit 1015, the transfer-remaining toner is developed and collected (cleaned) by the developing unit 1015. In addition, the developing roller 1018 rotates in a direction opposite to the rotational direction of the photosensitive drum 1012 in order to improve the collection efficiency of the transfer-remaining toner.

In the image forming apparatus 1100, the discharge products are generated when the transfer-remaining toner is charged by the contact charger 1013. In particular, in a case of using an AC+DC contact-charging method in which DC is superposed on AC, a lot of discharge products are generated. The discharge products are attached on the surface of the photosensitive drum 1012, and in particular, under the high-temperature and high-humidity environment, moisture is absorbed in a portion on which the discharge products remain, which causes a phenomenon in which an image becomes white. Assumedly, this is because the discharge products reduce the electrical resistance of the surface of the photosensitive drum 1012 so as to disperse a latent image. In particular, in a method in which the development and the collection (cleaning) are performed at the same time by the developing unit 1015 without preparing a cleaning blade serving as a cleaning unit as in the present embodiment, the discharge products on the photosensitive drum 1012 cannot be removed by the cleaning blade.

However, in the image forming apparatus 1100 according to the present embodiment, since the fixed pad 1050 can be pressed against the surface of the photosensitive drum 1012 after a transfer process is performed so that the nonwoven fabric 1058 comes in contact with the photosensitive drum 1012 with a uniform contact pressure, it is possible to reliably remove the discharge products. Accordingly, a problem caused by the attached discharge products, for example, a phenomenon in which an image becomes white can be prevented.

Furthermore, since the sponge 1054 has the curved surface 1054A, in correspondence with the diameter of the photosensitive drum 1012, in the fixed pad 1050, it is possible to obtain a uniform pressure over the entire contact surface of the photosensitive drum 1012. Accordingly, since it is possible to prevent a partially high pressure from being generated, and thus it is possible to solve problems in which, for example, the abrasion amount of the surface of the photosensitive drum 1012 increases. In addition, since a function of the nonwoven fabric 1058 holding toner or external additive and a function of the sponge 1054 pressed against the photosensitive drum 1012 are separated, a problem does not occur in which, for example, a brush fiber loses the elasticity due to a conventional brush pressing operation and thus the brush fiber is bent.

Figure 50A:
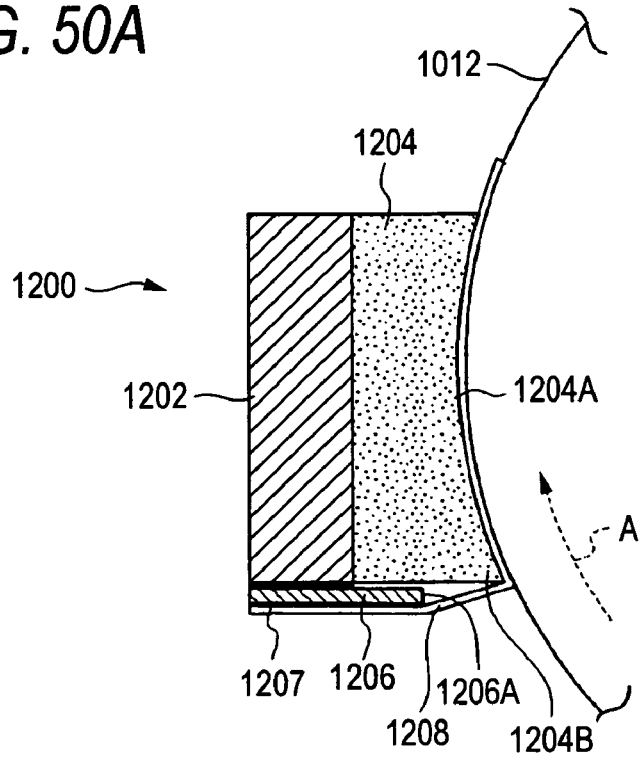
FIG. 50A is a cross-sectional view illustrating a fixed pad in which a fixed member of a nonwoven fabric is not used.

On the other hand, as shown in FIG. 50A, in a fixed pad 1200 in a comparative example, a fixed member 1206 is mounted on a side wall of a support body 1202 located at the upstream side (upstream side of the direction indicated by an arrow A) of the process direction and a front end portion 1206A of the fixed member 1206 is located at an intermediate portion (near to center) of a side surface of a sponge 1204. A nonwoven fabric 1208 is adhered to the side surface of the fixed member 1206 by using an adhesive 1207 and the nonwoven fabric 1208 is bent at a pointed end portion 1204B of the sponge 1204 so as to cover the entire curved surface 1204A.

Figure 50B:
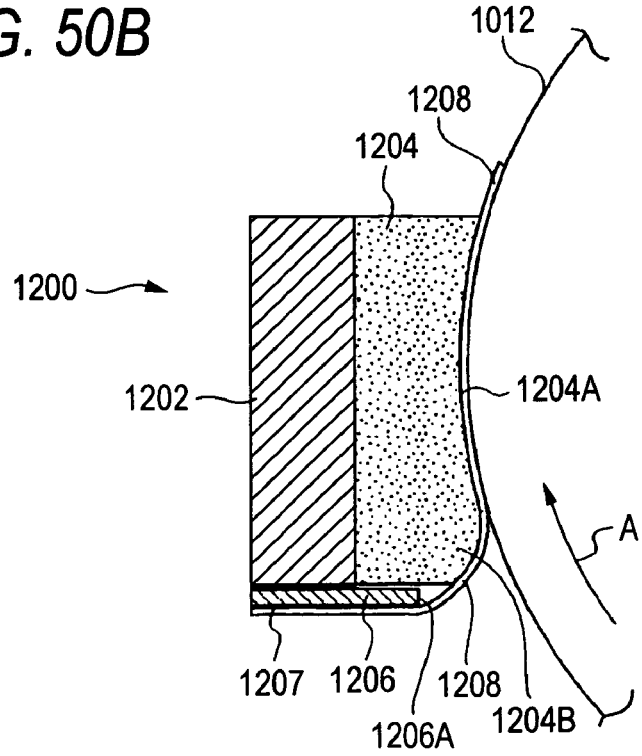
FIG. 50B is a view illustrating the state in which a sponge deforms when a photosensitive drum rotates.

In the fixed pad 1200, as shown in FIG. 50B, when the photosensitive drum 1012 rotates in the direction indicated by the arrow A, the fixed member 1206 cannot prevent the sponge 1204 from deforming. Accordingly, the nonwoven fabric 1208 abrades against the photosensitive drum 1012, which deforms the pointed end portion 1204B of the sponge 1204. For this reason, it is not possible to make the contact pressure uniform over the entire contact surface of the nonwoven fabric 1208. On the other hand, in the fixed pad 1050 according to the present embodiment, as shown in FIG. 48, since the fixed member 1056 is provided along the side surface of the sponge 1054 located at the upstream side (upstream side of the direction indicated by the arrow A) of the process direction and the nonwoven fabric 1058 is adhered to the fixed member 1056, it is possible to prevent the sponge 1054 from deforming by using the fixed member 1056. That is, since the nonwoven fabric 1058 is adhered to the fixed member 1056, the nip shape of the nonwoven fabric 1058 between the sponge 1054 and the photosensitive drum 1012 is maintained. As a result, it is possible to obtain a uniform nip pressure. In addition, since the front end portion 1058A of the nonwoven fabric 1058 is a free end, it is possible to prevent the nonwoven fabric 1058 from wrinkling between the sponge 1054 and the photosensitive drum 1012. As a result, the nonwoven fabric 1058 can be pressed against the photosensitive drum 1012 uniformly and stably.

FIRST EXAMPLE

This example was performed for the image forming apparatus according to the first embodiment under the conditions to be described below. In addition, a first comparative example represents a case in which toner is not held in the toner holding member of the first embodiment.

Figure 24:
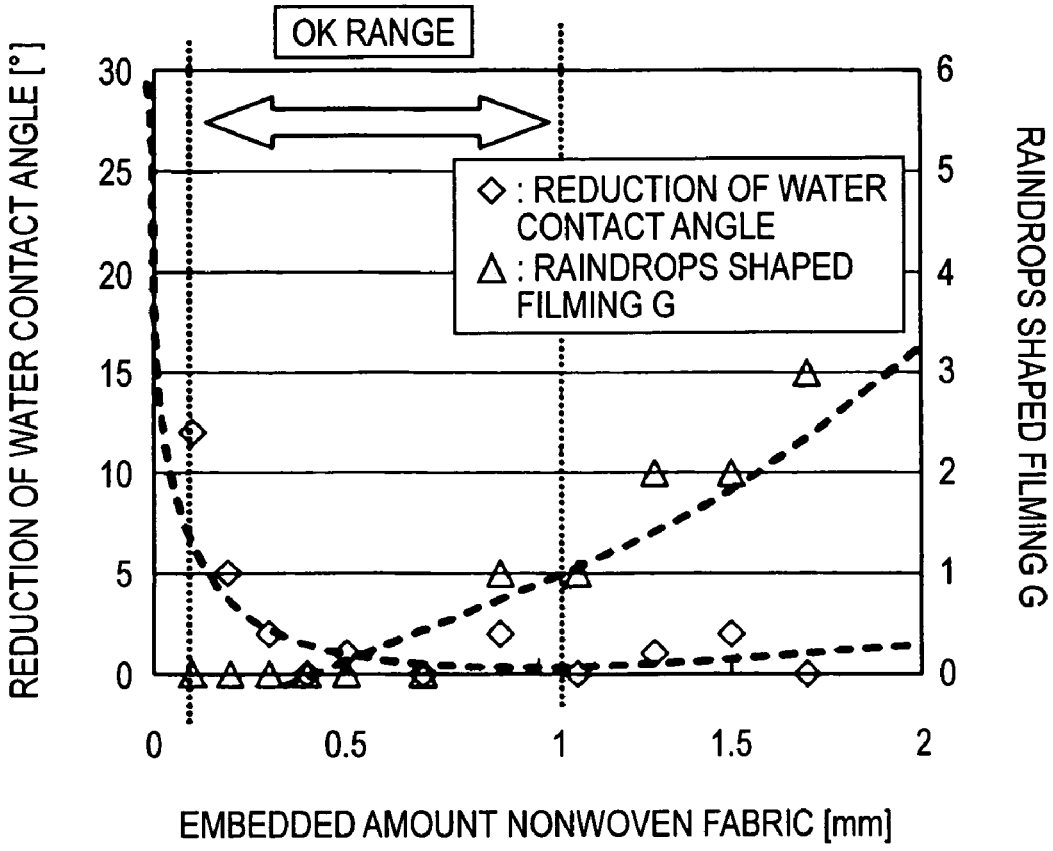
FIG. 24 is an explanatory view illustrating a basic function of a toner holding member according to a first example.
Figure 25:
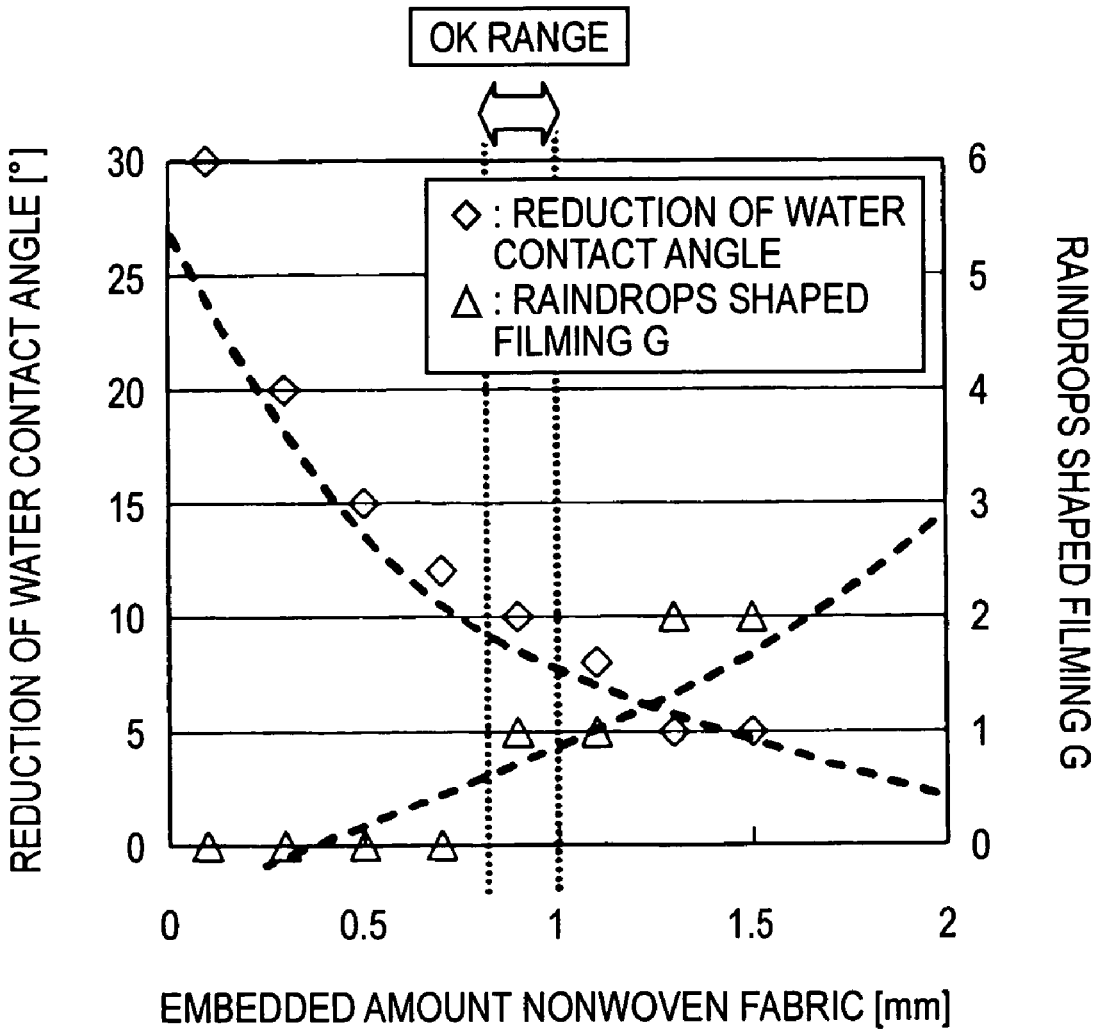
FIG. 25 is an explanatory view illustrating a function of a toner holding member according to a first comparative example.

In the first example and the first comparative example, the embedded amount of a nonwoven fabric of the toner holding member was changed, a photosensitive drum rotated about 4000 cycles for one hour in a high-temperature and high-humidity condition of, for example, 28° C. and 85%, and then it was examined how many degrees the contact angle of the photosensitive drum with respect to water was reduced (barometer of discharge product removal) and how much raindrops shaped filming occurred. As a result, the results is shown in FIGS. 24 and 25 were obtained.

The experiment conditions of the image forming apparatus in the example are as follows:

- Photosensitive drum: OPC (ϕ30 mm)
- Intermediate transfer member: polyimide resin
- Process speed: 104 mm/sec.
- Charging roller: AC applied, Iac=0.65 mA, Vdc=−520 V, f=614 Hz
- Exposing unit: laser 780 nm
- Potential of latent image: background portion=−500 V, image portion=−200 V
- Developing unit:
  - Developing method: two-components development
  - Developing roller: diameter of sleeve=ϕ16 mm, rotation speed of sleeve=208 mm/sec.
  - Gap between photosensitive drum and developing roller: 0.3 mm
  - Developing bias: DC component=−400 V, AC component=−1.5 kVp-p (6 kHz)
- Transfer condition:
  - Primary transfer bias: +500 to 1000 V
  - Secondary transfer bias: +1600 V
- Cleaning unit:
  - Rotary brush: conductive nylon, applied voltage=0 V
  - Toner holding member: formed by mixing an insulating nylon (registered trademark, the same hereinbelow) having a diameter of about 15 μm, an insulating nylon having a diameter of about 5 μm, and a fine polyester fiber, thickness=500 micron, attached on urethane sponge having a thickness of 3 mm, applied voltage=−850 V
  - Toner holding amount: about 10 mg/cm$^2$ In FIGS. 24 and 25, since the initial contact angle of the photosensitive drum with respect to water is 90° and an image becomes white when the contact angle is reduced above 10°, the reduced amount of contact angle is used as a barometer of discharge product removal. In addition, the raindrops shaped filming was examined by using an optical microscope and classified into several grades below according to the generated level. Here, it was determined that G1 or less was allowed.

G0: Not generated

G1: little generated, a phenomenon in which an image becomes white was not generated G2: a little generated, the phenomenon in which an image becomes white was generated a little G3: generated, the phenomenon in which an image becomes white was partially generated in a stripe shape G4: considerably generated, half of a print becomes white G5: significantly generated over almost the entire surface, the entire surface of a print becomes white Referring to FIG. 24, in the first example, it can be seen that, for the embedded amount of the nonwoven fabric of the toner holding member, a range of 0.15 to 1.0 mm is an OK range (range satisfying that the water contact angle is reduced by 10° or less and the grade of the raindrops shaped filming is G1 or below) and an ability of removing discharge products has been noticeably improved by the toner holding, and accordingly, the OK range is wide.

In contrast, referring to FIG. 25, in the first comparative example, it can be seen that, for the embedded amount of the nonwoven fabric of the toner holding member, a range of 0.8 to 1.0 mm is an OK range, which is very narrow.

SECOND EXAMPLE

In this example, instead of the nonwoven fabric, a fixed brush (a brush formed by mixing an insulating nylon having a diameter of about 15 μm and an insulating fine nylon having a diameter of about 5 μm) was used as the toner holding member so as to hold toner. In addition, a second comparative example represents a case in which toner is not held in the toner holding member of the second example.

In the second example and the second comparative example, the front end force of the fixed brush, which is a toner holding member, was changed, a photosensitive drum rotated about 4000 cycles for one hour in a high-temperature and high-humidity condition of, for example, 28° C. and 85%, and then it was examined how many degrees the contact angle of the photosensitive drum with respect to water was reduced (barometer of discharge product removal) and how much raindrops shaped filming occurred. As a result, the results shown in FIGS. 26 and 27 were obtained.

Figure 26:
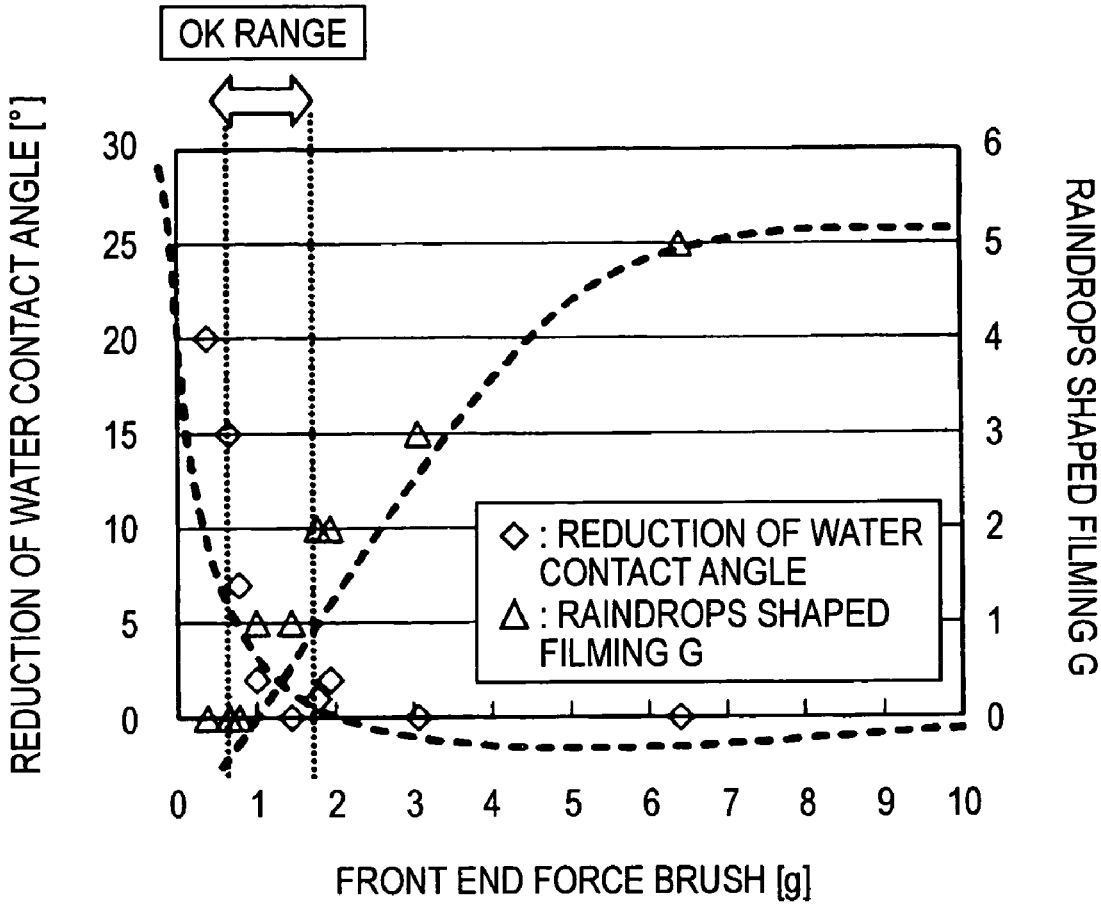
FIG. 26 is an explanatory view illustrating a basic function of a toner holding member according to a second example.

Referring to FIG. 26, in the second example, it can be seen that, if the front end force is about 1 g/cm or more, the water contact angle can be reduced by 10° or less, and it is possible to remove discharge products and to prevent the raindrops shaped filming at the same time.

Figure 27:
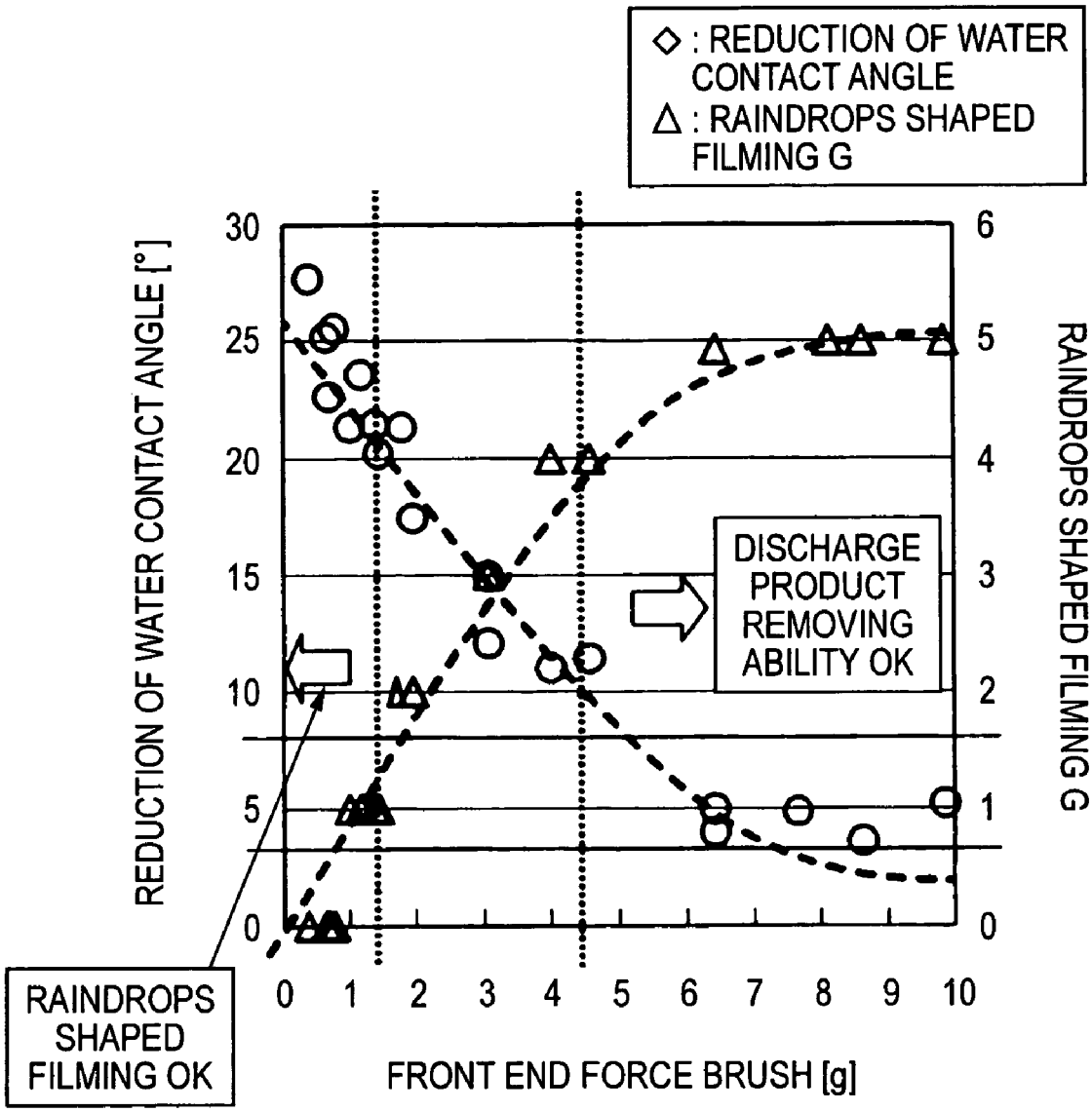
FIG. 27 is an explanatory view illustrating a function of a toner holding member according to a second comparative example.

In contrast, referring to FIG. 27, in the second comparative example, the front end force of about 4 g/cm or more is needed to suppress the water contact angle from being reduced by 10° or less. However, in order to make the grade of the raindrops shaped filming G1 or below, the front end force of about 1.5 g/cm or less is needed. Therefore, it can be seen that it is not difficult to prevent an image from becoming white due to discharge products and to prevent the image quality from deteriorating due to the raindrops shaped filming at the same time.

THIRD EXAMPLE

In this example, a fixed brush was used as a toner holding member of the image forming apparatus according to the first embodiment.

In the example, the relationship between the weight of toner held within the brush before remaining toner rush and the weight of toner held within the brush after remaining toner rush was examined under the conditions in which the fiber diameter of a conductive wool was 2d (diameter of about 15 μm), the fiber length was 4 mm, and the width was 6 mm in the fixed brush. As a result, the result shown in FIG. 28 was obtained. In addition, in the drawing, the toner rush length was 264 mm (corresponding to one rotation of a photosensitive drum), • represents that the amount of rushed toner is 5.0 $g/m^2$, and Δ represents that the amount of rushed toner is 0.5 $g/m^2$.

Figure 28:
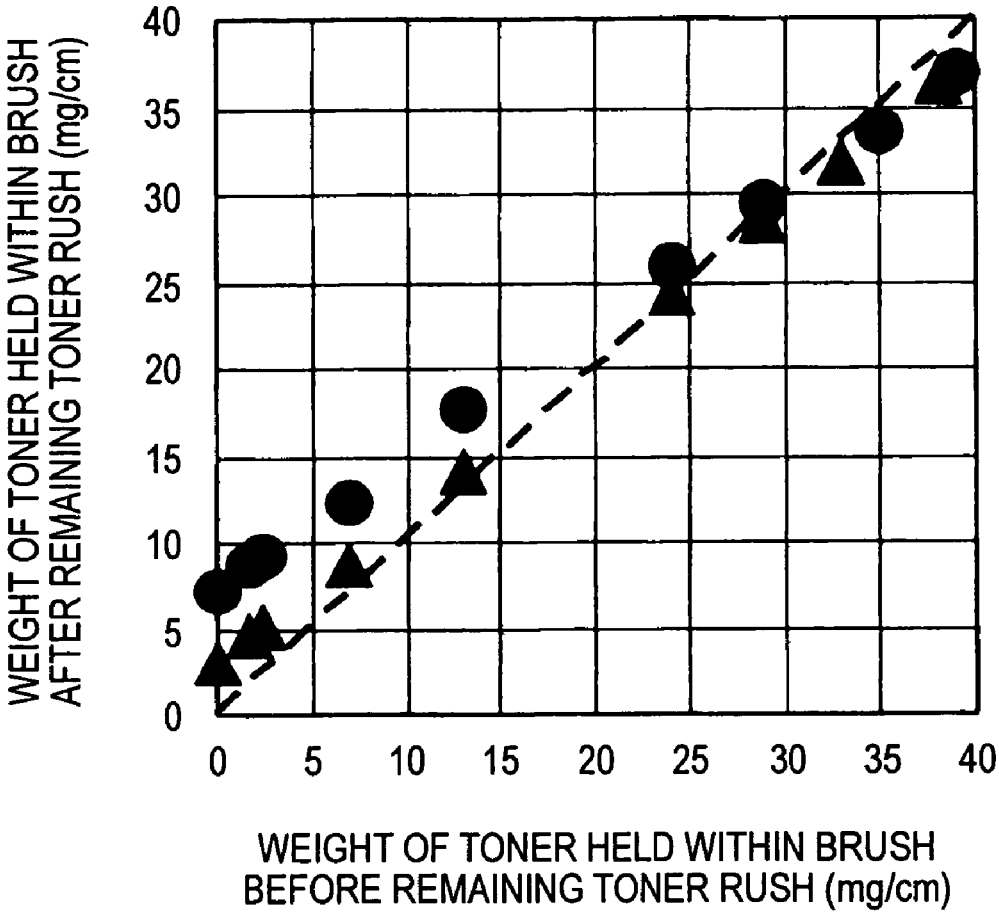
FIG. 28 is a graph illustrating the relationship between the weight of toner held within a brush before remaining toner rushes and the weight of toner held within the brush after remaining toner has rushed in a toner holding member according to a third example.

Referring to FIG. 28, it can be seen that the amount of toner held within the brush is large if the weight of toner held within the brush before toner rush is small and is small if the weight of toner held within the brush before toner rush is large.

From the point of view, it can be understood that the weight of toner held within the brush after toner rush can be estimated on the basis of the weight of toner held within the brush before toner rush and the amount of rushed toner.

In this example, the relationship between the number of rotations of a photosensitive drum and the weight of toner held within the brush after remaining toner rush was examined. As a result, the result shown in FIG. 29 was obtained.

Figure 29:
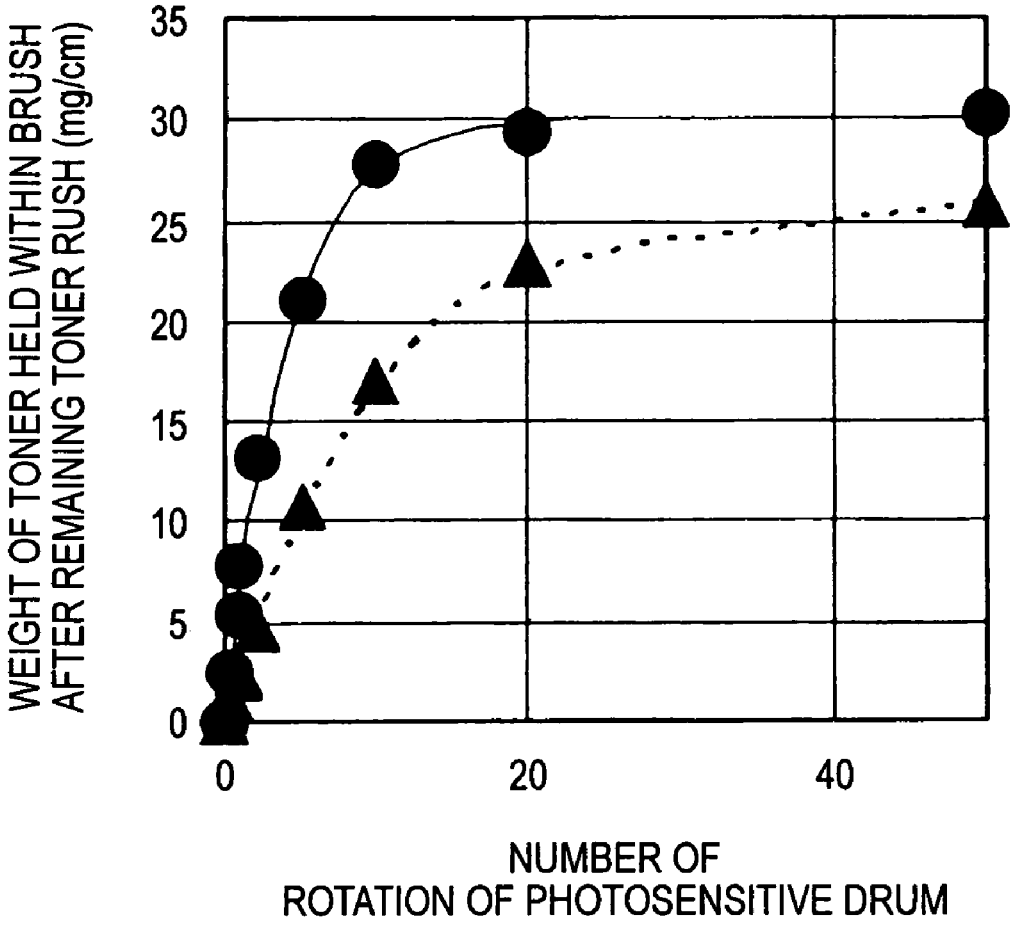
FIG. 29 is a graph illustrating the relationship between the number of rotations of a photosensitive drum and the weight of toner held within the brush after remaining toner has rushed in the third example.

Referring to FIG. 29, it can be seen that the weight of toner held within the brush increases according to the rush length (corresponding to the number of rotation of the photosensitive drum) and is saturated at a predetermined place. Such variation can be traced by using an exponential function.

Accordingly, in a case of a short rush length, the weight of toner held within the brush can be estimated from a regression equation in FIG. 29.

Further, in the third example and the third comparative example (a case in which a toner holding member is not used), a test on a phenomenon in which an image becomes white was performed, and as a result, the result shown in FIG. 30 was obtained.

Referring to FIG. 30, the same image patterns are used in a test chart 1, and three kinds of image patterns are randomly exchanged every 100 sheets of paper in a test chart 2. In addition, the process speed was 168 mm/sec. in the third example and the third comparative example, and the image pattern detection area was 8.4 mm×8.4 mm (600 dpi: 200×200 pixels) and a correction period was set to a job end for each A4-size sheet of paper.

As shown in FIG. 30, in the third example, since there is no possibility that an image will become white even if 50000 sheets of paper have been used, it is possible to effectively prevent a defective image from being generated as compared is with the third comparative example.

FOURTH EXAMPLE

This example was performed for the image forming apparatus according to the second embodiment.

In the example, the relationship between the weight of toner held within the brush and the weight of toner having passed through the brush was examined under the conditions in which the fiber diameter of a conductive wool was 2d (diameter of about 15 μm), the fiber length was 4 mm, and the width was 6 mm in the fixed brush serving as a toner holding member, and the amount of rushed toner was 0.8 mg (1 cm (width)×42 cm (length)). As a result, the result shown in FIG. 31 was obtained.

Figure 31:
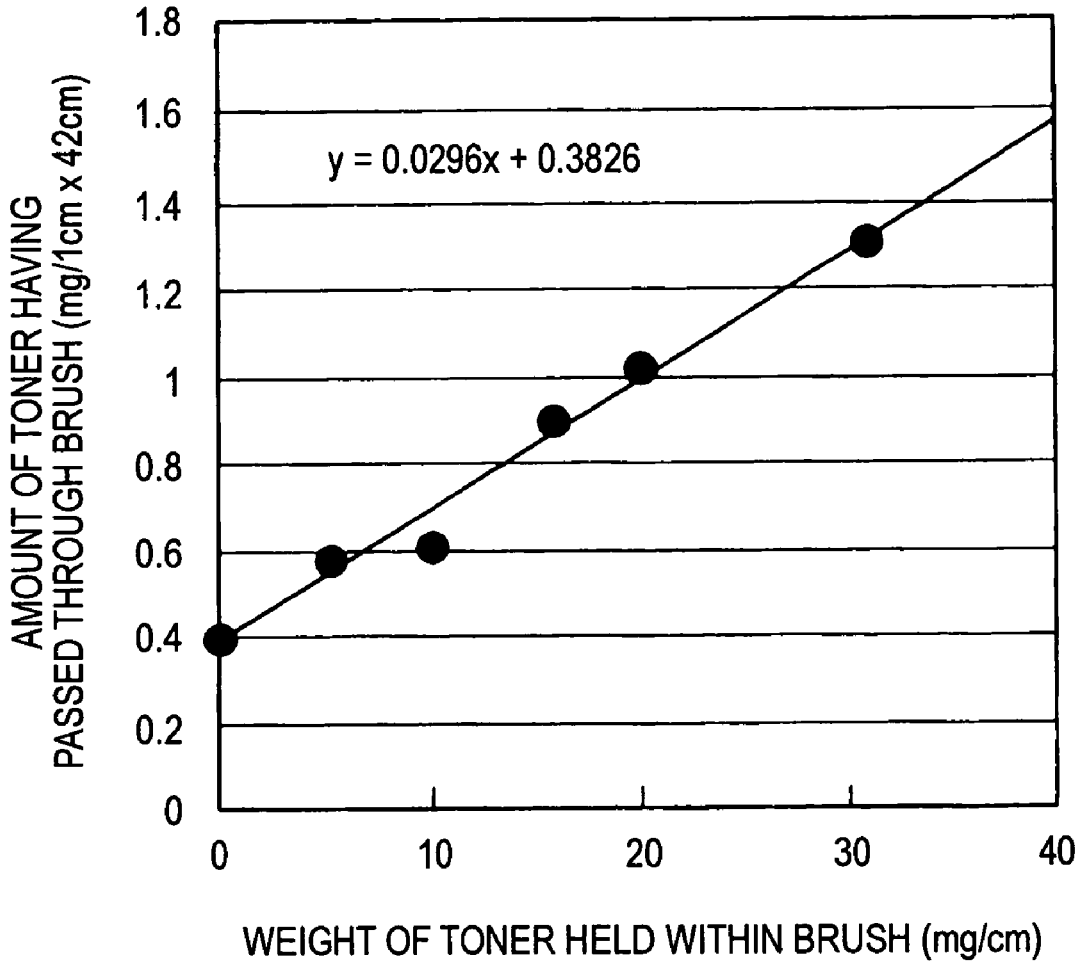
FIG. 31 is a graph illustrating the relationship between the weight of toner held within the brush and the weight of toner having passed through the brush in a fourth example.

Referring to FIG. 31, it can be seen that the amount of toner having passed through the brush is proportional to the weight of toner held within the brush before toner rushes. Accordingly, it is possible to estimate the weight of toner held within the brush before the toner rush on the basis of the amount of toner having passed through the brush.

Further, in the fourth example and the fourth comparative example (cases in which a toner holding member is not used), a test on an image which becomes white was performed, and as a result, the result shown in FIG. 32 was obtained.

Referring to FIG. 32, as the test conditions, a detection image for correction had 29 cm (width)×3.1 cm (length) at Cin 50%, the width where the pass-through amount is detected was about 8.4 mm (600 dpi: 200 pixels), and a period for the leak detection was set to a job end for every 100 A4-size sheets of paper.

As shown in FIG. 32, in the fourth example, it was confirmed that a phenomenon in which an image becomes white did not occur even if 50000 sheets of paper were used, in contrast to the comparative example in which the phenomenon in which an image becomes white was observed dimly from 20000 sheets of paper.

In addition, even for the image forming apparatus according to the third embodiment, the same experiment was performed, and approximately the same result as in the fourth example was obtained.

FIFTH EXAMPLE

In this example, a fixed brush was used as a toner holding member of the image forming apparatus according to the fifth embodiment.

In the example, a grade, at which an image becomes white as the amount of toner (toner holding amount) held in the fixed brush is changed, was examined under the conditions in which the fiber diameter of a conductive wool was 2 d (diameter of about 15 μm), the fiber length was 4 mm, and the width was 6 mm in the fixed brush. As a result, the result shown in FIG. 42 was obtained. Here, the experimental condition is approximately the same as that in the first example.

Figure 42:
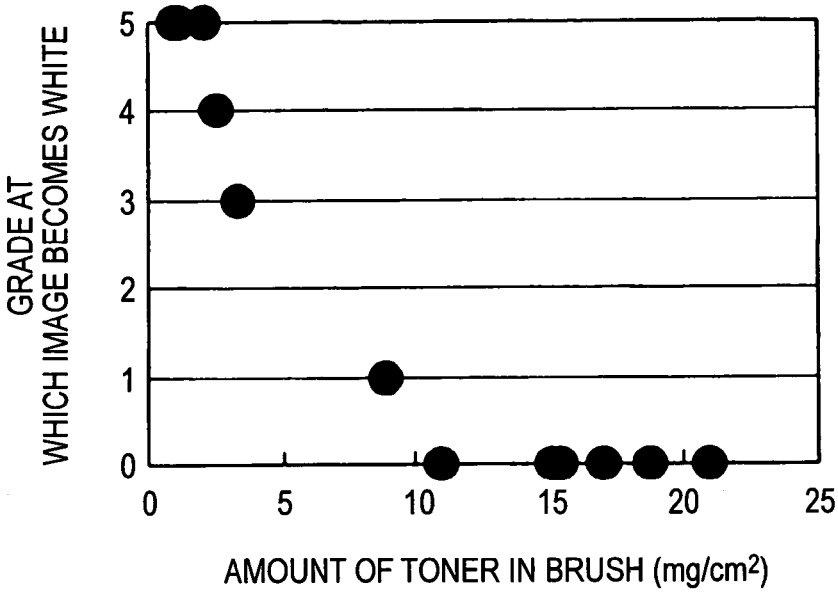
FIG. 42 is an explanatory view illustrating the relationship between the toner holding amount of a toner holding member and the grade in which an image becomes white according to a fifth example.

Referring to FIG. 42, it has been confirmed that, if the amount of toner held in the fixed brush is larger than a predetermined amount (in this example, 10 mg/cm$^2$), a grade G0 at which an image becomes white can be realized.

Figure 43:
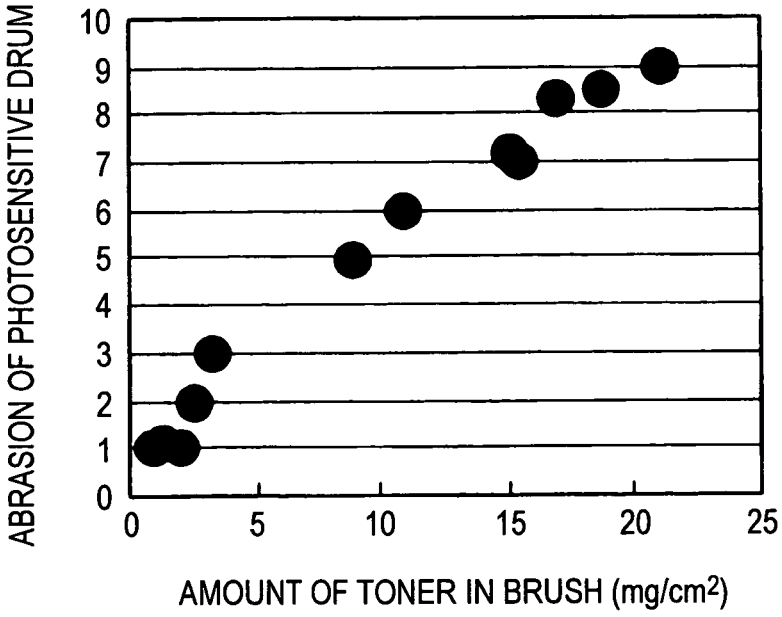
FIG. 43 is an explanatory view illustrating the relationship between the toner holding amount of the toner holding member and the abrasion amount of a photosensitive drum according to the fifth example.

Further, in the example, the abrasion amount of a photosensitive drum after the photosensitive drum has been rotated by 200,000 turns was examined as the amount of toner held in the fixed brush of the toner holding member is changed, and as a result, the result shown in FIG. 43 was obtained.

As can be seen in FIG. 43, it is confirmed that, if the amount of toner held in the fixed brush increases, the abrasion amount of the photosensitive drum also increase, which suppresses an image from becoming white. Here, in order to suppress the abrasion amount of the photosensitive drum within a proper range, it is necessary to set the toner holding amount with respect to the fixed brush to a proper value.

Furthermore, in the fifth example and the fifth comparative example (a case in which a toner holding member is not used in the fifth example), an image forming apparatus was left under the high-humidity environment (28° C., 85%) for eight hours whenever the photosensitive drum rotates 50,000 turns and then the number of rotations of the photosensitive drum until a phenomenon in which an image becomes white reoccurs was examined by setting the measurement width of the image concentration to about 8.4 mm (600 dpi: 200 pixels). As a result, the result shown in FIG. 44 was obtained.

Figure 45:
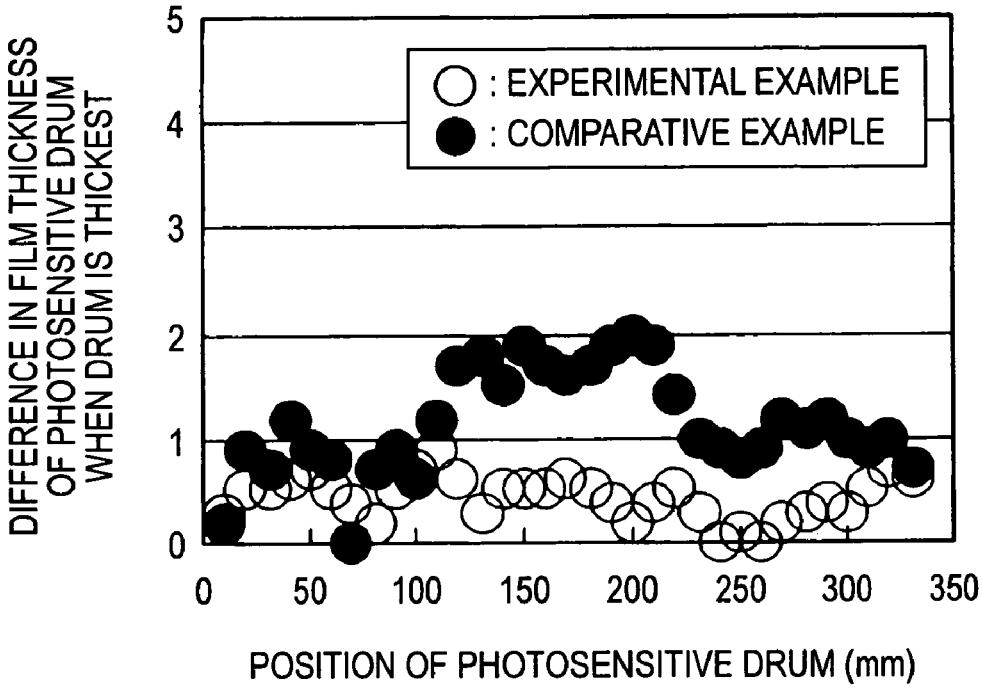
FIG. 45 is an explanatory view illustrating the relationship between the position of the photosensitive drum and the difference in the film thickness of the photosensitive drum when the photosensitive drum is thickest.

In addition, in the fifth example and the fifth comparative example, the relationship between the position of the photosensitive drum and the difference in the film thickness of the photosensitive drum when the photosensitive drum is thickest was examined after rotating the photosensitive drum 250,000 turns, and as a result, the result shown in FIG. 45 was obtained.

Figure 44:
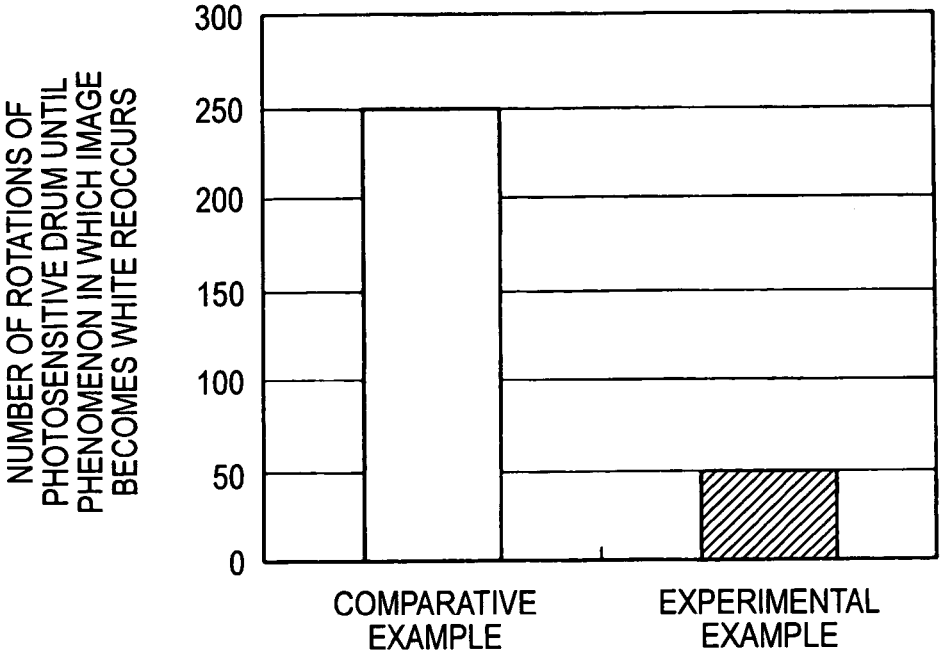
FIG. 44 is an explanatory view illustrating the number of rotations of a photosensitive drum until a phenomenon in which an image becomes white reoccurs in the fifth example and a fifth comparative example.

Referring to FIG. 44, in the fifth example, it can be seen that, even if the image forming apparatus is left under the high-humidity environment for a long time, it is possible to prevent the phenomenon, in which an image becomes white, from occurring by the number of rotations of the photosensitive drum smaller than that in the fifth comparative example.

In addition, referring to FIG. 45, the abrasion amount of the photosensitive drum is approximately uniform in the fifth example, but the abrasion amount of the photosensitive drum is not uniform in the fifth comparative example. Accordingly, it can be seen that the result obtained in fifth example is excellent from the view point of the uniformity of the abrasion amount of the photosensitive drum.

SIXTH EXAMPLE

Next, it will be described about an evaluation result on how a phenomenon, in which an image becomes white, occurs and the abrasion amount of the photosensitive drum 1012 by using the image forming apparatus 1100.

Here, specifications of main members and main electrical specifications will be described.

Fixed pad 1050: Nonwoven fabric 1058: WP8085

- Sponge 1054: foaming urethane
- Thickness of sponge 1054: 3 mm
- Nip width between fixed pad 1200 and photosensitive drum 1012: 5 mm Rotating brush 1040: Brush fiber: UU nylon

- Fiber diameter: 0.5 d (denier)
- Fiber length: 2.5 mm
- Embedded amount: 1 mm
- Diameter ϕ of rotating brush 1040: 10 mm
- Applied bias: −800 V Process speed: 1208 mm/sec.

Evaluation environment: temperature of 28° C., humidity of 80%

In addition, the evaluation has been performed by consecutively printing 100,000 A3-size sheets of recording paper.

Figure 51:
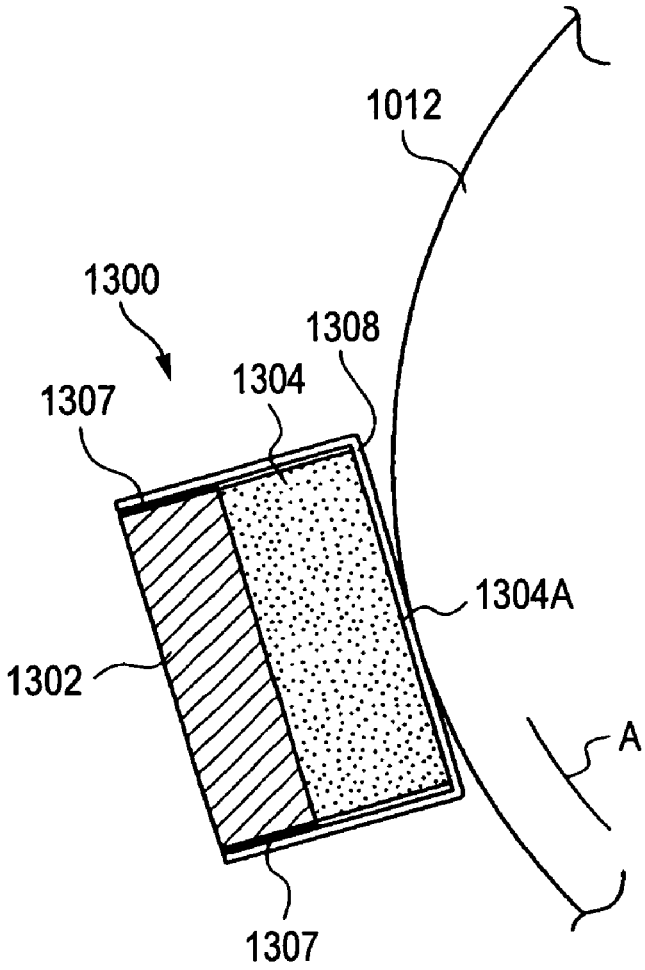
FIG. 51 is a cross-sectional view illustrating a fixed pad in a comparative example.
Figure 52:
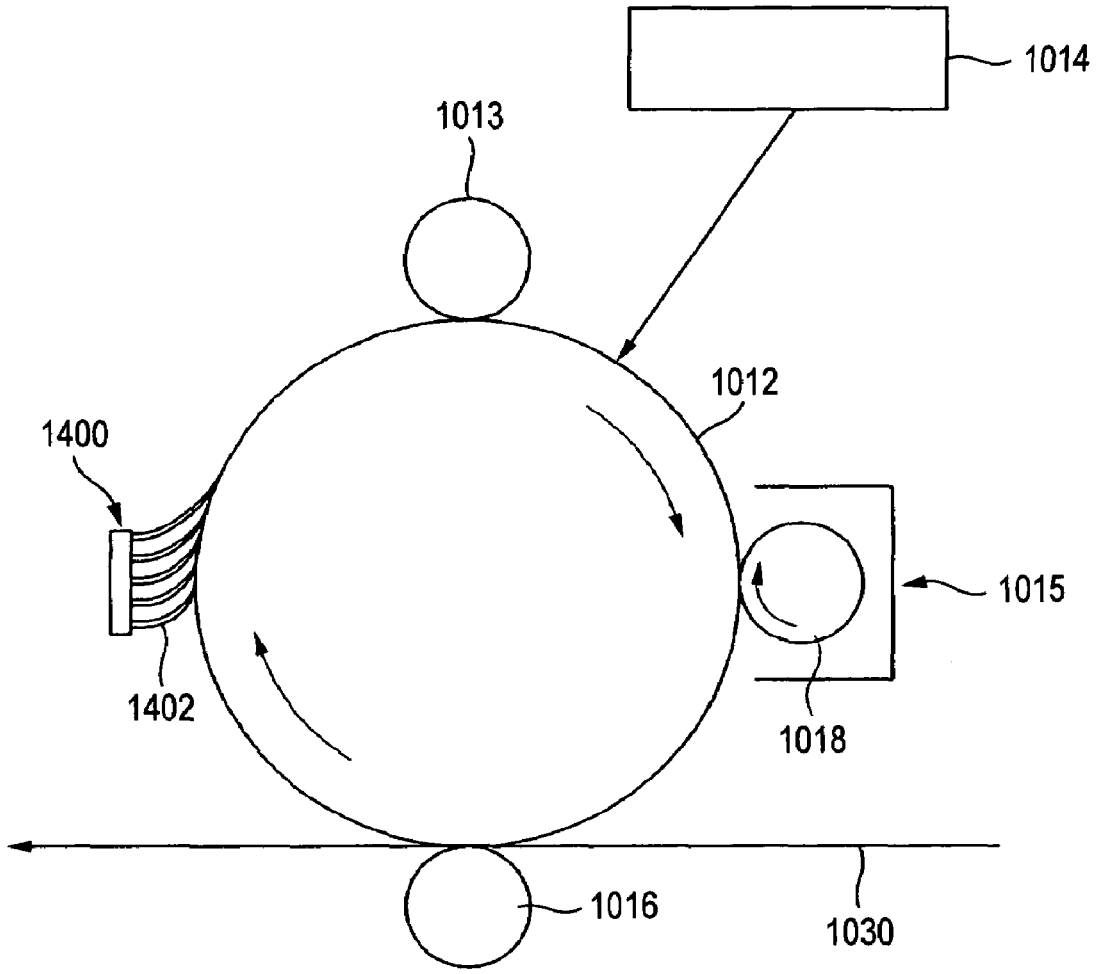
FIG. 52 is a view illustrating the configuration of a conventional image forming apparatus using a fixed brush for controlling the toner charge.
Figure 53:
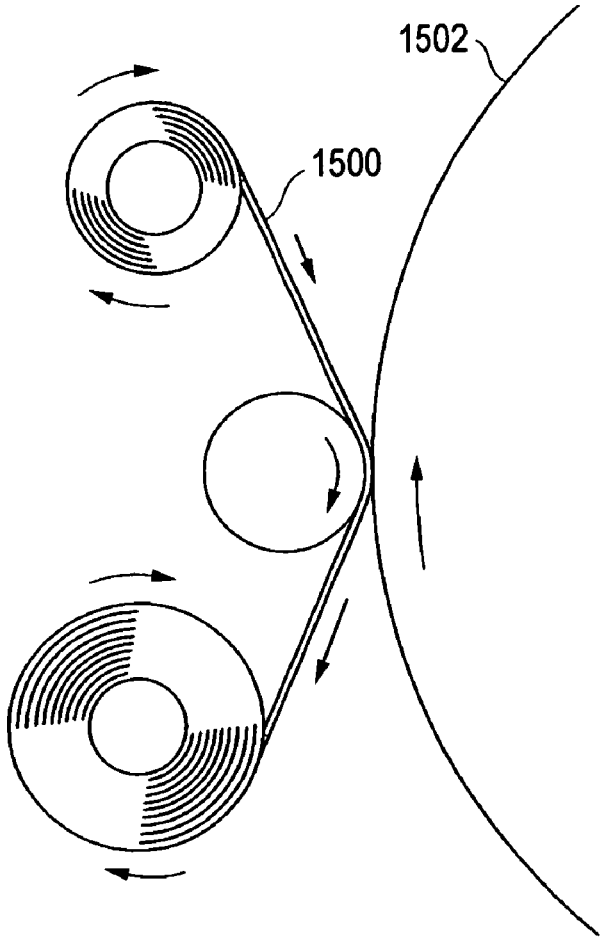
FIG. 53 is a view illustrating the configuration of a conventional image forming apparatus using a method in which a nonwoven fabric is wound.

Further, in a comparative example, a fixed pad 1300 shown in FIG. 51 was used. In the fixed pad 1300, a plate-shaped sponge 1304 is adhered to a plate-shaped support body 1302. A surface 1304A of the sponge 1304 facing the photosensitive drum 1012 is approximately flat. In addition, the surface 1304A of the sponge 1304 is covered by a nonwoven fabric 1308, and the nonwoven fabric 1308 is adhered to the support body 1302 at the upstream and downstream sides of the process direction (direction indicated by an arrow A) by using an adhesive 1307.

Table 1 shows an evaluation result on how a phenomenon, in which an image becomes white, occurs according to the embedded amount of a fixed pad.

How the phenomenon in which an image becomes white occurs was observed by naked eyes. In the evaluation result shown in table 1, ○ represents a case in which the phenomenon, in which an image becomes white, does not occur and the image quality is good, Δ represents a case in which the phenomenon, in which an image becomes white, occurs a little but the image quality is within the allowable level, and X represents a case in which the phenomenon, in which an image becomes white, occurs and the image quality is not satisfactory.

In addition, the embedded amount was obtained by mounting a fixed pad on a measuring jig and measuring the length of a brush fiber protruding from the circumferential surface position of the photosensitive drum 1012.

TABLE 1

| embedded amount (mm) | fixed pad 1300 sponge (flat surface) + nonwoven fabric | fixed pad 1050 sponge (curved surface) + nonwoven fabric |
|---|---|---|
| 0.2 | X | Δ |
| 0.5 | X | ○ |
| 0.7 | X | ○ |
| 1.0 | Δ | ○ |
| 1.5 | ○ | ○ |
| 2.0 | ○ | ○ |

As shown in table 1, in the fixed pad 1050 of the present embodiment, it has been confirmed that the evaluation result is Δ when the embedded amount is 0.2 mm, but the evaluation result is ○ when the embedded amount is larger than 0.2 mm and thus the phenomenon in which an image becomes white barely occurs.

On the other hand, in the fixed pad 1300 of the comparative example, it has been confirmed that, when the embedded amount is equal to or larger than 1.5 mm, the evaluation result is ○ and thus the phenomenon in which an image becomes white barely occurs, however, when the embedded amount is equal to or smaller than 0.7 mm, the evaluation result is X and thus the phenomenon in which an image becomes white occurs as the embedded amount decreases.

Table 2 shows an evaluation result on the abrasion amount of the photosensitive drum 1012 according to the embedded amount of a fixed pad.

In the evaluation result shown in table 2, ○ represents a case in which the abrasion amount is equal to or smaller than 10 nm/cyc and thus the abrasion amount is an allowable level, and X represents a case in which the abrasion amount is larger than 10 nm/cyc and thus the abrasion amount is not the allowable level. In addition, the abrasion amount was obtained by measuring the abrasion amount of a photosensitive drum after 100,000 sheets of paper were printed and then calculating the abrasion amount per rotation (nm/cyc) of the photosensitive drum.

TABLE 2

| embedded amount (mm) | fixed pad 1300 sponge (flat surface) + nonwoven fabric | fixed pad 1050 sponge (curved surface) + nonwoven fabric |
|---|---|---|
| 0.2 | ○ | ○ |
| 0.5 | ○ | ○ |
| 0.7 | X | ○ |
| 1.0 | X | ○ |
| 1.5 | X | X |
| 2.0 | X | X |

As shown in table 2, in the fixed pad 1050 of the present embodiment, it has been confirmed that the evaluation result is X when the embedded amount is 1.5 mm, but the evaluation result is ○ when the embedded amount is equal to or smaller than 1.0 mm, and thus the abrasion amount of the photosensitive drum 1012 is small when the embedded amount is small.

On the other hand, in the fixed pad 1300 of the comparative example, it has been confirmed that the evaluation result is ○ when the embedded amount is equal to or smaller than 0.5 mm, but the evaluation result is X when the embedded amount is equal to or larger than 0.7 mm, and thus the abrasion amount of the photosensitive drum 1012 is large.

As can be seen from the results shown in tables 1 and 2, in the fixed pad 1050 according to the present embodiment, when the embedded amount is within a range of 0.5 mm to 1.5 mm, the phenomenon in which an image becomes white does not occur and the abrasion amount of the photosensitive drum 1012 is small. On the other hand, in the fixed pad 1300 of the comparative example, there is no embedded amount satisfying both the phenomenon in which an image becomes white and the abrasion amount of the photosensitive drum 1012.

As such, when the fixed pad 1050 of the present embodiment is used, it has been confirmed that it is possible to suppress the phenomenon in which an image becomes white by pressing the nonwoven fabric 1058 against the photosensitive drum 1012 by means of the curved surface 1054A of the sponge 1054 even though the number of prints increases and that the abrasion amount of the photosensitive drum 1012 is also small.

Further, in the present embodiment, even though the front end portion 1058A of the nonwoven fabric 1058 has been a free end, the invention is not limited thereto. For example, it is possible to use a configuration in which the front end portion 1058A of the nonwoven fabric 1058 is adhered to a support body at the downstream side of the process direction with a gap interposed between the front end portion 1058A of the nonwoven fabric 1058 and a sponge. With this configuration, it is possible to prevent the nonwoven fabric 1058 from wrinkling between the sponge and the photosensitive drum 1012 and to prevent the sponge from deforming.

Furthermore, in the present embodiment, even though the nonwoven fabric 1058 has been used as a sheet-shaped member interposed between the sponge 1054 and the photosensitive drum 1012, the invention is not limited to the nonwoven fabric 1058. For example, it is possible to use a fabric or a sheet other than the nonwoven fabric, as long as it is a sheet-shape member capable of easily hold toner or discharge products.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

The entire disclosure of Japanese Patent Applications Nos. 2005-274536, 2005-274509, 2005-274026 filed on Sep. 21, 2005 including specifications, claims drawings and abstracts is incorporated herein by reference in its entirety.

What is claimed is:

1. An image forming apparatus comprising:

an image carrier that rotates in a predetermined direction so as to carry a toner image;

a charging member that charges the image carrier by a discharge operation;

a toner holding member that is disposed to be in contact with the image carrier so as to hold toner in a portion being in contact with the image carrier and that removes a discharge product generated on the image carrier; and a holding amount adjusting unit that adjusts a toner holding amount of the toner holding member, the holding amount adjusting unit including:

an estimation unit that estimates a current toner holding amount of the toner holding member; and a correction unit that corrects, the toner holding amount of the toner holding member on a basis of an estimation result obtained from the estimation unit, wherein the estimation unit estimates and updates the current toner holding amount of the toner holding member on a basis of input image information.

2. The image forming apparatus according to claim 1, wherein the adjustment of the toner holding amount by the holding amount adjusting unit is executed by a timing signal that represents that the toner holding amount needs to be adjusted as a trigger.

3. The image forming apparatus according to claim 1, wherein the estimation unit estimates the current toner holding amount for a unit of a plurality of blocks in a region along a longitudinal direction of the toner holding member.

4. The image forming apparatus according to claim 1, wherein the correction unit rotates the image carrier by a predetermined number of rotations, makes a corrected image for correcting the toner holding amount of the toner holding member on the image carrier, and rubs the corrected image on the toner holding member through the image carrier.

5. The image forming apparatus according to claim 1, wherein the correction unit makes corrected images corresponding to a plurality of blocks, respectively, the plurality of blocks being obtained by dividing a region along a longitudinal direction of the toner holding member.

6. The image forming apparatus according to claim 1, wherein the correction unit corrects the toner holding amount such that a toner holding amount per unit length of the toner holding member is equal to or larger than a predefined allowable amount.

7. The image forming apparatus according to claim 1, wherein the correction unit corrects the toner holding amount such that a toner holding amount per unit length of the toner holding member is equal to or larger than a predefined allowable amount and a toner holding amount per unit length of the toner holding member is approximately uniform along a longitudinal direction of the toner holding member.

8. The image forming apparatus according to claim 1, wherein the correction unit classifies estimation result information obtained from the estimation unit into divisions by a threshold value and makes a corrected image, having concentration distribution opposite to the current toner holding amount, for each of the classified divisions.

* * * * *